US010976091B2

(12) United States Patent
Kim

(10) Patent No.: US 10,976,091 B2
(45) Date of Patent: Apr. 13, 2021

(54) REFRIGERATOR

(71) Applicant: LG Electronics Inc., Seoul (KR)

(72) Inventor: Yonghyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 96 days.

(21) Appl. No.: 16/186,259

(22) Filed: Nov. 9, 2018

(65) Prior Publication Data

US 2019/0145686 A1 May 16, 2019

(30) Foreign Application Priority Data

Nov. 10, 2017 (KR) ..... 10-2017-0149939

(51) Int. Cl.
*F25C 5/185* (2018.01)
*F25C 1/04* (2018.01)
(Continued)

(52) U.S. Cl.
CPC ..... *F25C 5/185* (2013.01); *F25C 1/04* (2013.01); *F25C 1/24* (2013.01); *F25C 5/22* (2018.01);
(Continued)

(58) Field of Classification Search
CPC .... F25C 5/185; F25C 1/24; F25C 5/22; F25C 1/04; F25C 2305/022; F25D 2317/0671; F25D 2317/061; F25D 17/08; F25D 23/02
See application file for complete search history.

(56) References Cited

U.S. PATENT DOCUMENTS 6,745,586 B1 * 6/2004 Reimann ..... B60H 1/00371 62/244
7,237,393 B2 * 7/2007 Chung ..... F25C 5/187 62/137
(Continued)

FOREIGN PATENT DOCUMENTS

CN 101379352 3/2009
CN 103185446 7/2013
(Continued)

OTHER PUBLICATIONS

Extended European Search Report in European Application No. 18204796.9, dated Apr. 26, 2019, 7 pages.
(Continued)

*Primary Examiner* — Emmanuel E Duke
(74) *Attorney, Agent, or Firm* — Fish & Richardson P.C.

(57) ABSTRACT

A refrigerator includes a cabinet that defines a refrigerating compartment and a freezing compartment, a door configured to open and close at least a portion of the freezing compartment, an ice maker located adjacent to a rear surface of the door and configured to supply water to make ice automatically, to provide ice to an ice tray, and to transfer ice automatically, a cabinet duct located above the freezing compartment and configured to supply cold air to the freezing compartment or to the ice maker, an ice cover that is located above the ice maker and that includes a cover inflow hole configured to receive cold air located at a position that faces an outlet of the cabinet duct, and a supply duct that connects the cover inflow hole to the ice maker and that defines a cold air supply passage to an interior area of the ice maker.

19 Claims, 48 Drawing Sheets

(51) Int. Cl.
*F25C 1/24* (2018.01)
*F25C 5/20* (2018.01)

(52) U.S. Cl.
CPC .. *F25C 2305/022* (2013.01); *F25D 2317/061* (2013.01); *F25D 2317/0671* (2013.01)

(56) References Cited

U.S. PATENT DOCUMENTS

| | | | | |
|---|---|---|---|---|
| 2008/0236187 | A1* | 10/2008 | Kim | F25C 1/04 62/344 |
| 2010/0064716 | A1* | 3/2010 | Park | F25D 23/04 62/340 |
| 2011/0146331 | A1 | 6/2011 | Moon et al. | |
| 2011/0296864 | A1* | 12/2011 | Kim | F25C 5/22 62/344 |
| 2013/0167576 | A1* | 7/2013 | Kim | F25C 5/182 62/344 |
| 2014/0182315 | A1* | 7/2014 | Kim | F25C 5/08 62/73 |
| 2015/0082816 | A1* | 3/2015 | Park | F25C 1/04 62/66 |

FOREIGN PATENT DOCUMENTS

| | | |
|---|---|---|
| CN | 104976841 | 10/2015 |
| EP | 2685186 | 1/2014 |
| KR | 100809749 | 3/2008 |

OTHER PUBLICATIONS

Chinese Office Action in Chinese Appln. No. 201811307752.7 dated Jul. 15, 2020, 14 pages (with English translation).

* cited by examiner

REFRIGERATOR

CROSS-REFERENCE TO RELATED APPLICATION

The present application claims priority under 35 U.S.C. 119 and 35 U.S.C. 365 to Korean Patent Application No. 10-2017-0149939, filed on Nov. 10, 2017, which is hereby incorporated by reference in its entirety.

BACKGROUND

The present disclosure relates to a refrigerator.

Refrigerators are home appliances for storing foods at a low temperature. Such a refrigerator includes one or all of a refrigerating compartment for storing food in a refrigerated state and a freezing compartment for storing food in a frozen state.

Also, in recent years, a dispenser may be mounted on a front surface of a door of the refrigerator. Thus, drinking water may be dispensed through the dispenser without opening the refrigerator door.

In addition, an ice maker (an ice making device) for making ice to store the made ice may be disposed on the refrigerator door or in the storage compartment. Thus, the ice may be dispensed through the dispenser.

An automatic ice maker for detecting an amount of stored ice to perform water supply, ice making, and ice transfer is being developed as the ice maker. The ice stored in the automatic ice maker is dispensed to the outside through a dispenser.

In recent years, since a large amount of ice is used, a refrigerator having an improved structure of an ice maker itself so that an ice bin, in which made ice is stored, largely increases in capacity, or ice is more quickly made.

Representatively, a refrigerator having a grill structure in which a top surface of a cover is inclined toward an ice tray to more smoothly introduce cold air to an upper side of the ice tray is disclosed in Korean Patent Registration No. 10-0809749.

However, in the above-described structure, the cold air may be lost to the outside or a lower side of the tray while the cold air flows to the top surface of the ice tray.

In addition, a structure in which the introduced cold air is circulated on the top surface of the ice tray may not be provided to deteriorate heat-exchange efficiency with water of the ice tray.

In addition, the cold may be introduced toward the ice bin by passing through the ice tray. As a result, the stored ice may be frozen with each other due to the vaporization on a surface of the stored ice.

SUMMARY

Implementations provide a refrigerator in which a loss of cold air supplied to an ice tray is minimized so that an amount of made ice increases.

Implementations also provide a refrigerator in which circulation of cold air supplied toward an ice tray is promoted to improve ice making performance.

Implementations also provide a refrigerator in which cold air is prevented from being directly introduced into a space, in which ice is stored, to prevent the stored ice from being frozen.

Implementations also provide a refrigerator in which cold air heat-exchanged by passing through an ice tray is effectively discharged to the outside of an ice maker.

Implementations also provide a refrigerator in which a full state of made ice is accurately detected to secure an amount of made ice.

Implementations also provide a refrigerator in which cold air for making ice is effectively supplied to the inside of an ice making unit provided in a door.

In a refrigerator according to an implementation, a cabinet duct communicating with a heat-exchange space in which an evaporator is provided is provided in a cabinet, an ice maker is provided in a rear surface of a freezing compartment door, a supply duct connecting the ice maker at a side corresponding to an outlet of the cabinet duct is provided, and cold air of the evaporator is supplied to the ice maker through the supply duct.

The ice maker may include a tray accommodation part that partitions an upper space of the ice tray, and the supply duct may be inserted into an inflow space of the tray accommodation part.

An outflow space of the inflow space and the outflow space, which are partitioned by the tray accommodation part, may significantly increase in cross-sectional area.

An ice bin may be provided below the ice maker, and a cold air discharge hole defined in an upper end of the ice bin may be defined at a height corresponding to that of the ice tray.

The ice maker may have a plate shape to extend in a longitudinal direction of the ice tray and include an ice-making full ice disposed between a rear surface of the door and the ice tray and rotating to pass through the lower side of the ice tray.

In one implementation, a refrigerator includes: a cabinet providing a refrigerating compartment and a freezing compartment; a door opening and closing the freezing compartment; an ice maker provided in a rear surface of the door to automatically supply water for making ice to the ice tray and automatically transfer the ice; a cabinet duct provided above the freezing compartment to supply the cold air for cooling the freezing compartment to the ice maker; an ice cover disposed above the ice maker and having a cover inflow hole, through which the cold air is introduced, in a position facing an outlet of the cabinet duct; and a supply duct connecting the cover inflow hole to the ice maker to provide a cold air supply passage for making ice to the inside of the ice maker.

The supply duct may include: an insertion part extending to one side, which is eccentric to the rear surface of the door, of a top surface of the ice tray and inserted into the ice maker; and an extension part extending to be inclined from an upper end of the insertion part and connected to the cover inflow hole.

An opening of a lower end of the insertion part may have a surface area less than that of each of an opening of an upper end of the extension and the cover inflow hole.

The refrigerator may further include an inflow hole guide extending upward to guide the cold air discharged from the outlet of the cabinet duct to the cover inflow hole on a circumference of the cover inflow hole.

The refrigerator may further include a duct fixing part extending downward and inserted into an opened top surface of the supply duct to fix the supply duct.

The supply duct may be inserted into the ice maker and extend up to the outside of a rotation radius of the ice tray.

The supply duct may have an opened bottom surface at a position that is eccentric in front and rear directions with respect to a center line defining a rotation shaft of the ice maker.

The supply duct may partition a space above the ice tray into an inflow space into which the cold air is introduced and an outflow space from which the cold air is discharged.

The inflow space may have a volume less than that of the outflow space.

The cabinet duct may be disposed between an outer case defining an outer surface of the cabinet and an inner case spaced apart from the outer case to define the freezing compartment and communicate with a heat exchange space in which an evaporator is accommodated within the cabinet.

The cabinet duct may be mounted on a top surface of the inside of the freezing compartment and communicate with a heat exchange space in which an evaporator is accommodated within the cabinet.

The refrigerator may further include an ice bin which is provided below the ice maker and in which the ice made in the ice maker drops to be stored, wherein a lower end of the ice cover and an upper end of the ice bin may be spaced apart from each other to provide a cold air discharge hole through which the cold air heat-exchanged in the ice maker is discharged.

The ice maker maybe disposed in a rear surface-side space of the door with respect to a center line of the ice bin.

The cold air discharge hole may be defined at a height corresponding to a top surface of the ice tray.

The ice maker may include: a driving part rotating the ice tray; and a mounting bracket on which the ice tray is rotatably mounted, wherein the mounting bracket may include a tray accommodation part extending upward from a top surface of the ice tray to provide a space in which the top surface of the ice tray is accommodated, and a lower of the supply duct extends to be inserted into the tray accommodation part.

The tray accommodation part may be provided with a partition part partitioning a space within the tray accommodation part in a longitudinal direction of the ice tray into an inflow space into which the supply duct is inserted and an outflow space from which the cold air heat-exchanged in the ice tray is discharged.

The inflow space may have a volume less than that of the outflow space.

The ice maker may include a full ice detection member coupled to the driving part below the ice tray and rotating in the same direction as the ice tray to detect a full ice height of the ice bin while moving in front and rear directions, a driving shaft for the rotation of the ice tray and a detection member rotation shaft for the rotation of the full ice detection member are disposed on the same surface of the driving part, and a lever rotation shaft is disposed below an ice tray rotation shaft.

The full ice detection member may have a plate shape having a predetermined width and be bent below the ice tray to extend in a longitudinal direction of the ice tray.

The ice tray may include a plurality of cells that are partitioned to make a plurality of ices, and each of the cells has a width that gradually increases upward, and the full ice detection member may be accommodated in a space between an outer surface of the cell and the rear surface of the door in a standby state.

The details of one or more implementations are set forth in the accompanying drawings and the description below. Other features will be apparent from the description and drawings, and from the claims.

DETAILED DESCRIPTION

Hereinafter, detailed implementations of the present disclosure will be described in detail with reference to the accompanying drawings. However, the scope of the present disclosure is not limited to proposed implementations, and other regressive inventions or other implementations included in the scope of the spirits of the present disclosure may be easily proposed through addition, change, deletion, and the like of other elements.

Figure 1:
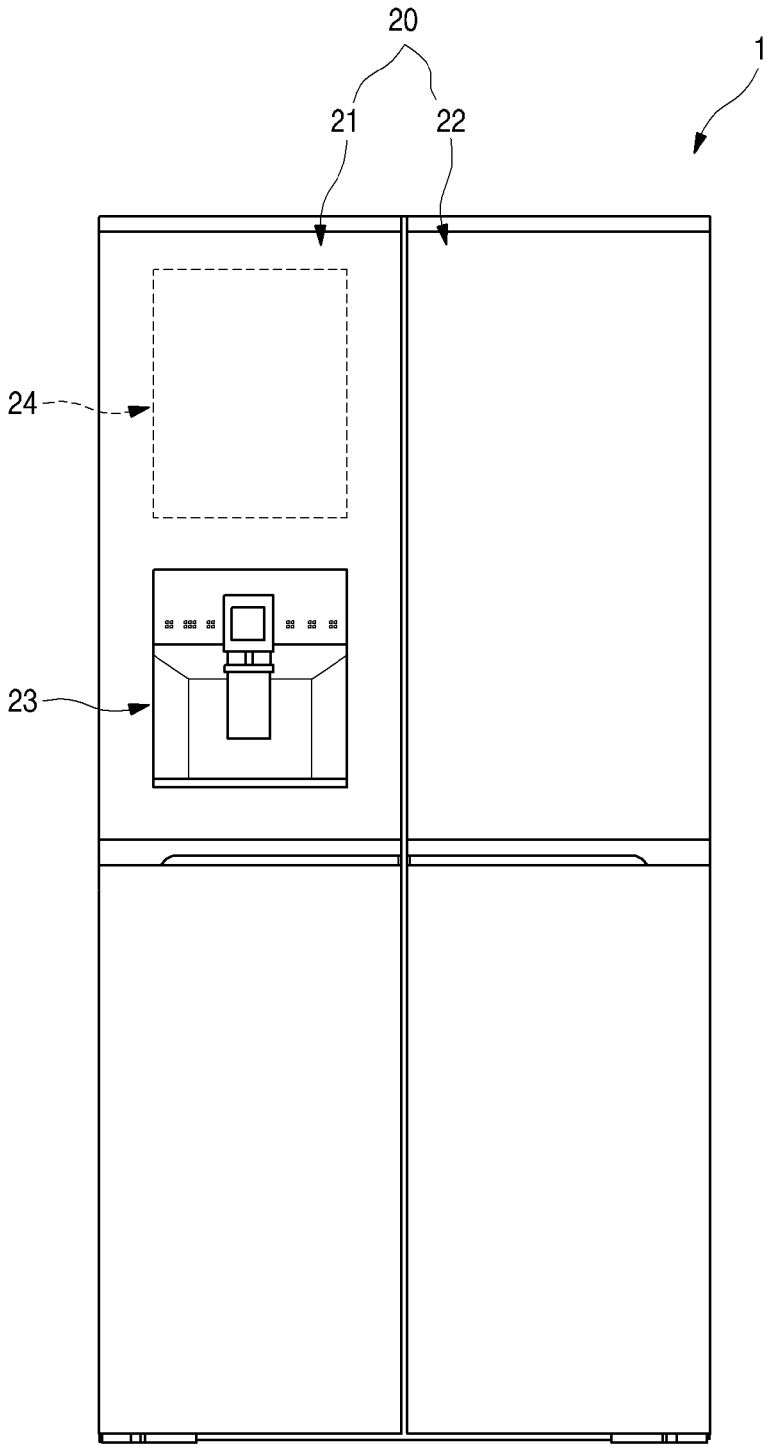
FIG. 1 is a front view of a refrigerator according to an implementation.
Figure 2:
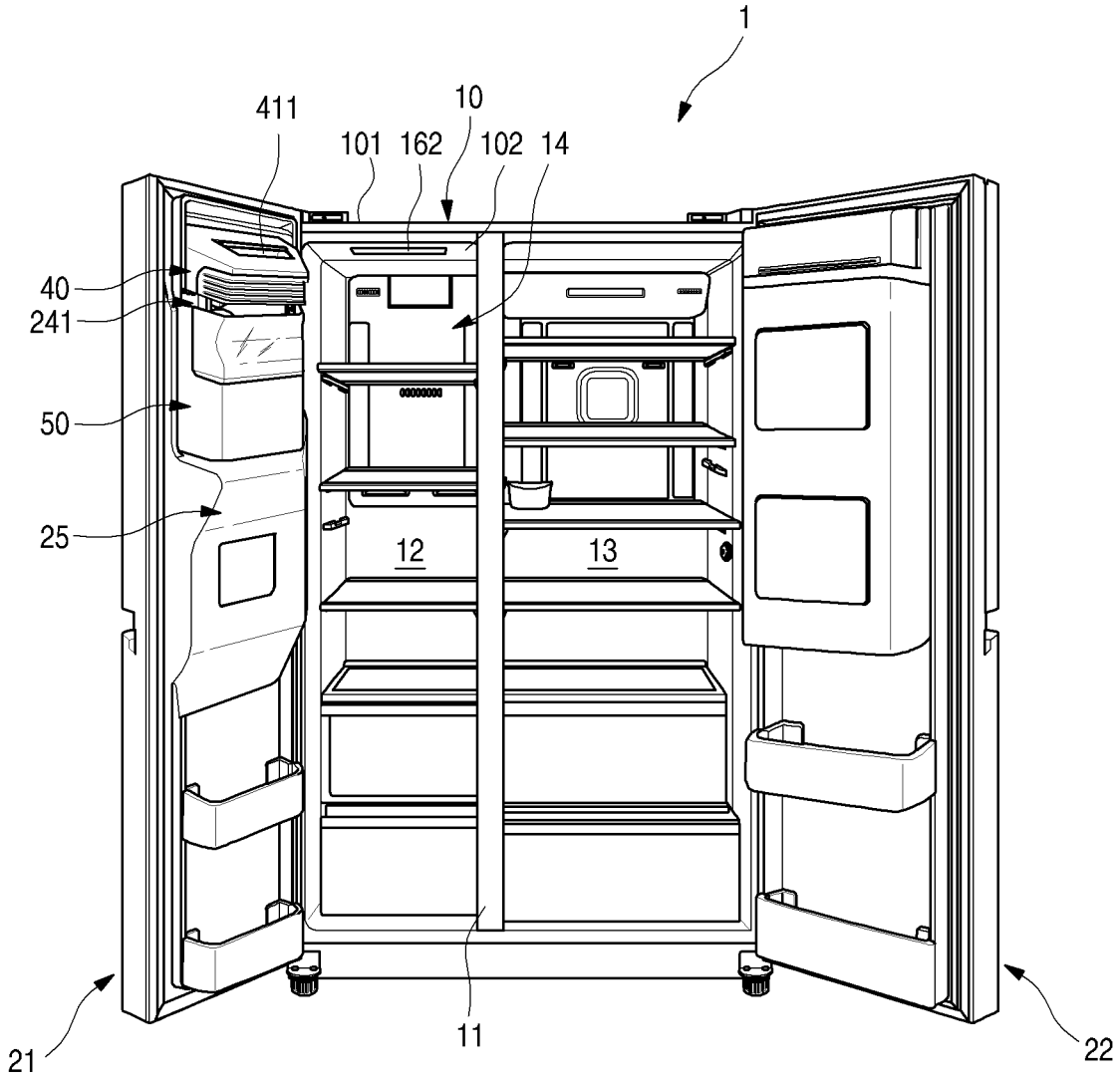
FIG. 2 is a view of the refrigerator with a door opened.

FIG. 1 is a front view of a refrigerator according to an implementation. Also, FIG. 2 is a perspective view of the refrigerator with a door opened.

Referring to drawings, a refrigerator 1 according to an implementation includes a cabinet 10 defining a storage space and a door 20 opening and closing the storage space of the cabinet 10. Here, an outer appearance of the refrigerator 1 may be defined by the cabinet 10 and the door 20.

For comprehension and convenience of description, in the refrigerator 1, a direction in which the door 20 is disposed is defined as a front direction, and a direction in which the cabinet 10 covered by the door 20 is disposed is defined as a rear direction. Also, a direction facing the ground is defined as a downward direction, and a direction opposite to the ground is defined as an upward direction.

The cabinet 10 may include an outer case 101 defining an outer surface and made of a metal material and an inner case 102 coupled to the outer case 101 to define the storage space in the refrigerator 1 and made of a resin material. Also, an insulation material 103 may be filled between the outer case 101 and the inner case 102 to insulate the inside of the refrigerator 1 from the outside.

The storage space may be partitioned in left and right spaces with respect to a barrier 11 to define a left freezing compartment 12 and a right refrigerating compartment 13. Also, a plurality of shelves and drawers are provided in the freezing compartment 12 and the refrigerating compartment 13, which are defined by the inner case 102 to independently provide a space for storing food.

The door 20 may include a refrigerating compartment door 21 and a freezing compartment door 22, which respectively independently open and close the refrigerating compartment 13 and the freezing compartment 12. The refrigerating compartment door 21 and the freezing compartment door 22 may have structures that are capable of respectively opening and closing the refrigerating compartment 13 and the freezing compartment 12 through rotation thereof. For this, all the refrigerating compartment door 21 and the freezing compartment door 22 may be rotatably connected to the cabinet 10 through a hinge device.

A dispenser 23 and an ice making unit 24 may be provided in a pair of freezing compartment door 22. Also, the dispenser 23 and the ice making unit 24 may be provided to communicate with each other by an ice chute 25. The ice making unit 24 may include at least the ice maker 60 and an ice cover 40. In some cases, the ice making unit 24 may further include at least one of an ice bin 50 and a seating member 30.

The dispenser 23 may be disposed on a front surface of the freezing compartment door 22, and a user may manipulate the dispenser 23 from the outside to dispense water or ice. Also, the ice making unit 24 may be disposed on the rear surface of the freezing compartment door 22. The ice making unit 24 may be configured to make and store ice and disposed above the dispenser 23. Also, the ice making unit 24 may communicate with the dispenser through the ice chute 25. Thus, when the dispenser 23 is manipulated, ice within the ice making unit 24 may be supplied to the dispenser 23 through the ice chute 25 and then be dispensed to the outside.

The ice chute 25 may have a structure in which the ice chute 25 protrudes to an upper side in which the ice making unit 24 is mounted and toward the inside of the refrigerator 1. An upper end of the ice chute 25 may protrude up to a position corresponding to a rear end of the ice making unit 24.

Also, the protruding portion of the ice chute 25 may be disposed in an internal region of the freezing compartment 12 in a state in which the freezing compartment door 22 is closed. Thus, both left and right surfaces of the ice chute 25 may be inclined or rounded to prevent the ice chute 25 from interfering with a wall inside the refrigerator when the freezing compartment door 22 is opened and closed.

The ice making unit 24 may made and store ice by interference cold air of cold air directly supplied from an evaporator 151 for cooling the freezing compartment 12 and cold air of the freezing compartment 12.

Particularly, when the freezing compartment door 22 is closed, a cover inflow hole 411 of the ice making unit 24 and a duct outlet 162 of the inside of the cabinet 10 are adjacent to each other to directly supply cold air into the ice making unit 24.

Figure 3:
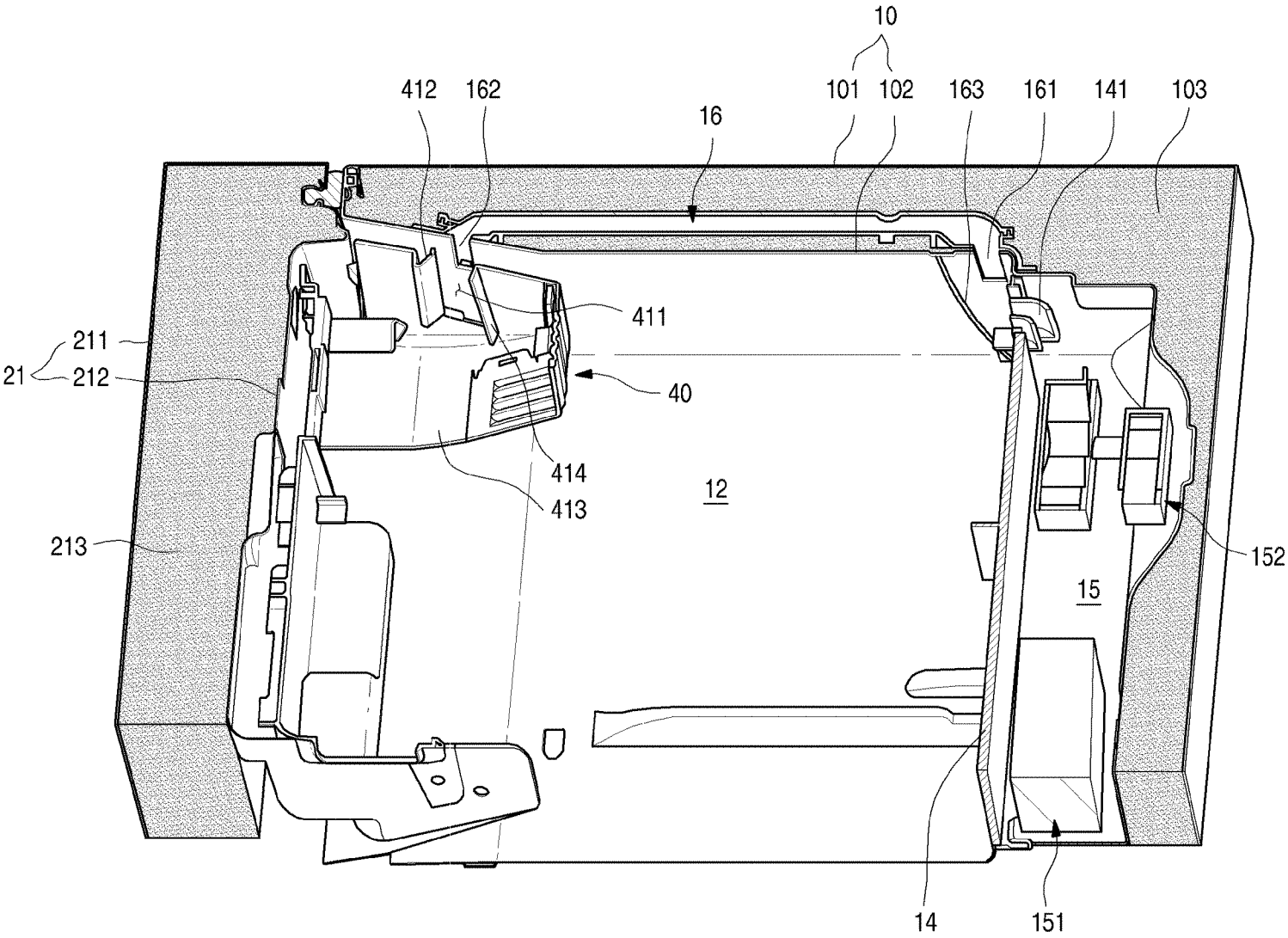
FIG. 3 is a cutaway perspective view illustrating a cabinet-side cold air flow structure of the refrigerator.

FIG. 3 is a cutaway perspective view illustrating a cabinet-side cold air flow structure of the refrigerator.

As illustrated in the drawing, a grill fan 14 is provided on a rear surface of the freezing compartment 12. The freezing compartment 12 and a heat exchange chamber 15 in which the evaporator 151 is accommodated may be partitioned from each other by the grill fan 14.

The grill fan 14 may be provided with a plurality of discharge holes 141 through which cold air is discharged into the freezing compartment 12 and a suction hole (not shown) through which air heat-exchanged in the freezing compartment 12 is introduced into the heat exchange chamber 15. A portion of the plurality of discharge holes 141 may be defined above the grill fan 14. Also, the suction hole may be defined below the grill fan 14 so that cold air is circulated in the entire inside of the freezing compartment 12.

Also, the evaporator 151 and a cooling fan 152 may be provided in the heat exchange chamber 15. The cold air generated in the evaporator 151 by rotation of the cooling fan 152 may be supplied into the freezing compartment 12 through the discharge hole 141, and the air heat-exchanged in the freezing compartment 12 may be introduced into the heat exchange chamber 15 through the suction hole. The cold air may be circulated by an operation of the cooling fan 152 to cool the freezing compartment 12 to a set temperature.

A cabinet duct 16 may be provided in an upper portion of the freezing compartment 12. The cabinet duct 16 may be disposed between the inner case 102 and an outer case 101, which define a top surface of the freezing compartment 12. Here, the cabinet duct 16 may be provided to be buried by the insulation material 103.

Also, the cabinet duct 16 may extend forward and backward. A duct inlet 161 and a duct outlet 162 may be disposed on opened front and rear ends of the cabinet duct 16, respectively.

The duct outlet 162 may be exposed to the top surface of the freezing compartment 12 and disposed on the inclined front end of the top surface of the freezing compartment 12. Also, the duct outlet 162 may be disposed at a position corresponding to the cover inflow hole 411 of the ice making unit 24. Thus, when the freezing compartment door 22 is closed, all cold air supplied through the cabinet duct 16 may be introduced into the ice making unit through the cover inflow hole 411.

The duct inlet 161 may communicate with the heat exchange chamber 15, and when the cooling fan 152 is driven, cold air generated in the evaporator 151 may be introduced into the duct inlet 161. The duct inlet 161 may be disposed at the rear end of the top surface of the freezing compartment 12. Also, the duct inlet 161 and the discharge hole 141 may communicate with each other by the duct cover 163 that allows the grill fan 14 to communicate with the duct inlet 161. Thus, the cold air within the heat exchange chamber 15 may be supplied to the cabinet duct 16 by successively pass through the discharge hole 141, the duct cover 163, and the duct inlet 161. Alternatively, the duct inlet 161 may extend up to the heat exchange chamber 15 to directly communicate with the heat exchange chamber 15.

In this structure, when the temperature of the freezing compartment 12 is not satisfied, the cooling fan 152 may be driven to cool the freezing compartment 12. In addition, when ice is made in the ice making unit 24, the cooling fan 152 may be also driven to directly supply cold air to the ice making unit 24.

The supply of the cold air into the freezing compartment 12 and the ice making unit 24 may be performed at the same time. A separate damper may be provided in the discharge hole 141 and/or the cabinet duct 16 to selectively supply the cold air into the freezing compartment 12 and the ice making unit 24.

Figure 4:
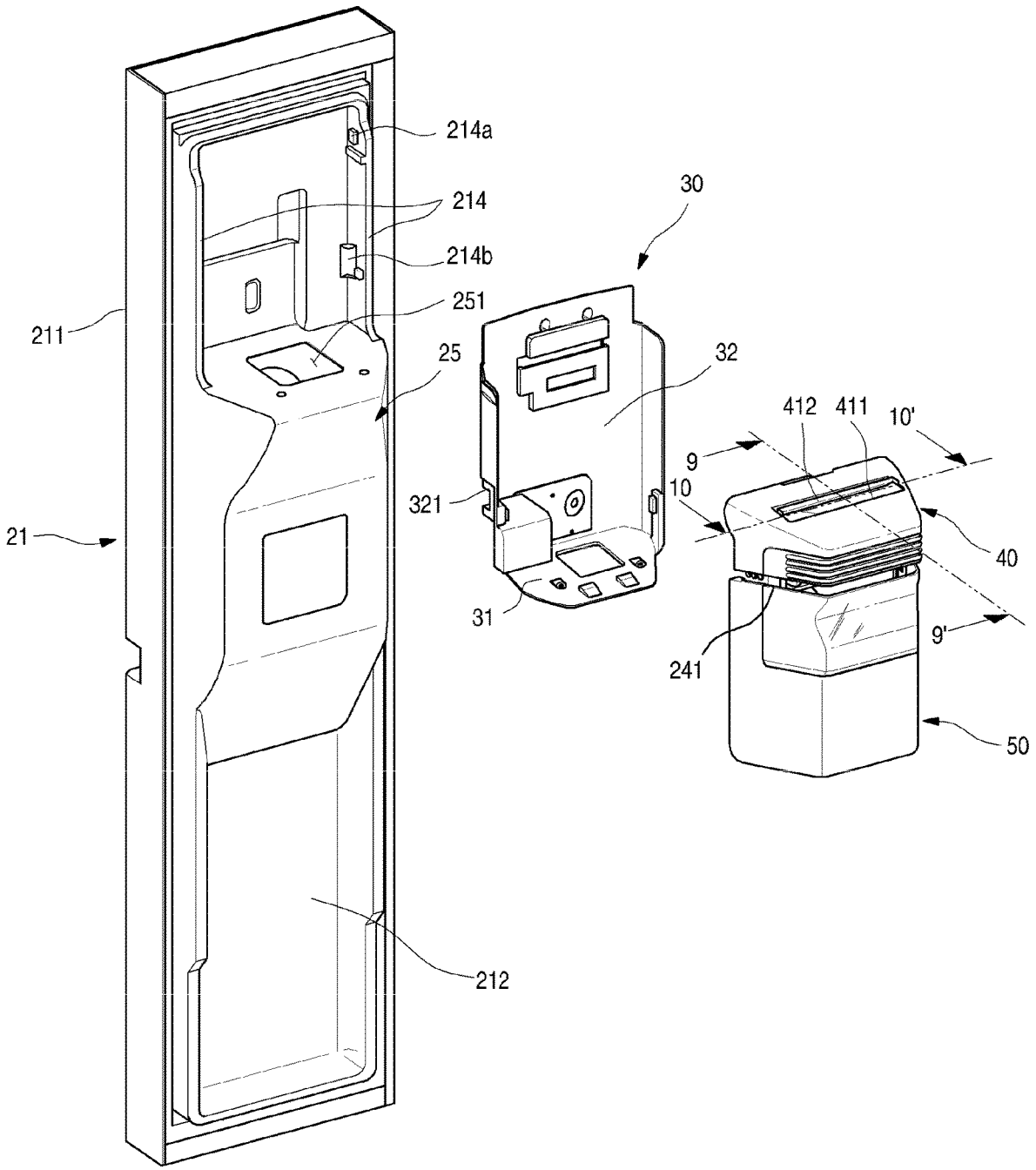
FIG. 4 is an exploded perspective view illustrating a coupling structure of the door and an ice making unit.

FIG. 4 is an exploded perspective view illustrating a coupling structure of the door and the ice making unit.

As illustrated in the drawing, the freezing compartment door 22 may include an outer plate 211 defining a front surface, a door liner 212 defining a rear surface, and an insulation material 213 filled between the outer plate 211 and the door liner. Also, a cap deco may be mounted on each of top and bottom surfaces of the freezing compartment door 22 to define the top and bottom surfaces of the freezing compartment door 21.

A dike 214 may protrude backward from a circumference of a rear surface of the door liner 212. Particularly, a seating member mounting part 214*b* and a cover mounting part 214*a* for mounting the ice making unit 24 and the ice cover 40 may be disposed on both left and right sides of the door liner 212, respectively.

Also, the ice chute 25 may be disposed on the door liner 212 above the dispenser 23. The ice chute 25 may provide a passage through which the ice making unit 24 and the dispenser 23 communicate with each other and support the ice making unit 24 at a lower side.

The ice chute 25 may have a top surface that is perpendicular to the rear surface of the door liner 212 and has a shape corresponding to the bottom surface of the ice making unit 24. Also, a chute opening 251 may be defined in the top surface of the ice chute 25. The chute opening may serve as a passage through which the ice making unit 24 and the dispenser 23 are connected to each other and guide the ice discharged from the ice making unit 24 to the dispenser 23.

A seating member 30 on which the ice making unit 24 is mounted may be disposed on the rear surface of the freezing compartment door 22, which faces the ice making unit 24. The seating member may have a structure that is closely attached to the door liner 212.

Also, the seating member mounting part 214*b* disposed on the door dike 214 may be coupled to a seating member coupling part 321 disposed on the seating member 30. Thus, the seating member 30 may be fixed and mounted on the door liner 212. Also, the ice making unit 24 may be mounted on the seating member 30 so that the ice making unit 24 is substantially mounted on the rear surface of the freezing compartment door 21.

Also, the cover mounting part 214*a* may be disposed on the door dike 214 above the seating member mounting part 241*b*. The cover mounting part 214*a* may be disposed at a position corresponding to the cover coupling part 43 disposed on each of both sides of the ice cover 40. The ice cover 40 may be fixed and mounted on the door liner 212 by the cover mounting part 214*a* and the cover coupling part 43.

The ice maker 60 for making ice and the ice bin 50 in which the ice made in the ice maker 60 is stored may be mounted on the seating member 30. Also, the ice bin 50 may be detachably disposed on the seating member 30.

When the ice cover 40 is mounted, the ice maker 60 may be covered. The ice bin 50 may be disposed below the ice maker 60 and the ice cover 40. Also, a cold air discharge hole 241 through which air within the ice making unit 24 is discharged may be defined between the ice cover 40 and the ice bin 50 so that the air within the ice making unit 24 is circulated.

Figure 5:
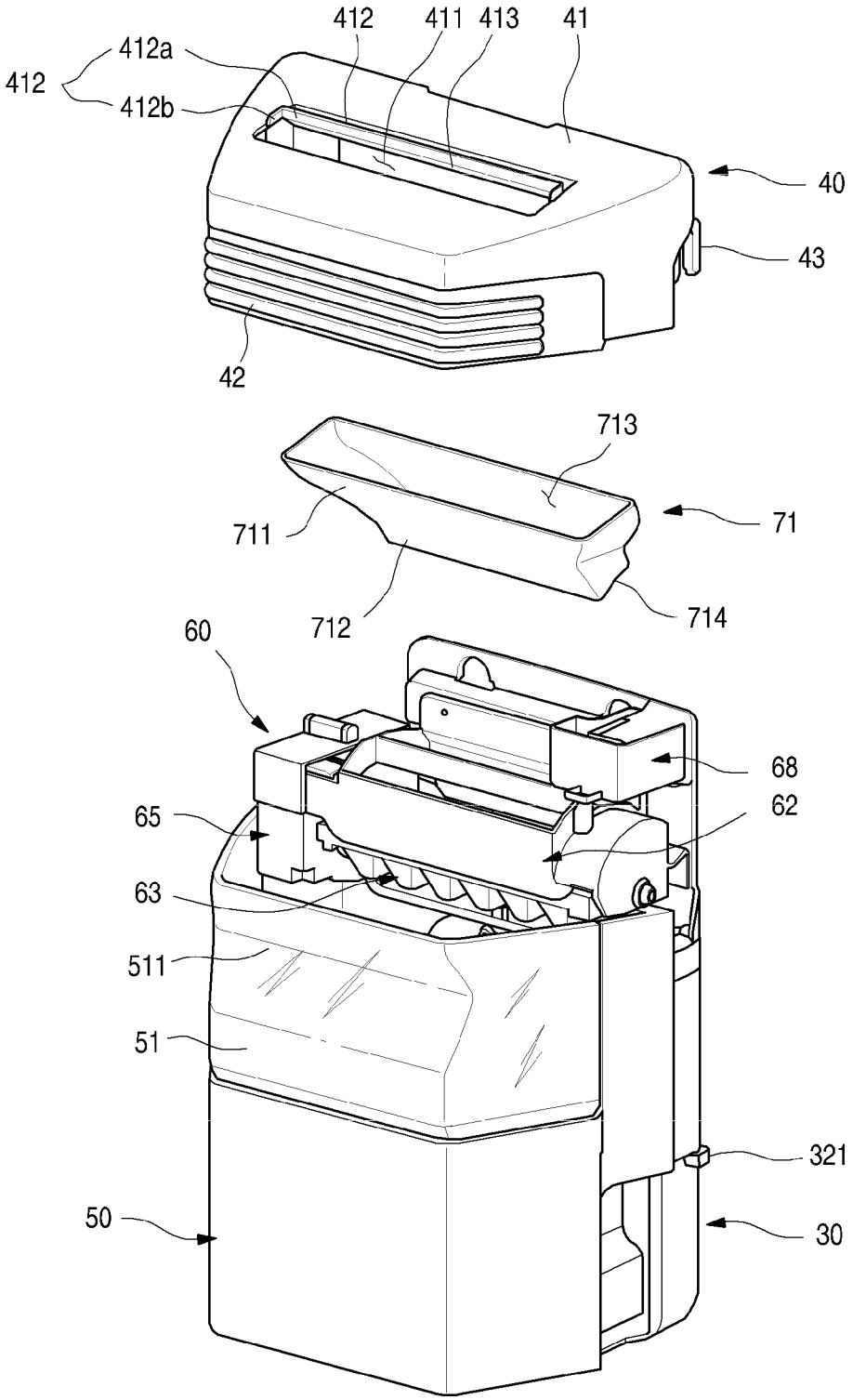
FIG. 5 is an exploded perspective view of the ice making unit.
Figure 6:
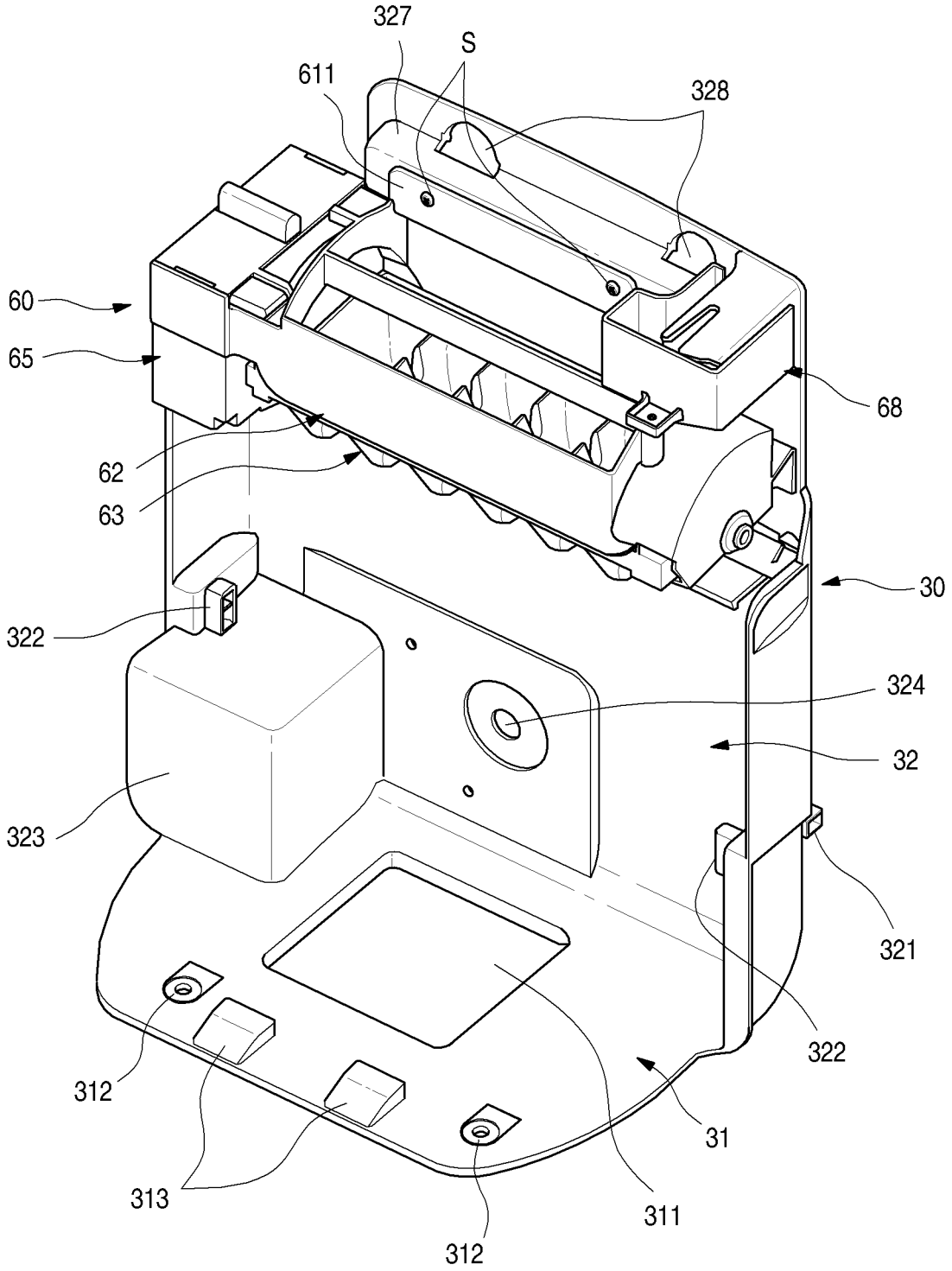
FIG. 6 is a front perspective view illustrating a state in which an ice maker that is one component of the ice making unit is mounted.
Figure 7:
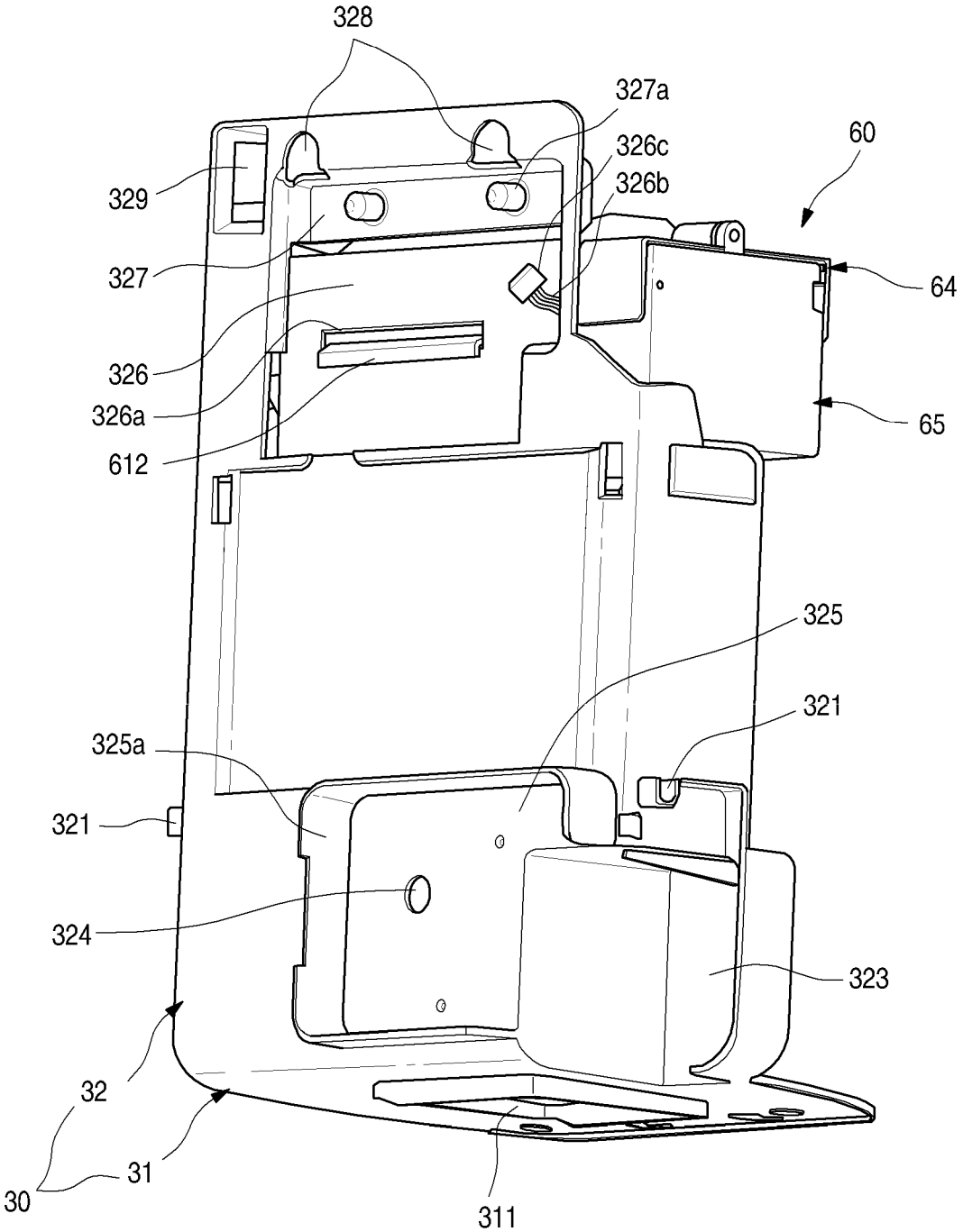
FIG. 7 is a rear perspective view illustrating the state in which the ice maker is mounted.

FIG. 5 is an exploded perspective view of the ice making unit. Also, FIG. 6 is a front perspective view illustrating a state in which the ice maker that is one component of the ice making unit is mounted. Also, FIG. 7 is a rear perspective view illustrating a state in which the ice maker is mounted.

As illustrated in the drawings, the ice making unit 24 may include the ice maker 60 fixed and mounted on the seating member 30 to make ice, the ice bin 50 disposed below the ice maker 60 to store the ice, and the ice cover 40 disposed above the ice bin 50 to cover the ice maker 60 on the whole. Alternatively, the ice making unit 24 may include the seating member 30. Thus, the ice making unit 24 may be independently mounted on the rear surface of the freezing compartment door 21 without the separate seating member 30. The rear surface of the freezing compartment door 21 and the inner surface of the seating member 30 may be substantially the same.

The seating member 30 may include a support surface 31 coming into contact with the ice chute 25 and a mounting surface 32 vertically extending from a rear end of the support surface 31 and fixed to the rear surface of the freezing compartment door 21.

A support surface opening 311 communicating with the chute opening 251 of the ice chute 25 may be defined in a center of the support surface 31. Also, a screw hole 312 to which a screw for coupling the support surface 31 to a top surface of the ice chute 25 may be defined in the support surface 31. Also, a support surface restriction part 313 for fixing the ice bin 50 mounted on the seating member 30 may protrude from a rear end of the support surface 31. The support surface restriction part 313 may extend to have an inclination that gradually increases in height toward the mounting surface 32 so that the support surface restriction part 313 is easily mounted and also easily restricted after being mounted by the rotation of the ice bin 50. An extending end of the support surface restriction part 313 may be vertically disposed to face the support surface 31.

The mounting surface 32 may be recessed in a shape corresponding to that of the door liner 212. That is, both left and right ends of the mounting surface 32 may be perpendicular to the extending direction to define side surface parts. Also, an ice bin mounting part 322 for detaching the ice bin 50 may protrude inward from each of the side surface parts. The ice bin mounting part 322 may have a protrusion shape extending in a vertical direction. Thus, the ice bin 50 may vertically move to be detached. Also, left and right surfaces of the ice bin 50 may be fixed by the ice bin mounting part 322, and a bottom surface of the ice bin 50 may be coupled to the support surface restriction part 313 so as to be fixed.

A shaft hole 324 may be opened at a lower center of the mounting surface 32, and thus, a shaft rotating by an ice bin motor 54 may pass through the shaft hole 324. Also, the shaft may be coupled to an ice transfer member 52 within the ice bin 50.

A motor accommodation part 323 on which the ice bin motor 54 is mounted may be defined in one surface of the mounting surface 32 and one side of an edge of the support surface 31. The motor accommodation part 323 may protrude between the mounting surface 32 and the support surface 31.

In detail, a gear box mounting part 325 on which a gear box 55 connected to the ice bin motor 54 may be disposed on a front surface of the mounting surface coming into contact with the door liner 212. The gear box 55 may be disposed at a front side of the shaft hole 324 and include the shaft passing through the shaft hole and connected to the ice bin motor 54 through a plurality of gears. The ice bin motor 54 and the gear box 55 may be provided as one module and be fixed and mounted on the gear box mounting part 325 and the motor accommodation part 323.

Thus, the gear box mounting part 325 may communicate with the motor accommodation part 323 and define a space in which the gear box 55 is mounted by a mounting part rib 325*a* protruding forward from the mounting surface 32. Here, the shaft hole 324 may be defined in an internal region of the gear box mounting part 325.

An ice maker mounting part 326 may be defined above the mounting surface 32. The ice maker mounting part 326 may be a space that is defined by recessing an upper portion of the mounting surface 32 backward. The ice maker 60 may be fixed and mounted on the mounting surface 32.

Also, a space in which a wire 326*b* and a connector 326*c*, which are connected to the ice maker 60, are accommodated may be defined the internal space of the recessed ice maker mounting part 326. Thus, when the ice maker 60 is mounted, the wire 326*b* and the connector 326*c*, which are connected to the ice maker 60, may be accommodated between the ice maker mounting part 326 and the door liner 212. For this, a recessed structure may be provided in one side of the door liner 212 corresponding to the ice maker mounting part 326.

Also, a mounting slit 326*a* may be provided in the ice maker mounting part 326. The mounting slit 326*a* may be lengthily defined in a horizontal direction. A bracket restriction part 612 disposed on a front surface of the mounting bracket 61 may be inserted into and fixed to the mounting slit 326*a*. The bracket restriction part 612 may accommodate a lower end of the mounting slit 326*a* in a state of being inserted into the mounting slit 326*a* so that the ice maker 60 is fixed to the ice maker mounting part 326.

Also, the ice maker seating part 327 may protrude backward from an upper portion of the ice maker mounting part 326. The front surface of the ice maker seating part 327 may have a recessed shape, and a screw boss 327*a* to which a screw S for fixing the ice maker 60 is coupled may be disposed in the ice maker seating part 327. The screw boss 327*a* may extend to a height corresponding to the front surface of the mounting surface to come into contact with the door liner 212 so as to be supported.

A mounting part 611 disposed on an upper end of the mounting bracket 61 may be seated on a rear surface of the ice maker seating part 327. When the screw S is coupled by passing through the mounting part 611, the ice maker 60 may be fixed to the seating member 30. Here, the mounting bracket 61 may be mounted with a structure that is completely closely attached to the seating member 30. That is, the mounting bracket 61 may be closely attached so that the cold air does not flow downward into a space between the seating member 30 and the ice maker 60.

Also, the mounting part 611 may be seated on the protruding ice maker seating part 327 and fixed to the mounting bracket 61. In the state in which the mounting bracket 61 is fixed, and the ice maker 60 is mounted, the front surface of the ice maker 60 below the mounting part 611 may be disposed to be closely attached to the mounting surface 32. That is, the ice maker 60 may be disposed closet to the rear surface of the freezing compartment door 21 in the recessed region of the rear surface of the freezing compartment door 22 to secure a horizontal length of the ice tray 63 and also prevent the cold air supplied from the upper side from pass downward through a space between the front surface of the ice tray 63 and the seating member 30.

Also, a cover mounting hole 328 into which a cover protrusion 415 protruding from a rear end of the ice cover 40 is inserted may be further provided in an upper end of the mounting surface 32. Thus, the rear end of the ice cover 40 may be fixed and mounted on the seating member 30, and left and right ends of the ice cover 40 may be fixed and mounted on the door dike 214.

Also, a tube hole 329 through a tube or a nozzle for supplying water are accessible may be defined in the mounting surface of one side of the cover mounting hole 328, and the tube hole 329 may communicate with a water supply cup 68 for supplying water into the ice tray 63.

The ice bin 50 may have a box shape in which the ice made in the ice maker 60 drops to be stored. Also, a see-through part 51 may be provided on upper portions of the front and side surfaces of the ice bin 50. The see-through part 51 may be made of a transparent material so that the inside of the see-through part 51 is seen. Thus, an amount or state of the ice stored in the ice bin 50 may be confirmed through the see-through part 51.

Also, a protrusion part 511 protruding inward from the ice bin 50 may be disposed on the see-through part. The protrusion part 511 may be disposed at a position corresponding to a full ice height of the ice bin 50. Thus, ices disposed at the rear portion of the ice bin, which are far away from the full ice detection member 67, of ices disposed adjacent to the full ice height within the ice bin 50 may be pushed toward the ice maker 60, and thus, the ices may be induced to a region in which the ices are capable of being detected by the full ice detection member 67.

An auger rotating for preventing ice within the ice bin 50 from being frozen and an ice transfer member 52 selectively discharging an ice cube or an ice patch of the ices within the ice bin 50 may be disposed in a region below the see-through part 51. Since the ice transfer member 52 discharges ice patches, the ice transfer member 52 may be called a crusher. The auger 53 and the ice transfer member 52 may be connected to the ice bin motor 54 and the gear box 55 and then be driven in the state in which the ice bin 50 is mounted.

Also, a portion of the inner surface of the ice bin 50 on which the auger 53 and the ice transfer member 52 may be inclined to guide the ice dropping from the ice maker 60 to the ice transfer member 52.

A handle for allow a user to lift the ice bin 50 may be disposed on a lower portion of both side surfaces of the ice bin 50. The support surface restriction part 313 may be separated from a restriction groove 501 of a bottom surface of the ice bin 50 by lifting and pulling the ice bin 50 to separate the ice bin 50 from the seating member 30.

Both side surfaces of the ice bin 50 and both side surfaces of the ice cover 40 may be inclined and also disposed on the same plane as both inclined side surfaces of the ice chute 25. Thus, when the freezing compartment door 22 is opened or closed, the ice making unit 24 and the ice chute 25 may not interfere with both side surfaces within the freezing compartment 12.

The ice cover 40 may be disposed above the ice bin 50. The ice cover 40 may have a structure that covers the ice maker 60 and the supply duct 71 mounted on the ice maker 60. When the ice cover is separated, at least the ice maker 60 and the supply duct 71 may be exposed.

The ice cover 40 may define an outer appearance of the upper portion of the ice making unit 24 and may have a shape of which both side surfaces are inclined like the ice bin 50 and the ice chute 25 on the whole, and a circumferential surface is disposed on the same plane as the ice bin 50 and the ice chute to provide a sense of unity.

A cover deco 42 may be disposed on portions of the front surface and both side surfaces of the ice cover 40. The cover deco 42 may be disposed above the see-through part 51 and have both side ends that are disposed the same extension line as the see-through part 51. Also, the cover deco 41 may be made of the same material as the see-through part 51 and thus have the same texture. A shape of an unevenness 421 may be continuously disposed on most of an outer surface of the cover deco 42 so that the inside of the ice cover 40 is not completely seen unlike the see-through part 51.

A top surface 41 of the ice cover 40 may have an inclination corresponding to a front end of the top surface of the freezing compartment 12. Also, a cover inflow hole 411 through which cold air discharged from the cabinet duct 16 is introduced may be defined in the top surface 41 of the ice cover 40. Also, the supply duct 71 disposed to communicate with the cover inflow hole 411 may be disposed on an inner surface of the ice cover 40.

Figure 8:
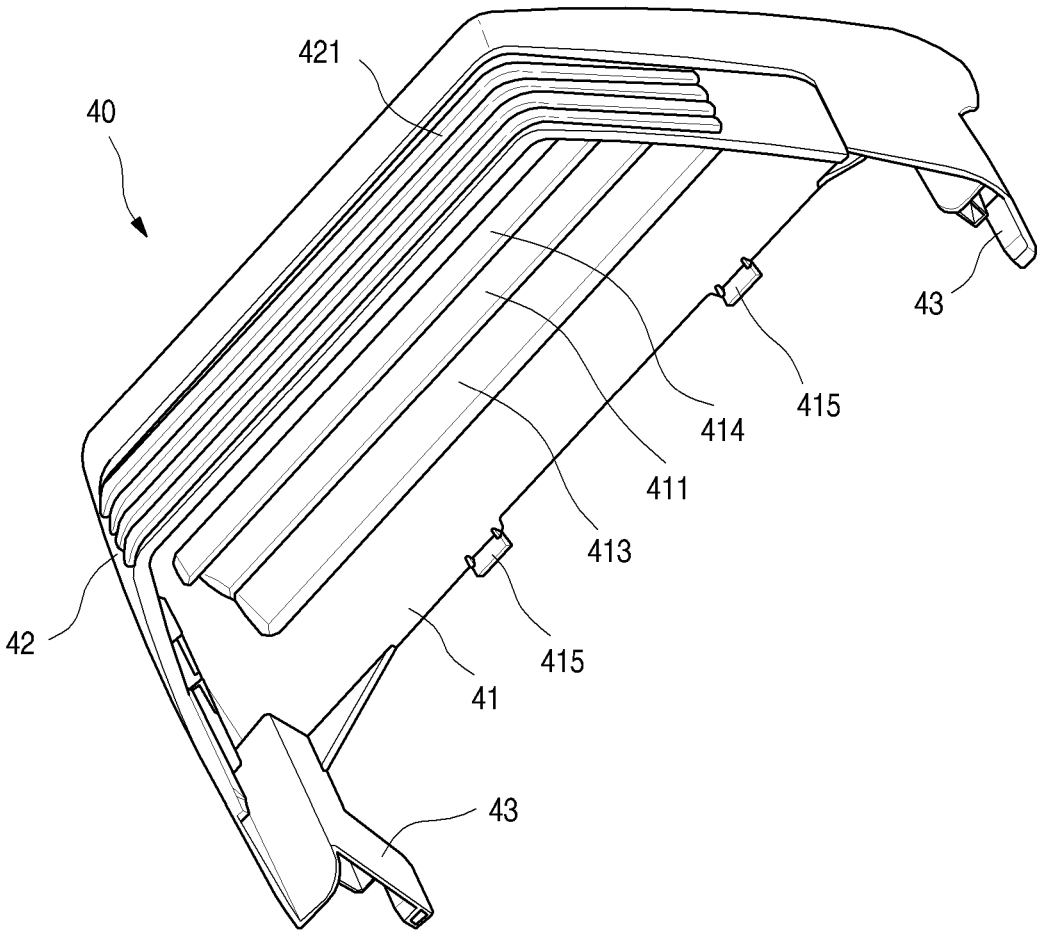
FIG. 8 is a bottom perspective view of an ice cover that is one component of the ice making unit.
Figure 9:
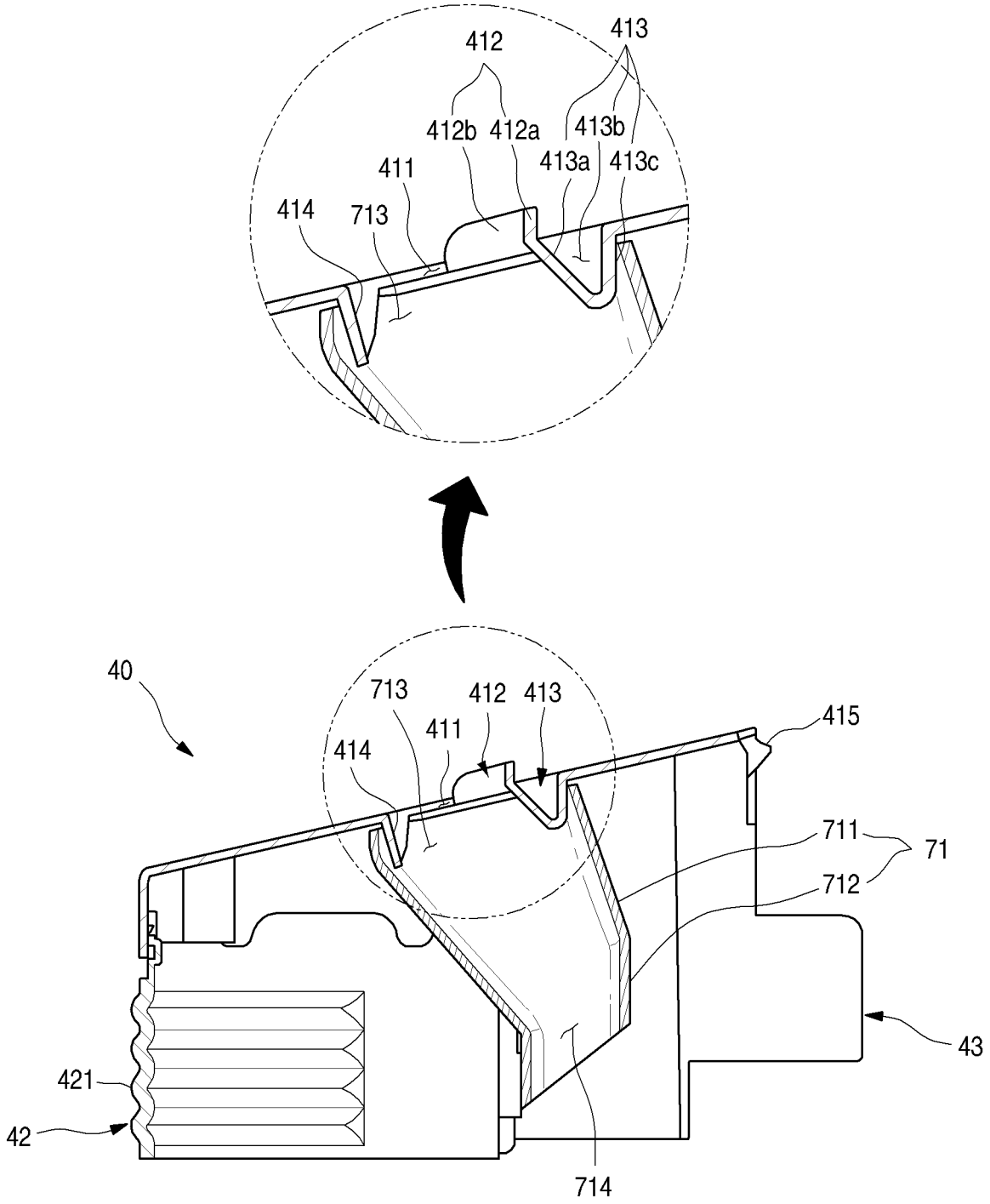
FIG. 9 is a longitudinal cross-sectional view illustrating a state in which a supply duct is mounted on the ice cover.
Figure 10:
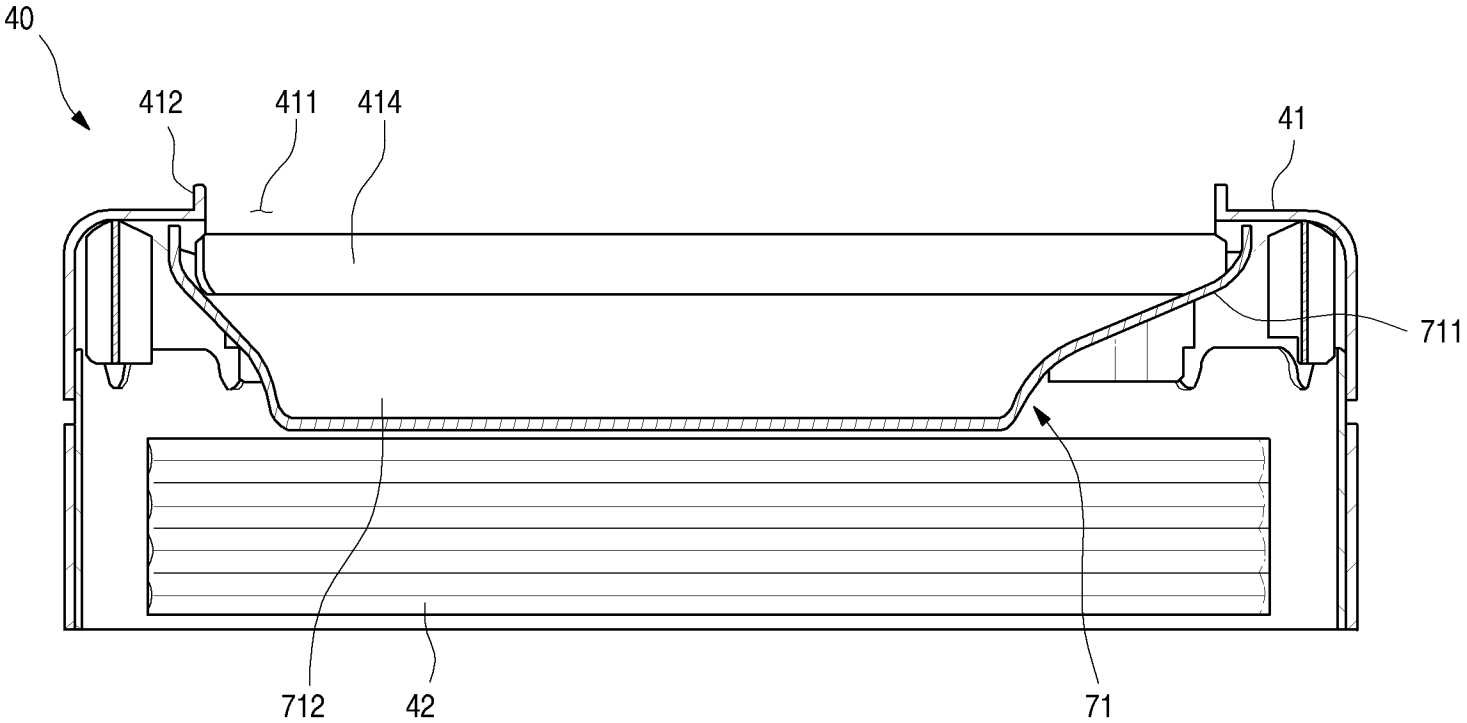
FIG. 10 is a transverse cross-sectional view illustrating a state in which a supply duct is mounted on the ice cover.

FIG. 8 is a bottom perspective view of the ice cover that is one component of the ice making unit. Also, FIG. 9 is a longitudinal cross-sectional view illustrating a state in which the supply duct is mounted on the ice cover, i.e., a cross-sectional view taken along line 9-9' of FIG. 4. Also, FIG. 10 is a transverse cross-sectional view illustrating a state in which the supply duct is mounted on the ice cover, i.e., a cross-sectional view taken along line 10-10' of FIG. 4.

As illustrated in the drawings, a cover coupling part 43 may be disposed on each of both side surfaces of the ice cover 40. The cover coupling part 43 may have a structure that is inserted into the cover mounting part 314*a*, which is disposed on the door dike 214, downward and then is fixed. Also, the cover protrusion 415 may extend forward from the front end of the top surface of the ice cover 40 and be inserted in the cover mounting hole 328 defined in the seating member 30.

The cover inflow hole 411 may be defined in the top surface of the ice cover 40. The cover inflow hole 411 may be disposed above the ice maker 60. In more detail, the cover inflow hole 411 may be disposed at a further rear side than a central portion of the ice tray 63. Thus, cold air discharged from the cabinet duct 16 may smoothly flow to an upper side of the ice tray 63 via the cover inflow hole 411.

In detail, the cover inflow hole 411 may be defined in a position facing the duct outlet 162 o the cabinet duct 16 so that the cold air discharged from the cabinet duct 16 is more smoothly introduced toward the ice tray 63. Here, the cover inflow hole 411 may be disposed at a slightly rear side rather than the ice tray 63 so that the cold air discharged through the cabinet duct 16 flows to the ice tray 63 without being lost.

In more detail, a rear end of the cover inflow hole 411 may be disposed at a further rear end than a rear end of the ice tray 63, and a front end of the cover inflow hole 411 may be disposed at a further rear side than the central portion of the ice tray 63 so that the introduced cold air flows to the ice tray at a gentle angle.

An inflow hole guide 412 extending upward may be disposed on a circumference of the cover inflow hole 411. The inflow hole guide 412 may be necessary to allow the cold air discharged from the duct outlet 162 to be effectively introduced into the cover inflow hole 411 in a state in which the duct outlet and the cover inflow hole 411 are separated from each other.

The inflow hole guide 412 may protrude along the circumference of the cover inflow hole 411. When the freezing compartment door 22 is opened and closed, the inflow hole guide 412 may protrude to a height at which the inflow hole guide 412 does not interfere with the inner case 102.

Thus, the inflow hole guide 412 may guide the cold air so that the cold air discharged from the duct outlet 162 flows to the inside of the cover inflow hole 411 without being lost to the outside of the cover inflow hole 411.

The inflow hole guide 412 may include a front guide 412*a* protruding along a front end of the cover inflow hole 411 and a side guide 412*b* protruding along a side end of the cover inflow hole 411. That is, the cold air discharged from the duct outlet 162 to flow to both sides and the front side may be guided to the inside of the cover inflow hole 411 by the front guide 412*a* and the side guide 412*b*.

Here, the side guide 412*b* may be disposed on the entire side end of the cover inflow hole 411. Alternatively, the side guide 412*b* may be disposed on only a portion adjacent to the front guide 412*a* so that the side guide 412*b* does not interfere with elevation of the freezing compartment door 21 when the freezing compartment door 21 is opened and closed or is adjusted in height to adjust a height difference.

A separate guide may not be provided on the rear end of the cover inflow hole 411. When a guide having a protruding shape is disposed on the rear end of the cover inflow hole 411, since the cold air discharged toward the cover inflow hole 411 is blocked, the guide may be omitted to more smoothly introduce the cold air.

The ice cover and the supply duct may have a coupling structure different from the above-described coupling structure.

Figure 11:
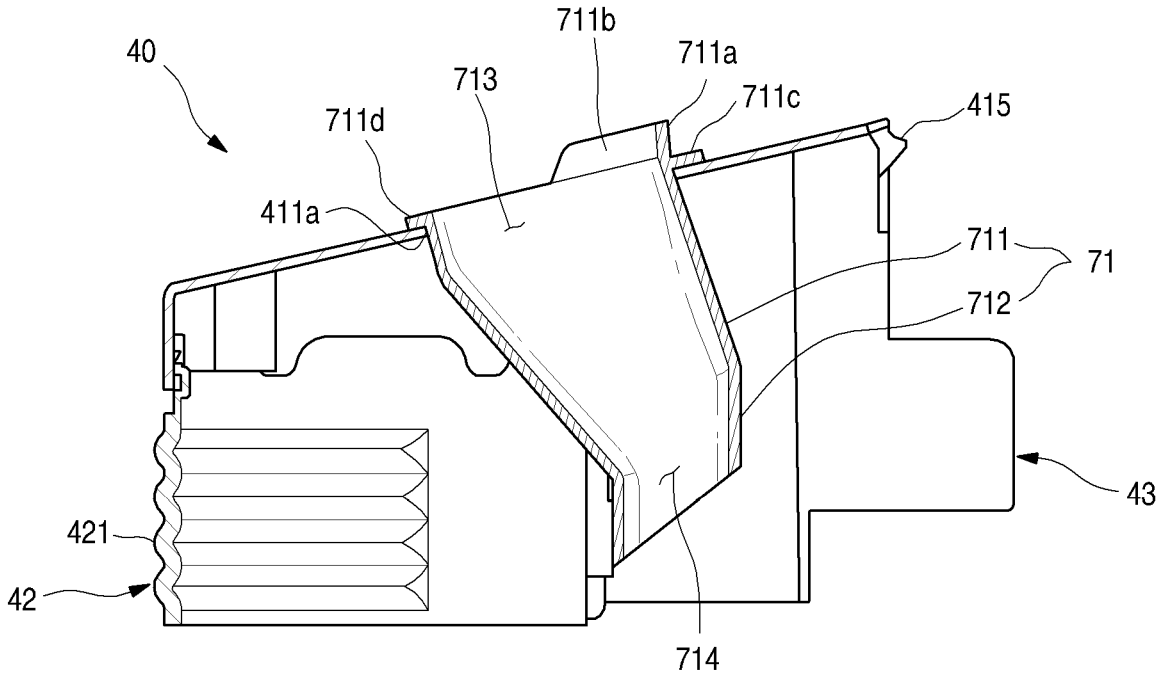
FIG. 11 is a perspective illustrating another example of the ice cover and the supply duct.

FIG. 11 is a perspective illustrating another example of the ice cover and the supply duct.

As illustrated in FIG. 11, the cover deco 42 may be disposed on both the side surfaces and the front surface of the ice cover 40. An unevenness 421 may be disposed on the cover deco 42.

Also, the ice cover 40 may include an inclined top surface 41, and a cover inflow hole 411*a* may be defined to be opened in the inclined top surface 41.

The cover inflow hole 411*a* may be defined at a position facing the duct outlet 162 and serve as an inlet through which the cold air discharged from the duct outlet 162 is introduced. Also, the cover inflow hole 411*a* may have a size that is enough so that an upper portion of the supply duct 71 is inserted.

The supply duct 71 may have a size that gradually increases from a lower end to an upper end thereof. Thus, the supply duct 71 may be inserted into the cover inflow hole 411*a* from an insertion part 712 provided in the lower end thereof and be configured so that an extension part 711 is fixed to the cover inflow hole 411*a*. Thus, the cover inflow hole 411*a* may have a size corresponding to that of an opened top surface of the supply duct 71, i.e., an upper opening 713. Thus, in the state in which the supply duct 71 is mounted, a circumference of the upper end of the supply duct 71 may be closely attached and fixed to an inner surface of the cover inflow hole 411*a*.

Duct fixing parts 711*c* and 711*d* protruding outward may be further disposed on an outer surface of an upper portion of the extension part 711. The duct fixing parts 711*c* and 722*d* may come into contact with the circumference of the cover inflow hole 411*a* and be seated on the cover inflow hole 411*a* to maintain the state in which the supply duct 71 is seated on the ice cover 40. Also, the duct fixing parts 711*c* and 711*d* may be disposed along the circumference of the supply duct 71. The supply duct 71 may be inserted into the cover inflow hole 411*a* from an upper side of the ice cover 40 due to the above-described structure, and thus, the duct fixing parts 711*c* and 722*d* may be fixed to and mounted on the ice cover 40.

Also, inflow hole guides 711*a* and 711*b* may be further disposed on the upper end of the extension part 711. The inflow hole guides 711*a* and 711*b* may be disposed on the upper end of the extension part 711 to pass through the cover inflow hole 411*a* and then further extend upward.

Thus, when the supply duct 71 is mounted, the inflow hole guides 711*a* and 711*b* may be disposed on the circumference of the cover inflow hole 411*a* to prevent the cold air from being introduced through the inside of the cover inflow hole 411*a*, i.e., an upper opening 713.

As illustrated in the drawings, the inflow hole guides 711*a* and 711*b* may include a front guide 711*a* and a side guide 711*b*, which are provided by extension of an upper end of a front surface and an upper end of each of both side surfaces of the extension part 711. Alternatively, the inflow hole guides 711*a* and 711*b* may have various shapes so that the inflow hole guides 711*a* and 711*b* include at least portions of the circumference of the extension part 711.

The inflow hole guide 412 disposed on the circumference of the cover inflow hole 411 may be applied according to various modified examples, and the various modified examples will be described below with reference to the accompanying drawings.

Figure 12:
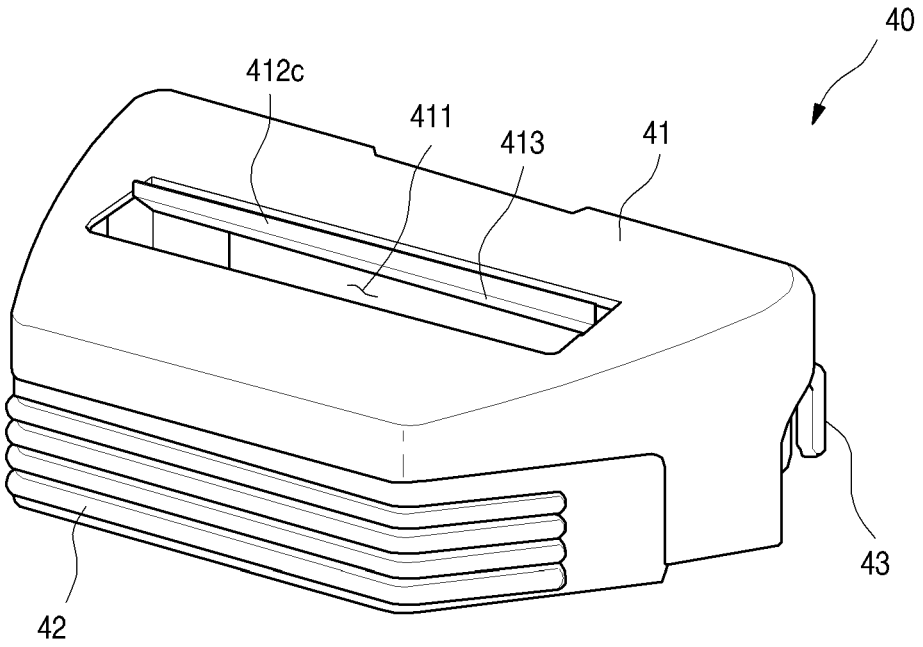
FIG. 12 is a perspective view illustrating another example of the ice cover.

FIG. 12 is a perspective view illustrating another example of the ice cover.

As illustrated in FIG. 12, a top surface 41 of the ice cover 40 may have an inclination, and the cover inflow hole 411 may be defined in the inclined top surface 41. Also, an inflow hole guide 412*c* may be disposed on the front end of the cover inflow hole 411.

The inflow hole guide 412*c* may be disposed on the front end of the cover inflow hole 411 to extend from a left end to a right end of the cover inflow hole 411. The inflow hole guide 412*c* may not be provided on the rest both side ends and a rear end of the cover inflow hole 411 except for the front end of the circumference of the cover inflow hole 411. Thus, an interference when the freezing compartment door 21 is opened and closed or is elevated may be minimized.

Figure 13:
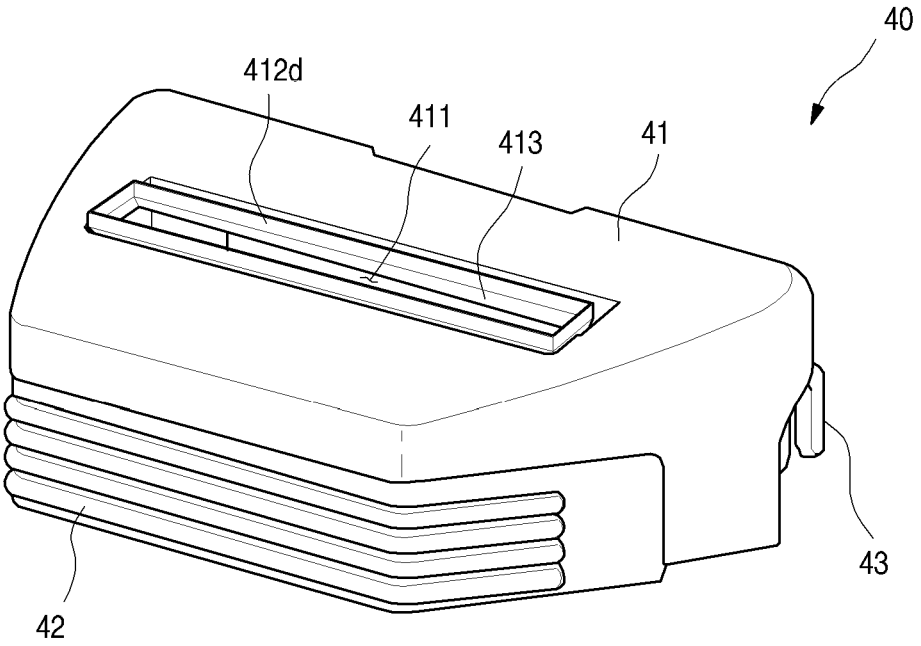
FIG. 13 is a perspective view illustrating further another example of the ice cover.

FIG. 13 is a perspective view illustrating further another example of the ice cover.

As illustrated in FIG. 13, a top surface 41 of the ice cover 40 may have an inclination. Also, the cover inflow hole 411 may be defined in the top surface 41 of the ice cover 40, and an inflow hole guide 412*d* may be disposed on the circumference of the cover inflow hole 411.

The inflow hole guide 412*d* may be disposed along the entire circumference of the cover inflow hole 411. Particularly, the position corresponding to a rear end of the inflow hole guide 412*d* may be inclined toward the inside of the refrigerator to guide the cold air to the cover inflow hole 411 within a range in which the cold air supplied through the duct outlet 162 is not blocked.

Also, the inflow hole guide 412*d* may protrude upward along the entire circumference of the cover inflow hole 411 to extend up to the duct outlet 162. Thus, when the freezing compartment door 21 is closed, a passage may be provided from the duct outlet 162 to the cover inflow hole 411 by the inflow hole guide 412*d*. Thus, all the cold air discharged from the duct outlet 162 may be substantially guided to flow into the cover inflow hole 411.

Also, the inflow hole guide 412*d* may be made of a material having elasticity such as rubber, silicon, urethane, and the like. Thus, when the freezing compartment door 21 is opened and closed or is elevated, the inflow hole guide 412*d* may not damage the cabinet 10 or other components even though the inflow hole guide 412*d* comes into contact with the cabinet 10 or other components and also do not interfere with the movement of the freezing compartment door 21.

Figure 14:
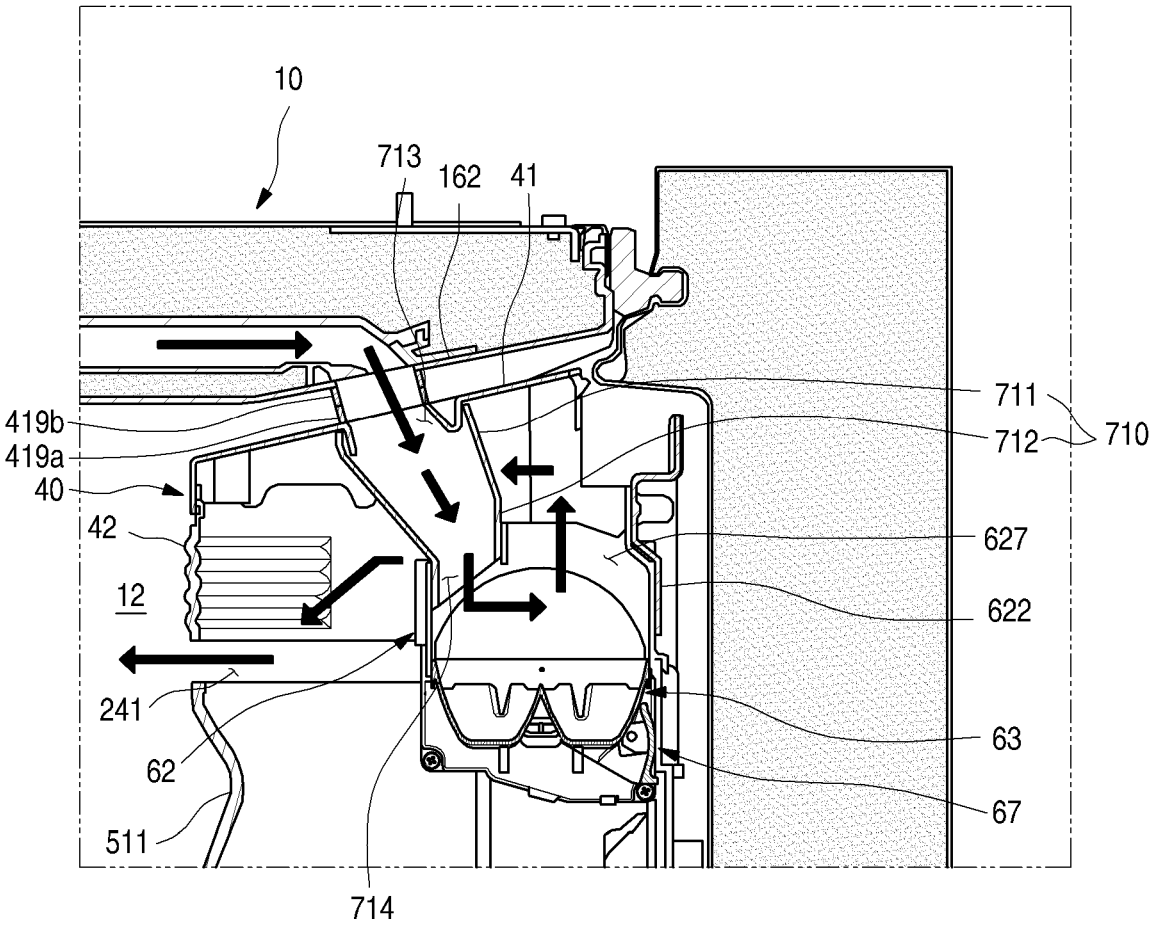
FIG. 14 is a cross-sectional view illustrating a cold air flow state to the inside of the ice cover.

FIG. 14 is a cross-sectional view illustrating a cold air flow state to the inside of the ice cover.

As illustrated in FIG. 14, inflow hole guides 419*a* and 419*b* may be disposed on the circumference of the duct outlet 162 and the circumference of the cover inflow hole 411. The inflow hole guides 419*a* and 419*b* may guide the cold air discharged from the duct outlet 162 to the cover inflow hole 411. Also, the inflow hole guides 419*a* and 419*b* may be made of an elastic material such as rubber, silicon, urethane, and the like.

Also, the inflow hole guides 419*a* and 419*b* may come into contact with each other when the freezing compartment door 15 is closed. Here, the inflow hole guides 419*a* and 419*b* may be completely closely attached to each other by compression to maintain a seated state therebetween. Thus, as illustrated in FIG. 14, when the freezing compartment door 15 is closed, the inflow hole guide 419*b* that is disposed at a side of the cabinet 10 and the inflow hole guide 419*a* that is disposed at a side of the freezing compartment door 15 may be closely attached to each other to provide a passage connecting the duct outlet 162 to the cover inflow hole 411.

Thus, all the cold air discharged from the duct outlet 162 may be substantially introduced into the cover inflow hole 411 along the passage provided by the inflow hole guides 419*a* and 419*b* without leaking into the storage space.

Although not shown, the inflow hole guide may not be disposed on the ice cover 40 but be disposed on only the duct outlet 162. Also, the inflow hole guide may extend to come into contact with the cover inflow hole 411.

Referring again to FIGS. 8 to 10, the supply duct 71 may be mounted on the inside of the ice cover 40. The supply duct 71 may be separately formed and then mounted on a top surface of the inside of the ice cover 40. For this, a first duct fixing part 413 and a second duct fixing part 414 may extend downward from the top surface of the inside of the ice cover 40.

The first duct fixing part 413 may extend downward from a front end of the cover inflow hole 411. Here, a recessed groove may be defined in a top surface of the first duct fixing part 413, and a bottom surface of the first duct fixing part 413 may have a structure protruding downward from the ice cover 40. The first duct fixing part 413 may be integrated with the inflow hole guide 412 and the cover inflow hole 411 through injection molding by the recessed structure when the inflow hole guide 412 and the cover inflow hole 411 are molded.

Also, a rear surface of the first duct fixing part 413 may be inclined to guide the cold air introduced into the cover inflow hole 411 and thereby to flow along the inner surface of the supply duct 71. Also, a front surface of the first duct fixing part 413 may be disposed directly downward and then inserted into the upper opening 713 of the supply duct 71 to come into contact with the inner surface of the supply duct 71.

The second duct fixing part 414 may extend downward from a rear end of the cover inflow hole 411. The second duct fixing part 414 may extend downward from the inclined top surface of the ice cover 40 and be disposed at a further rear side than the first duct fixing part 413 to further extend downward than the first duct fixing part 413.

The first duct fixing part 413 and the second duct fixing part 414 may be inserted into the upper opening 713. Here, the second duct fixing part 414 and the second duct fixing part 414 may come into contact with an inner surface of the upper opening 713, and thus, the supply duct 71 may be fixed to the ice cover 40.

The coupled state between the supply duct 71 and the ice cover 40 may be maintained. When the ice cover 40 is detached, the supply duct 71 may be detached together with the ice cover 40. In the state in which the supply duct 71 is mounted on the ice cover 40, the cover inflow hole 411 may be disposed within the upper opening 713. Thus, the cold air passing through the cover inflow hole 411 may be introduced into the supply duct 71 through the upper opening 713.

The supply duct 71 may extend from the top surface of the ice cover 40 toward to the upper side of the ice tray 63. Also, the lower opening 714 of the supply duct 71 may face the top surface of the ice tray 63. The lower end of the supply duct 71 may extend to a position that is closest to the top surface of the ice tray 63. Also, the lower end of the supply duct 71 may extend by a length at which the supply duct 71 does not interfere with the ice tray 63 when the ice tray 63 rotates.

The supply duct 71 may include an insertion part 712 inserted into the mounting bracket 61 defining the upper portion of the ice maker 60 and an extension part 711 extending from an upper end of the insertion part 712 to the cover inflow hole 411.

The insertion part 712 may have a width corresponding to a horizontal width of the ice tray 63 and be inserted into one region of a rear portion of the mounting bracket 61. Also, a lower end of the insertion part 712 may be inclined or rounded and extend downward by a length at which the insertion part 712 does not interfere with the ice tray 63 when the ice tray 63 rotates.

The lower opening 714 through which the cold air is discharged to the ice tray 63 may be defined in the lower end of the insertion part 712. A flow rate of cold air supplied to the ice tray 63 may be determined by a size of the lower opening 714. Thus, to uniformly supply as much cold air as possible to the entire ice tray 63, the lower opening 714 may have a horizontal length corresponding to that of the ice tray 63, more particularly, a horizontal length of a space into which water is accommodated.

Also, to realize the effective flow and circulation of the cold air above the ice tray 63, the lower opening 714 may be disposed at an eccentric position above the ice tray 63 to supply the cold air. Thus, the lower opening 714 may have a surface area less than that of the ice tray 63. For example, the lower opening 714 may have a surface area that is less than half of that of the top surface of the ice tray.

That is, to effectively supply the cold air, the front end of the lower opening 714 may be disposed at a position corresponding to the front end of the ice tray 63, and the lower end of the lower opening 714 may be disposed at a further front side than the center of the ice tray 63.

The insertion part 712 may extend up to the upper end of at least the mounting bracket 61. The lower opening 714 may be disposed inside the mounting bracket 61 so that all the cold air supplied by the supply duct 71 flows from the inside of the mounting bracket 61 to the top surface of the ice tray 63.

The extension part 711 may extend to be inclined backward from the upper end of the insertion part 712. Here, the upper opening 713 may be defined in the upper end of the extension part 711 and have a size equal to or greater than that of the cover inflow hole 411. Thus, the first duct fixing part 413 and the second duct fixing part 414 may be inserted into the upper opening 713.

The upper opening 713 may have a size greater than that of the lower opening 714 so that an amount of introduced cold air satisfies a discharge flow rate that is set by the lower opening 714. That is, although a portion of the cold air introduced through the upper opening 713 is lost while passing through the supply duct 71, the desired flow rate of cold air discharged from the lower opening 714 may be satisfied.

Thus, the upper opening 713 may have a size greater than that of the lower opening 714, and also, the size of the upper opening 713 may be lager in horizontal and vertical directions. Here, the horizontal width of the upper opening 713 may be as large as possible as within the structure in which the supply duct 71 is mountable long as the width of the top surface of the ice cover 40 permits the horizontal width of the upper opening 713. Also, the vertical width of the upper opening 713 may be equal to or slightly larger than that of the lower opening 714. Here, the vertical width of the upper opening 713 may be largely formed within a range in which the flow direction of air is not excessively bent in consideration of the position of the duct outlet 162 of the cabinet duct 16 and the position of the insertion part 712. Thus, the upper opening 713 may have a size greater than that of the lower opening 714, and also, a difference in size in the left and right directions is larger than that in size in the front and rear directions.

Since the upper opening 713 has a size greater than that of the lower opening 714, the extension part 711 may be inclined or rounded so that the widths in the horizontal and vertical directions gradually decrease downward. Thus, the cold air may be effectively supplied to the ice tray due to the above-described structure.

The duct outlet 162 of the cabinet duct 16 may have a size equal to or greater than that of the cover inflow hole 411 of the ice cover 40. As a result, the cold air supplied from the cabinet duct 16 may be supplied at a proper flow rate with respect to the required flow rate of the supply duct 71.

Figure 15:
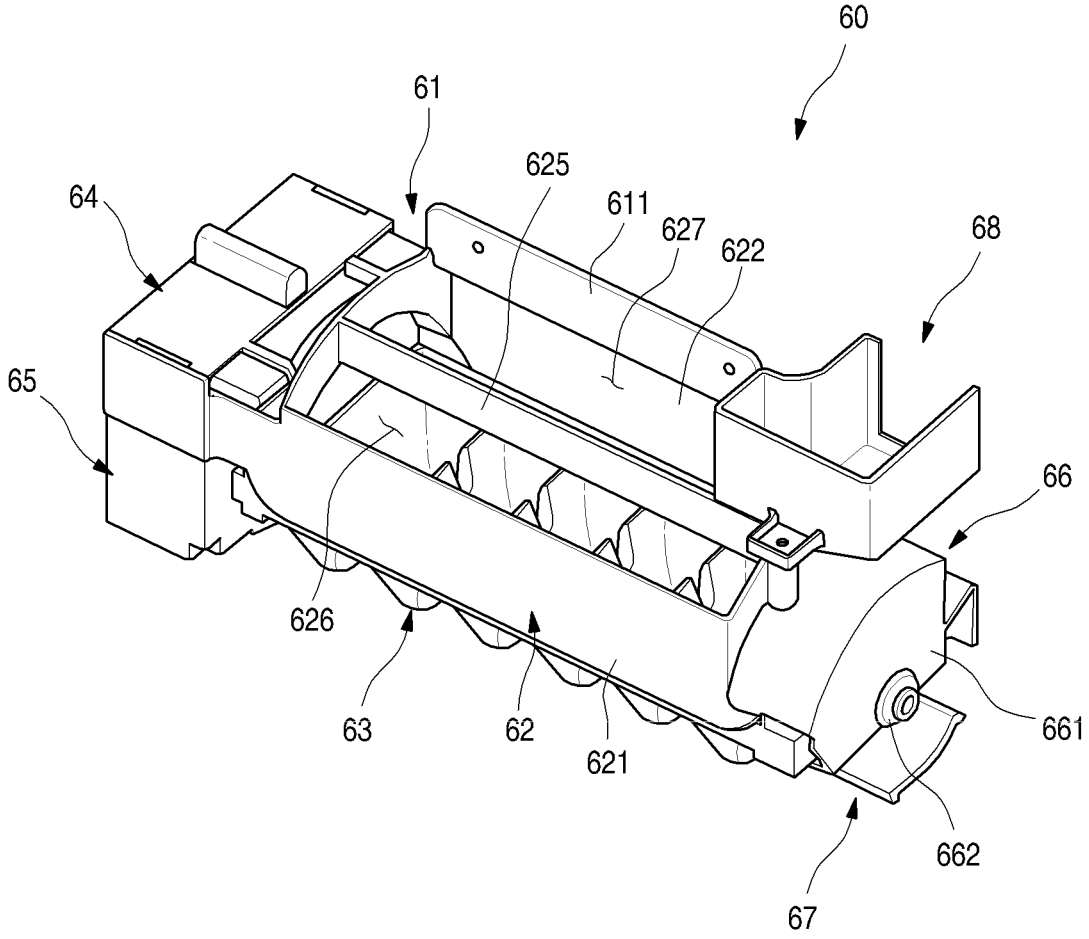
FIG. 15 is a perspective of the ice maker.
Figure 16:
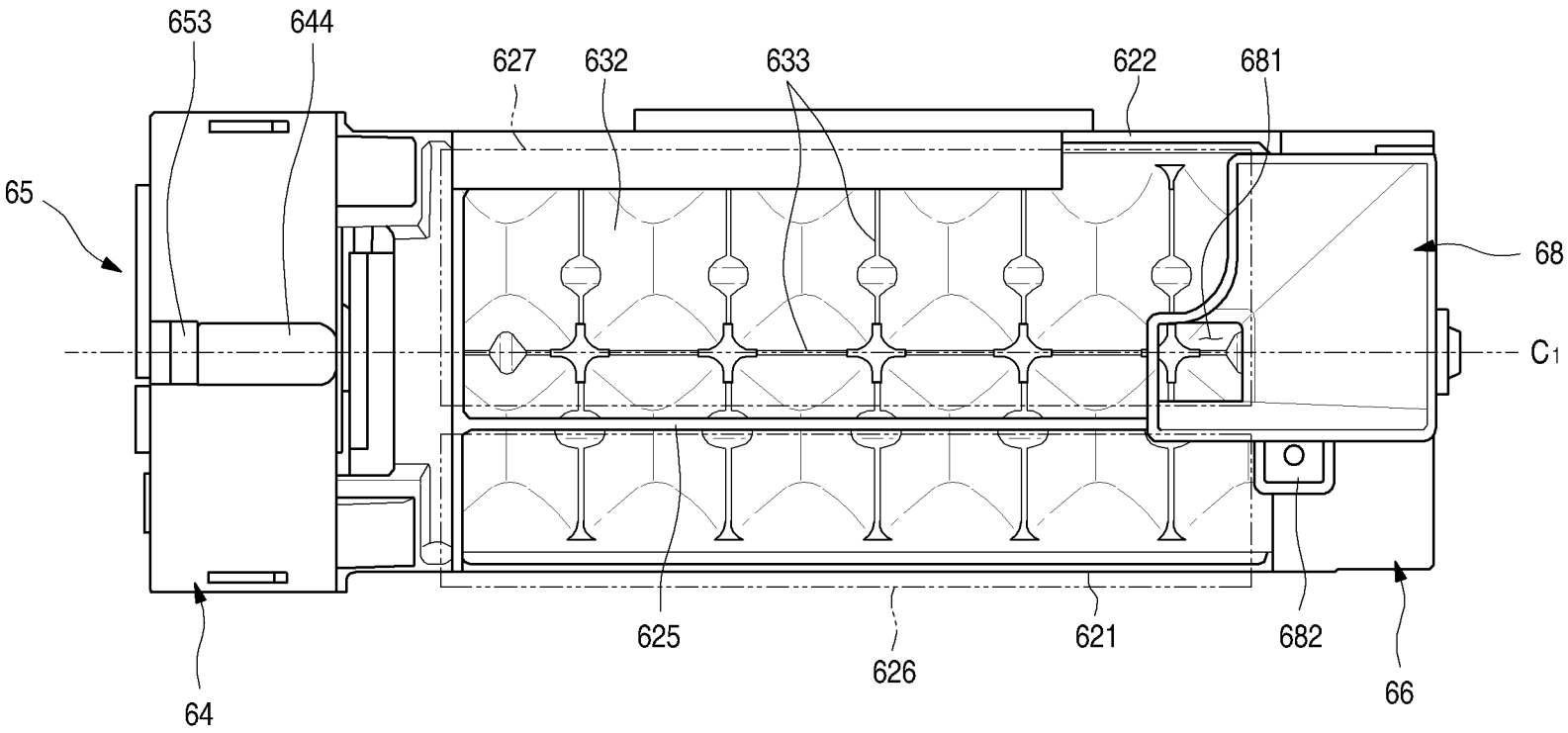
FIG. 16 is a plan view of the ice maker.
Figure 17:
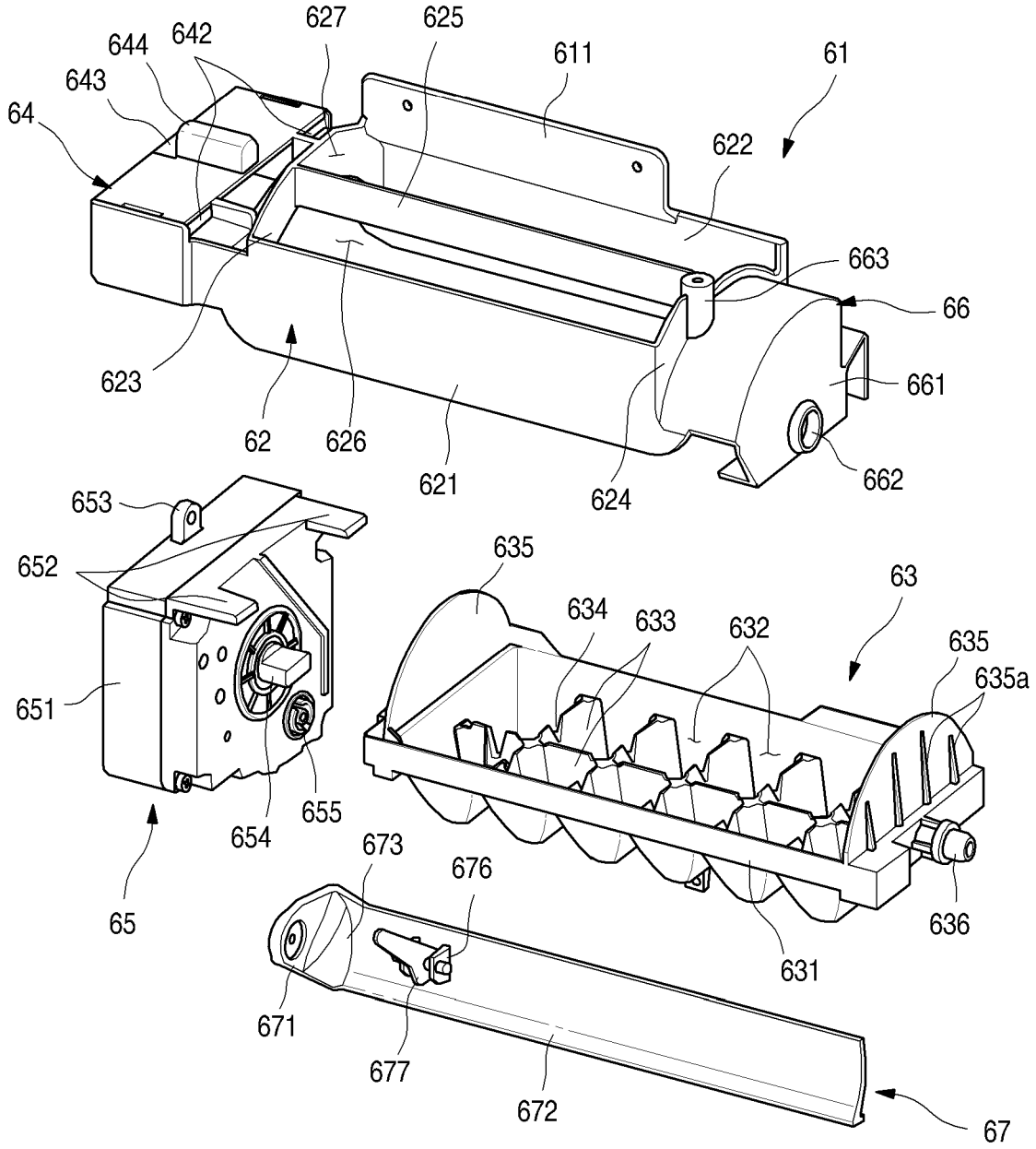
FIG. 17 is an exploded perspective view of the ice maker.

FIG. 15 is a perspective of the ice maker. Also, FIG. 16 is a plan view of the ice maker. FIG. 17 is an exploded perspective view of the ice maker.

As illustrated in the drawings, the ice maker 60 may generally include the mounting bracket 61 for mounting the ice maker 60, the driving part 65 providing driving force for driving the ice maker 60, the ice tray 63 connected to the driving part 65 to rotate and accommodating water for making ice, and the full ice detection member 67 connected to the driving part 65 to detect whether ices stored in the ice bin 50 are full.

The mounting bracket 61 may be configured to allow the ice maker 60 to be fixedly mounted on the seating member 30. Also, the mounting bracket 61 may provide a structure in which the driving part 65 and the ice tray 63 are mountable. In addition, the mounting bracket 61 may guide the cold air for making ice and prevent water accommodated in the ice tray 63 from being splashing or overflowing.

The mounting bracket 61 may include a tray accommodation part 62 in which the ice tray 63 is accommodated, a mounting part 611 which extends from a front end of the tray accommodation part 62 and on which the ice maker 60 is fixed and mounted, and a driving part mounting part 64 on which the driving part 65 is mounted. Also, the mounting bracket 61 may further include a water supply cup for supplying water to the ice tray 63.

The structure of the mounting bracket 61 will be described below in more detail.

The driving part 65 may be configured to provide power for the rotation of the ice tray 63 and the full ice detection member 67 and mounted on one end of both left and right sides of the mounting bracket 61. Also, a driving shaft coupled to the ice tray 63 and a detection member rotation shaft coupled to the full ice detection member 67 may be disposed on one surface of the driving part 65. Thus, the ice tray 63 and the full ice detection member 67 may rotate by the driving of the driving part 65.

The driving part 65 may include a motor and a plurality of gears in a driving part case 651. Thus, the one motor and the plurality of gears may be combined with each other to perform the rotation of the ice tray 63 and the rotation of the full ice detection member 67 together. Also, to fix and mount the driving part 65, a case protrusion 652 and a screw fixing part 653 may be disposed on the driving case 651.

The ice tray may accommodate water for making ice and be made of a plastic resin material. One end of the ice tray 63 may be axially coupled to the driving part 65 to rotate. Also, a plurality of cells 632 may be partitioned in the ice tray 63. As illustrated in the drawings, the plurality of cells 632 having the same size may be continuously arranged in two columns. The water may be filled into each of the cells 632. A passage 634 may be provided to be cut between partition walls 633 partitioning the cells 632 so that the water is uniformly supplied into the cells 632 even through the water is supplied to one side of the ice tray 63.

Also, an edge part 631 may be disposed on an upper end of the ice tray 63. The edge part 631 may be disposed on a circumference of the upper end of the ice tray 63 and extend upward to come into contact with a lower end of the tray accommodation part 62 of the mounting bracket 61.

The edge part 631 may be closely attached to front and rear surfaces of the tray accommodation part 62. Thus, the edge part 631 may prevent the water within the ice tray 63 from overflowing when water is supplied, or the freezing compartment door 22 rotates to be opened and closed. Also, the edge part 631 may come into contact with a freezing release member 677 provided on the full ice detection member 67 to prevent the full ice detection member 67 from being bonded when the ice tray 63 rotates.

The tray rotation shaft 636 is disposed on a center of both left and right ends of the edge part 631. Also, the tray rotation shaft 636 disposed on one side may be coupled to the driving shaft 654 of the driving part 65, and the tray rotation shaft 636 disposed on the other side may be axially coupled to the tray accommodation part 62.

Also, a cover plate 635 having a semicircular shape and extending upward may be disposed on each of both left and right ends of the top surface of the edge part 631. The cover plate 635 may be accommodated in the tray accommodation part 62 and have a surface that is opened to each of both left and right sides of the ice tray 63. Thus, in the state in which the ice tray 63 is disposed in the tray accommodation part 62, all front, rear, left, and right sides of the upper side of the ice tray 63 may be covered by an accommodation part front surface and an accommodation part rear surface of the tray accommodation part 62 and the cover plate 635. Thus, the water supplied to the ice tray 63 may be prevented from overflowing due to the above-described structure. Also, the cold air supplied to the upper side of the ice tray 63 may be circulated above the ice tray 63 without passing through a lower side via the ice tray 63.

In addition, when the ice tray 63 rotates or is twisted, the ice tray 63 may rotate to be seated without being separated from the tray accommodation part 62 by the cover plate 635. A plurality of reinforcement ribs 674 may vertically extend from a lower end of an outer surface of the cover plate 635.

The ice made in the ice tray 63 may drop down and then be transferred in the state in which the ice tray 63 rotates. The ice tray 63 made of a plastic material may rotate by a set angle so that an opened surface of the cell 632 faces a lower side and then be twisted to separate the ice from the ice tray 63. Thus, the ice maker 60 may be called a twisting type ice maker due to the above-described transfer manner.

Figure 18:
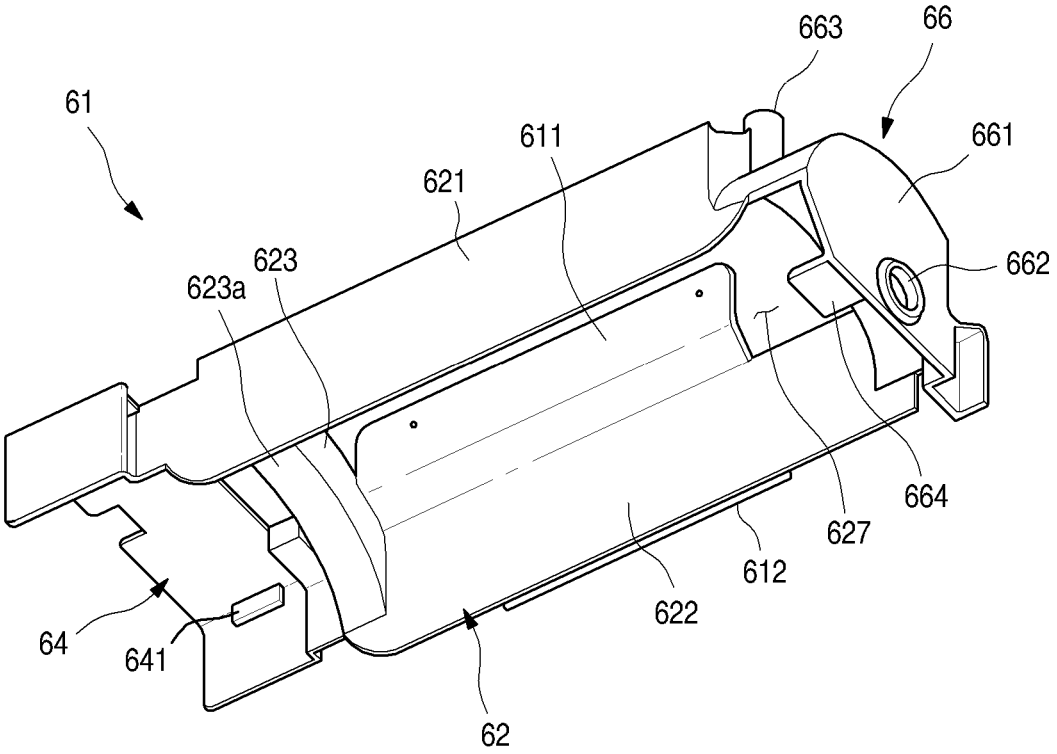
FIG. 18 is a bottom perspective view of a mounting bracket that is one component of the ice maker.

FIG. 18 is a bottom perspective view of the mounting bracket that is one component of the ice maker. Referring to the drawing, a structure of the mounting bracket 61 will be described in more detail.

The mounting bracket 61 may include the tray accommodation part 62. The tray accommodation part 62 may be disposed along a circumference of the ice tray 63 to accommodate the ice tray 63 therein. The tray accommodation part 62 may extend upward from the upper end of the ice tray 63. Particularly, the accommodation part front surface 622 and the accommodation part rear surface 621 may come into contact with front and rear ends of the edge part 631 of the ice tray 63 to extend upward. Thus, the overflowing of the water in the front and rear directions within the ice tray 63 may be prevented. Also, the tray accommodation part 62 may have a predetermined height to prevent the water from overflowing and also provide a cold air circulation space.

The mounting part 611 extending upward may be disposed above the front surface of the tray accommodation part 62. The mounting part 611 may extend up to the ice maker seating part 327 and be stepped to be disposed at a position that slightly further protrudes backward than the accommodation part front surface 622. Also, the bracket restriction part 612 protrudes from the accommodation part front surface 622. The bracket restriction part 612 may be inserted into a mounting slit 326*a* defined in the seating member 30. Thus, the ice maker 60 may fix and mount the ice maker 60 by coupling a screw to the mounting part 611 in a state in which the ice maker 60 is temporarily fixed by the coupling of the bracket restriction part 612.

An opening having a rounded shape, which corresponds so that the cover plate 635 is accommodated, may be defined in each of both side surfaces of the tray accommodation part 62. Also, an accommodation part side surface 623 connecting the accommodation part front surface 622 to the accommodation part rear surface 621 may be disposed above the opening. The accommodation part side surface 623 may be configured so that a guide surface 623*a* coming into contact with an outer end of the cover plate 635 is vertically bent outward to guide the rotation of the ice tray 63.

Also, a partition part 625 may be disposed between the accommodation part side surfaces 623. The partition part 625 may partition a space of the tray accommodation part into front and rear spaces, and both ends of the partition part 625 may come into contact with the accommodation part side surface 623. The partition part 625 may have a vertical height corresponding to a size of the accommodation part side surface 623 to partition a space above the tray so that the cold air supplied to the ice tray 63 and the cold air discharged to the outside of the ice tray 63 flow with directionality. Here, the partition part 625 may have a vertical length so that the partition part 625 does not interfere with the ice tray 63 when the ice tray 63 rotates.

The space of the tray accommodation part 62 may be partitioned into a front space 627 and a rear space 626 with respect to the partition part 625. Also, the rear space 625 may have a volume corresponding so that a lower end of the supply duct 71, i.e., the insertion part 712 is inserted. Thus, the rear space 626 may serve as an inlet through which the cold air is supplied to the top surface of the ice tray 63. The front space 627 may serve as an outlet through which air heat-exchanged on the top surface of the ice tray 63 is discharged to the outside of the ice maker 60. Thus, the rear space 266 may be called an inflow space, and the front space 267 may be called an outflow space. Alternatively, when the cold air is introduced into the front space 267, the front space 267 may be called an inflow space, and the rear space 266 may be called an outflow space.

In the space above the ice tray 63, which is defined by the tray accommodation part 62, the rear space 626 into which air is introduced may be less than the front space through which the air is discharged to allow a low pressure region to be generated in the front space 627. That is, as illustrated in FIG. 16, when the ice maker 60 is viewed from an upper side, the partition part 625 may be disposed at a slightly rear side from a central line C1 of the ice tray 63. Thus, the cold air supplied to the top surface of the ice tray 63 by the supply duct 71 may be heat-exchanged with the water filled into the ice tray 63 and then effectively flow to the outside of the tray accommodation part 62 through the front space 627 to realize an effective cold air circulation structure due to the above-described structure.

In the accommodation part front surface 622 of the tray accommodation part 62, the rest portion except for the mounting part 611 may be provided as a flat surface that vertically extends but not be inclined, bent, or stepped so that the ice tray 63 is maximally closely attached to the mounting surface 32 of the seating member 30. The horizontal length of the ice tray 63 may be maximized due to the above-described structure, and thus, a gap through which the cold air leaks downward may be minimized.

The driving part mounting part 64 may be disposed on one side of both sides of the tray accommodation part 62. The driving part mounting part 64 may be configured to accommodate an upper end of the driving part case 651 defining an outer appearance of the driving part 65, and a restriction protrusion 641 restricted in a groove of each of front and rear surfaces of the driving part case 651 may be disposed on an inner surface of the driving part mounting part 64.

Also, a protrusion insertion hole 642 into which the case protrusion 652 protruding from one surface of the driving part case 651 is inserted may be defined in one side of the driving part mounting part 64. Also, a fixing part insertion part 643 into which a screw fixing part 653 which protrudes from the top surface of the driving part case 651 and to which the screw is coupled is inserted may be defined in the top surface of the driving part mounting part 64. A screw coupling part 644 to which the screw is coupled may be further disposed on one side of the fixing part insertion hole 643.

Thus, the driving part 65 may be maintained in the stably fixed state through the insertion of the case protrusion 652 and the coupling of the screw in the state in which the driving part 65 is accommodated in the driving part mounting part 64.

A shaft coupling part 66 may be disposed on the other side of the left and right sides of the tray accommodation part 62. The shaft coupling part 66 may further extend to the outside of the accommodation part side surface 623, and a side part 661 covering a side of the ice tray may be disposed on the shaft coupling part 66. Also, a surface in which a rotation shaft hole 662 to which the rotation shaft 636 of the ice tray 63 is coupled is defined may be provided on the side part 661.

Also, a twisting protrusion 664 protruding at a position spaced apart from the tray rotation shaft 636 may be disposed on a lower end of the surface to which the tray rotation shaft 636 is coupled. The twisting protrusion 664 may protrude to the edge part 631 of the ice tray 63. When the ice tray 63 rotates to transfer the ice, the twisting protrusion 664 may restrict one side of the edge part 631 to provide twisting of the ice tray 63 in a state in which the ice tray 63 completely turns inside out.

Also, a water supply cup 68 for supplying water to the ice tray 63 may be seated on a top surface of the shaft coupling part 66. The water supply cup 68 may have a predetermined volume so that the water supplied for making ice is temporarily stored and flows, and a top surface of the water supply cup 68 may be opened. Thus, the water supplied to the water supply cup 68 may be primarily stored in the water supply cup 68 so as to be buffered at constant flow rate, and a constant amount of water may be supplied to the ice tray 63 thereunder to prevent the water from splashing when the water is supplied to the ice tray 63.

Also, the water supply cup 68 may be seated on a cup support part 663 extending upward from a top surface of the shaft coupling part 66 and be screw-coupled to a cup fixing part 682 and thus be fixed on the mounting bracket 61. Thus, the water supply cup 68 may be disposed above the ice tray 63.

Also, as illustrated in FIG. 16, the water supply cup 68 may extend to the inside of the ice tray 63. A drain hole in the bottom of the water supply cup 68 may be opened at a position adjacent to at least second and third cells 632 with respect to the inside of the ice tray 63 to minimize the splashing of the water when the water is supplied.

Figure 19:
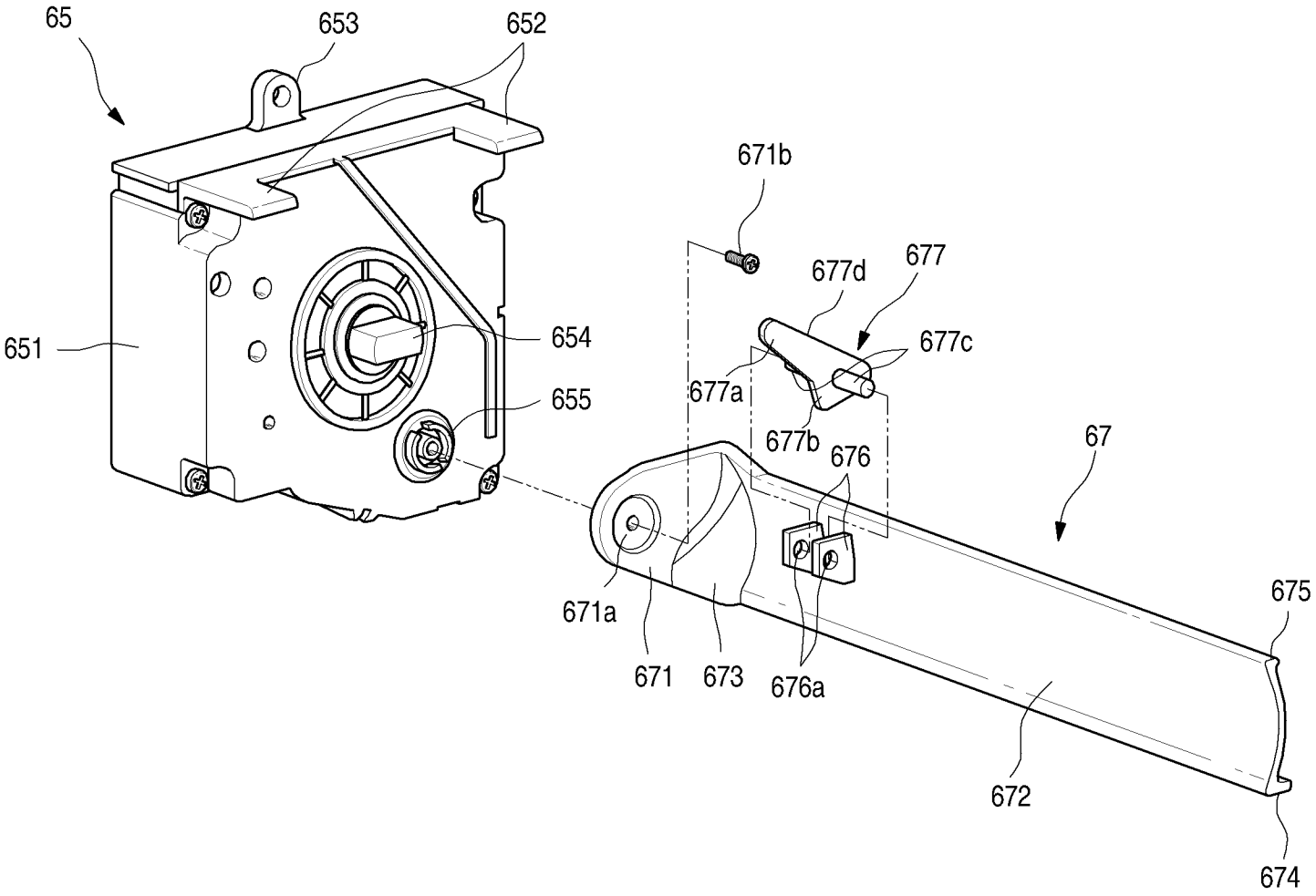
FIG. 19 is an exploded perspective illustrating a coupling structure of a driving part that is one component of the ice maker and a full ice detection member.
Figure 20:
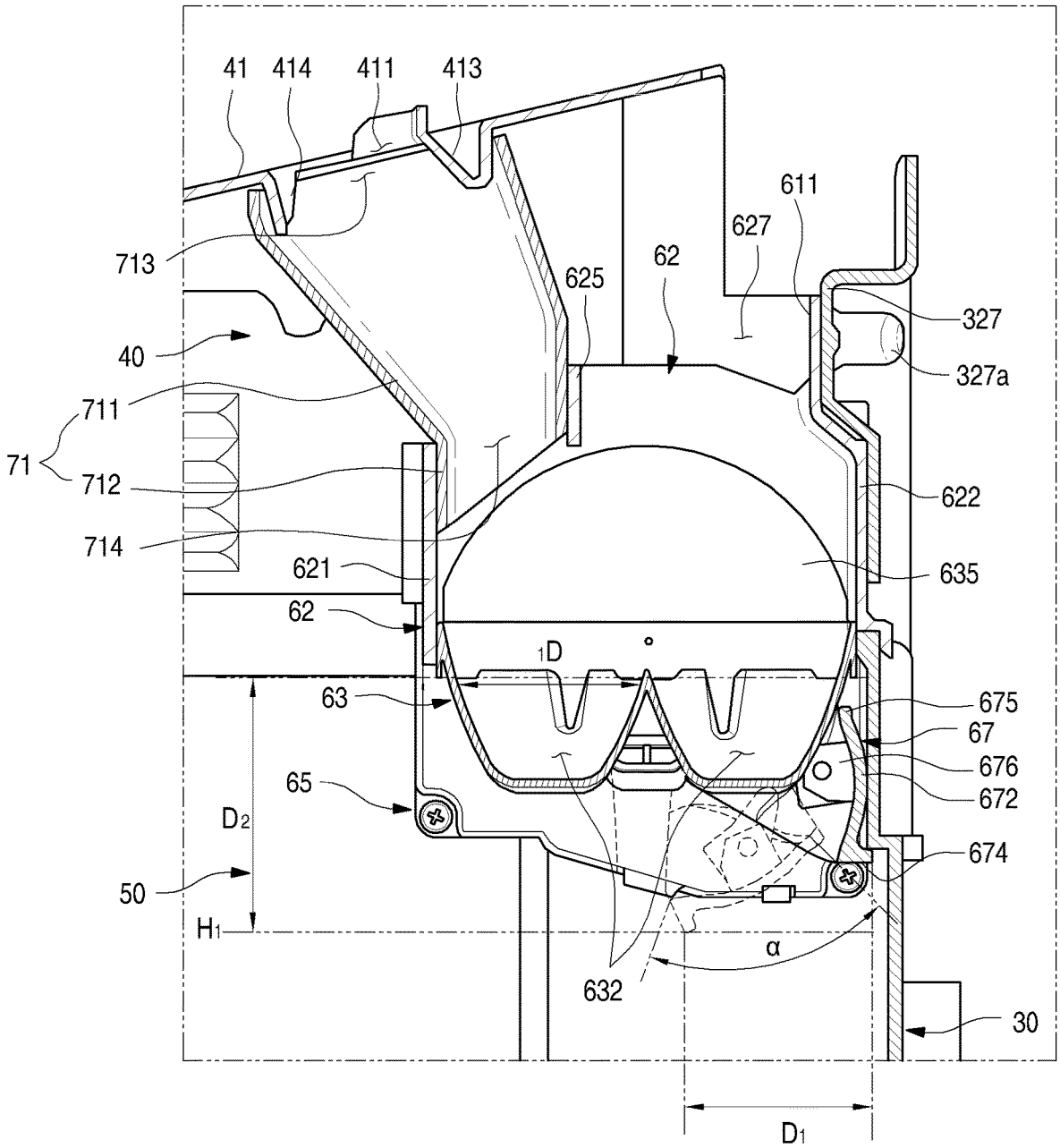
FIG. 20 is a longitudinal cross-sectional view illustrating a state in which the ice maker is mounted.

FIG. 19 is an exploded perspective illustrating a coupling structure of the driving part that is one component of the ice maker and the full ice detection member. Also, FIG. 20 is a cross-sectional view illustrating a state in which the ice maker is mounted.

As illustrated in the drawings, the full ice detection member 67 may be axially coupled to the driving part 65 to rotate. Here, the rotation shaft of the full ice detection member 67 may be disposed at a further lower side than the rotation shaft of the ice tray 63 and also be disposed at a further front side (a rear surface-side of the freezing compartment door) than the rotation shaft of the ice tray 63.

The full ice detection member 67 may not protrude to the front and rear sides of the ice maker 60 in a standby state or an operation state. In the operation state, the full ice detection member 67 may pass through a full ice height $H_1$ at which ices are accumulated on the lower portion of the ice tray 63 to effectively detect whether ices are full.

Also, the full ice detection member 67 has to be configured so that the full ice detection member 67 does not interfere with the ice tray 63 when the ice tray 63 rotates, or ices are not jammed. Thus, the full ice detection member 67 may be disposed at a position that is eccentric to one side of the lower side of the ice tray 63.

Here, in the structure according to this implementation, in which the ice tray rotates in a clockwise direction to transfer ice, the full ice detection member 67 and the rotation shafts of the full ice detection member 67 may be disposed at a slightly right side with respect to the center of the ice tray 63. That is, the rotation shaft of the full ice detection member 67 may be disposed at a right lower side with respect to the ice tray 63. Thus, the full ice detection member 67 may effectively detect the ice at the full ice position in the operation state and prevent the interference with the ice tray 63 in the standby state. Also, the full ice detection member 67 may be disposed in a space between the ice tray 63 and the seating member 30 or the rear surface of the freezing compartment door 21.

That is, a separate space for locating the full ice detection member 67 may be unnecessary, and the full ice detection member 67 may be accommodated in the space between the curved surface or inclined section of the outer surface of the ice tray 63 and the seating member 30 or the rear surface of the freezing compartment door 15.

Thus, the ice maker 60 itself may have a slim structure. Furthermore, the entire ice making unit 24 may have a slim structure. Thus, the storage space of the refrigerator may be maximally secured in capacity, and the loss of the cold air in the storage space may be prevented. Furthermore, the internal space of the ice bin 50 may be sufficiently secured, and the ice storage capacity may increase, or the cold air flow path may be widened so that the cold air is more smoothly circulated.

Particularly, as illustrated in FIG. 20, the full ice detection member 67 may detect the same full ice height $H_1$ even through the full ice detection member 67 is mounted at a further lower side and has a shorter rotation radius, when compared with the full ice detection device that is vertically movable.

However, the full ice detection device according to the related art may have a detection region $D_2$ in a vertical direction. In this state, a height of only one region in a width direction of the ice bin 50, i.e., a point region may be detected. Thus, in the case of the ice bin 50 having a wide width in the front and rear directions, if the ices are not uniformly distributed, the height of the ice may be necessarily high when the ices are disposed outside the detection region $D_2$, or the ices are transferred to the rear-side of the freezing compartment door 21 by the rotation in a counter-clockwise direction like the same structure as the ice maker 60 according to the present disclosure. As a result, the ices within the ice bin 50 may have a non-uniform height, and thus, the ices may have a high height at the position close to the rear surface of the freezing compartment door 21.

However, since the full ice detection device according to the related art moves to a region $D_2$, the full ice state may not be detected. When the ices stored in the ice bin 50 are hung on the ice tray 63 to interrupt the rotation of the ice tray 63, the transfer of the ices may not be performed.

The full ice detection member 67 according to this implementation may have a structure that rotates in the front and rear directions to reach the same full ice height $H_1$. Also, the full ice detection member 67 may rotate in the same direction as the ice tray 63 at a position that is adjacent to the rear surface-side of the freezing compartment door 21, which is a direction in which the ices are poured by the rotation of the ice tray 63.

Also, the full ice detection member 67 may have a detection region $D_1$ that passes through the front side (the freezing compartment door-side direction) of the ice bin 50 on which the ices are mainly accumulated by the rotation of the ice tray 63. Thus, the full ice detection member 67 may detect the full ice state in the wider region in the front and rear directions, and substantially, in the region in which the large amount of ices are accumulated and the region in which possibility of hanging of the ices below the ice tray 63 is high. Therefore, the full ice state may be more accurately detected.

In detail, the full ice detection member 67 may be disposed on the front end of the ice bin 50 in the standby mode state that is an initial state before detecting the full ice state. In the detection mode state the full ice detection member 67 rotates to detect the ice of the ice bin 50, the full ice detection member 67 may detect the ices within the ice bin 50 while moving backward by passing through the inside of the ice bin 50 from the front side of the ice bin 50.

Also, the full ice detection member 67 may rotate at a set angle $\alpha$ until the full ice state is detected with respect to the standby state. Here, the set angle may be approximately 65% and thus, an end of the full ice detection member 67 may disposed on the lowermost end in the state of rotating at the set angle to reach a height corresponding to the full ice height $H_1$.

Here, a lower end of the full ice detection member 67 may rotate until a height of the lower end of the full ice detection member 67 is equal to or less than that of the lower end of the edge part 631 when the ice tray 63 rotates. That is, a stored height of the ice, which is detected by the full ice detection member 67, may be a height at which the ice tray 63 does not interfere with the transferred ice when the ice tray 63 rotates to transfer the ice. Substantially, the stored height may be a maximum height to which the ices are maximally stored while securing the operation of the ice tray 63.

At least upper portion of the full ice detection member 67 may be disposed in a space between the ice tray 63 and the mounting bracket 61 in the standby mode state. That is, a separate space for locating the full ice detection member 67 may not be further secured but be disposed in a space between the rear surface of the freezing compartment door 21 and the inclined or rounded shape of the cell 632 of the ice tray 63, which is defined when the ice maker 60 is mounted. Thus, event through the structure in which the full ice detection member 67 rotates in the lower region of the ice tray 63 is provided, the loss in storage capacity of the ice bin 50 may not occur substantially.

In detail with respect to the structure of the full ice detection member 67, the full ice detection member 67 may be mounted on one surface of the driving part case 651 of the driving part 65. The driving shaft 654 to which the tray rotation shaft 636 of the ice tray 63 is coupled may be exposed to one surface of the driving part case 651, and also, a detection member rotation shaft 655 on which the full ice detection member 67 is mounted may be exposed to the same surface. Thus, the ice tray 63 and the full ice detection member 67 may be respectively coupled to the driving shaft 654 and the detection member rotation shaft 655 to rotate by being interlocked with each other by the gear structure within the driving part 65 when the driving part 65 is driven.

The driving shaft 654 and the detection member rotation shaft 655 may be provided on the same plane and extend in the same direction. Thus, the structure in which the driving shaft 654 and the detection member rotation shaft 655 are interlocked with each other through a relatively simple structure by a spur gear within the driving part 65 may be realized, and thus, the driving part 65 may also have a slim thickness and be compact.

On the other hand, in the case of the full ice detection device that moves in the vertical direction according to the related art, the structure in which the driving shaft for rotating the ice tray and the rotation shaft for driving the full ice detection device cross each other may be necessarily provided. Thus, the combination and arrangement of the gears within the driving part may be relatively complicated, and the driving part may have thicker thickness.

Also, the case protrusion 652 may laterally extends on the top surface of the driving part case 651, and the screw fixing part 653 may protrude upward.

The full ice detection member 67 may extend from an inner surface of the driving part 65 on the whole. That is, the full ice detection member 67 may extend in the extension direction of the ice tray 63 under the ice tray 63. That is, the full ice detection member 67 may extend from one end to the other end of the ice tray and have a length corresponding to that of the ice tray 63 or greater than that of the ice tray 63.

The full ice detection member 67 may have a bent plate shape having a predetermined width on the whole. That is, the full ice detection member 67 may include a connection part 671 and a detection part 672, which are bent in directions crossing each other.

The connection part 671 may define one end of the full ice detection member 67 and be connected to the detection member rotation shaft 655. The connection part 671 may be disposed in parallel to the driving part case 651 and bent at an angle that is perpendicular or almost perpendicular to the detection part 672.

A shaft coupling part 671*a* coupled to the detection member rotation shaft 655 may be disposed on one end of the connection part 671, and the connection part 671 may be fixed and coupled to the detection member rotation shaft 655 by a coupling member 671*b* passing through the shaft coupling part 671*a*. Thus, when the detection member rotation shaft 655 rotates, the connection part 671 may rotate together.

The connection part 671 may extend in a direction perpendicular to the ice tray 63, i.e., parallel to one surface adjacent to the driving part case 651. Also, the connection part 671 may not protrude to the outside of the ice maker 60 while the detection part 672 does not interfere with the rotation of the ice tray 63 and simultaneously may extend by a length at which the connection part 671 reaches or passes through the full ice height $H_1$.

Also, a reinforcement part 673 may be disposed on an inner surface of the connection part 671. The reinforcement part 673 may extend from one side of the connection part 671 up to a point that comes into contact with an end of the detection part 672 and have a thickness greater than that of an upper portion thereof on which the shaft coupling part 671*a* is disposed. That is, the reinforcement part 673 may be formed by a stepped portion of the inner surface of the connection part 671 and have a thickness that gradually increases toward the detection part 672.

Also, the reinforcement part 673 may have a height that gradually decrease from a rear end coming into contact with ice when the full ice state is detected toward a rear end thereof. A portion of the region of the connection part 671, which faces the ice bin 50, may have a high height and a thin thickness and then may gradually decrease in height and increase in thickness in the opposite direction on the whole. Thus, when the full ice detection member 67 rotates, an impact or a load may be applied to the detection part 672 due to the contact with the ice. Thus, the connection part 671 may prevent the full ice detection member 67 from being damaged by the impact or load. Also, the connection part 671 may have a width that gradually increases an upper end thereof, on which the shaft coupling part 671*a* is disposed, toward a lower end thereof.

Also, the lower end of the connection part 671 may come into contact with one end of the detection part 672. That is, the full ice detection member 67 may be bent perpendicularly from the extending end of the connection part 671 to form the detection part 672.

The detection part 672 may have a plate shape having the same width as the lower end of the connection part 671. The detection part 672 may extend from one end of the connection part 671 to the extending other end of the ice tray 63. That is, the detection part 672 may have a length corresponding to that of at least the ice tray 63. Thus, whether the full ice state in the region in which the ice tray 63 is disposed may be completely detected. Also, the detection part 672 may have a predetermined width in the standby state so that the detection part 672 does not interfere with the rotation of the ice tray 63.

The detection part 672 may be rounded in inner surface and outer surface. When the ice dropping from the ice tray 63 comes into contact with the full ice detection member 67, the ice may not be hung on the detection part 672 but move along the detection part 672 due to the rounded shape of the detection part 672. Also, when the full ice state is detected, the full ice detection member 67 may effectively prevent the ice from being hung due to the rotation even through the full ice detection member 67 comes into contact with the ice so that the full ice state is effectively detected, and the full ice detection member 67 returns to the standby state.

Here, the rounded shape of the detection part 672 may have a predetermined curvature so that the ice transferred along the detection part 672 drops to an inner front side of the ice bin 50.

Also, a reinforcement rib 674 may be disposed on one end (the lower end in FIG. 15) of the detection part 672. The reinforcement rib 674 may be bent at an angle that is perpendicular or almost perpendicular to the one end of the detection part 672, i.e., be bent from an inner surface to an outer surface of the detection part 672. Also, the reinforcement rib 674 may be disposed on a front end in a direction in which the detection part 672 rotates to detect the full ice state.

The reinforcement rib 674 may reinforce the overall strength of the detection part 672 and also prevent the detection part 672 from being damaged when the full ice detection member 67 rotating for detecting the full ice state comes into contact with ice. Particularly, a contact area with the ice may increase to damp the impact when coming into contact with the ice, and also, additional reinforcement may be provided to maintain the shape of the detection part 672 in the structure in which one end of the detection part 672 is fixed to the connection part 671.

In addition, a contact radius with the ice and a surface area may substantially increase due to the increase in surface area by the bent structure of the reinforcement rib 674, and the performance for detecting the full ice state within the ice bin 50 may be improved in proportional to the increase of the contact radius and the surface area.

Also, an auxiliary rib 675 may be disposed on the other end (the upper end in FIG. 19) of the detection part 672 opposite to the position on which the reinforcement rib 674 is disposed. The auxiliary rib 675 may extend from one end to the other end of the rear end of the detection part 672. Also, the rear end of the detection part 672 may be inclined or rounded. Here, the auxiliary rib 675 may have a height less than that of the reinforcement rib 674 to reinforce the strength. Also, the auxiliary rib 675 may return to the standby state to prevent the ice from being hung while the rotation.

The freezing release member 677 may be disposed on one side of an inner surface of the detection part 672. The freezing release member may allow the full ice detection member 67 to be released from a frozen state by the rotation of the ice tray 63 when the shaft of the full ice detection member 67 is not driven by the frozen state.

The freezing release member 677 may be disposed between a pair of mounting parts 676 extending from the inner surface of the detection part 672. Also, a release member rotation shaft 677*c* passing through a hole 676*a* defined in the mounting part 676 may protrude from each of both side surfaces of the freezing release member 677. Thus, the freezing release member 677 may have a rotatable structure between the mounting parts 677.

The freezing release member 677 may have a plate shape having a width that gradually increases from an upper portion 677*a* to a lower portion 677*b*. Thus, the upper portion 677*a* having the narrow width may come into contact with the ice tray 63 above the release member rotation shaft 677*c*, and the lower portion 677*b* having the wide width may be disposed below the release member rotation shaft 677*c*. Thus, the freezing release member 577 may have a weight center that is defined below the release member rotation shaft 677*c* and simultaneously defined at a rear side of the release member rotation shaft 677*c*. Thus, when the full ice detection member 67 is in the standby state, the upper portion 677*a* of the freezing release member 677 may be in a state of preparing contact with the ice tray 63 in the state in which the upper portion 677*a* rotates.

The freezing release member 677 may extend by a length at which the freezing release member 677 comes into contact with the edge part 631 of the ice tray 63 when the ice tray 63 rotates. Also, an inclined or rounded contact part 677*d* may be disposed on the upper portion 677*a* of the freezing release member 677. The contact part 677*d* may contact with the edge part 631 of the ice tray 63. When the ice tray 63 rotates, the edge part 631 of the ice tray 63 may push the contact part 677*d* without being hung to be restricted by the contact part 677*d* to allow the ice tray 63 to rotate.

An operation of the freezing release member will be described below in more detail.

Figure 21:
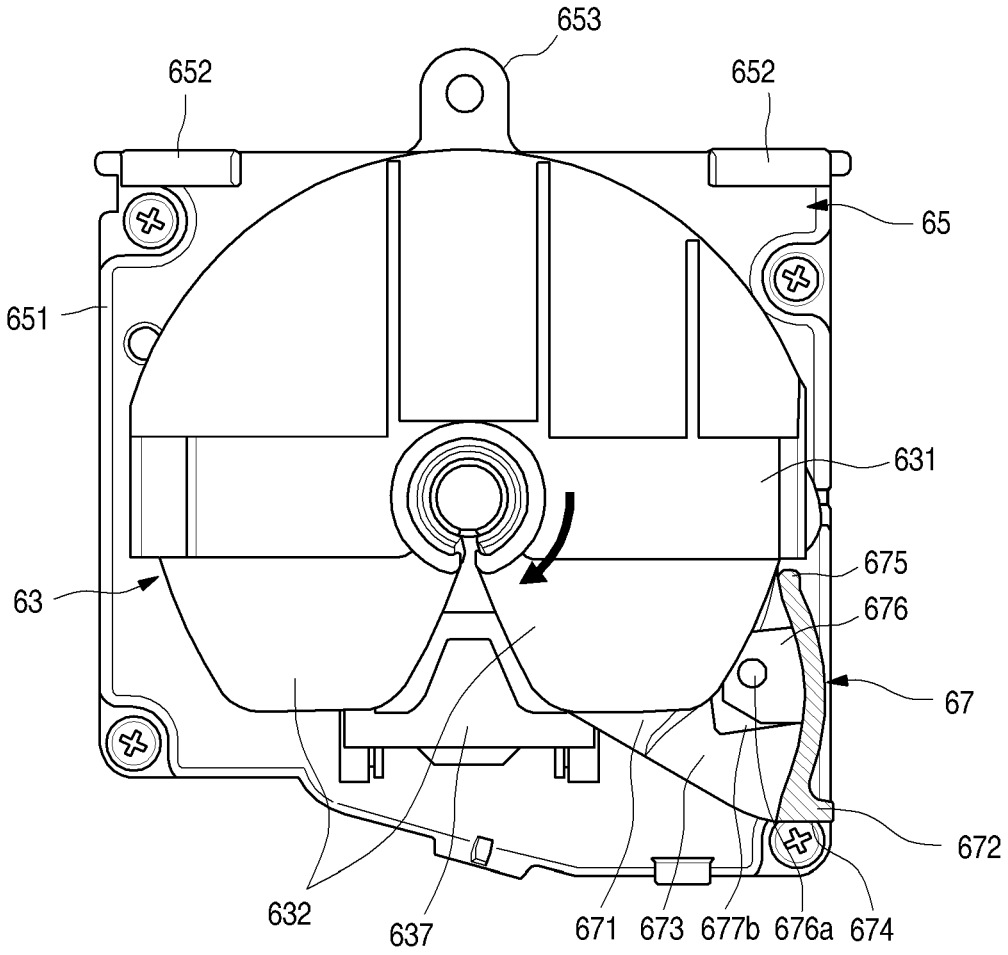
FIGS. 21 and 22 are views illustrating an operation state for releasing coupling of the full ice detection member.
Figure 22:
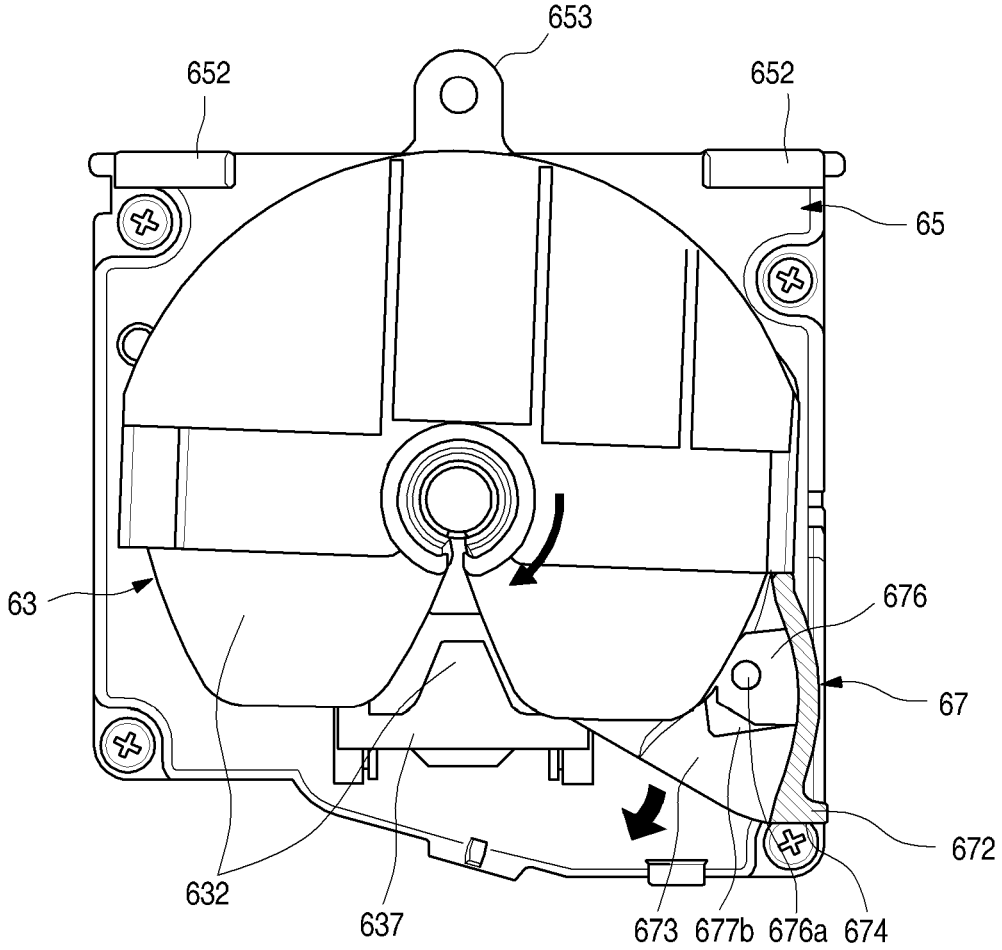

FIGS. 21 and 22 are views illustrating an operation state for releasing coupling of the full ice detection member.

In the state in which the ice tray 63 does not rotate for transferring the ice, and the full ice detection member 67 is not driven for detecting the full ice state, the ice tray 63 and the full ice detection member 67 may be maintained in the state illustrated in FIG. 21.

Here, the freezing release member 677 may extend from the detection part 672 to the outer surface of the ice tray 63. The freezing release member 677 may protrude to a recessed space between the cells 632 of the bottom surface of the ice tray 63. Thus, in the state of FIG. 20, an end of the freezing release member 677 may be only inserted into the space between the cells 632 of the ice tray 63 but may not come into contact with the outer surface of the ice tray 63.

Also, the freezing release member 677 may have a weight center at a right lower side with respect to the release member rotation shaft 677*c*. Thus, the freezing release member 677 may be maintained in a state of rotating in a counterclockwise direction with respect to the release member rotation shaft 677*c*.

In this state, when the ice tray 63 rotates, the contact part 677*d* of the freezing release member 677 may be disposed between the cells 632 and thus may not come into contact with the outer surface of the cell 632 but come into contact with the edge part 631 of the ice tray 63 after the ice tray 63 rotates at a set angle.

Alternatively, in the state in which the full ice detection member 67 is not frozen, the full ice detection member 67 may rotate by being interlocked with the rotation of the ice tray 63. Thus, in the state of rotating for normally detecting the full ice state, the ice tray 63 and the freezing release member 677 may not come into contact with each other. Here, the contact may not be actual contact but mean contact in which force capable of pressing the freezing release member 677 to release the frozen state is applied.

The detection member rotation shaft 655 of the full ice detection member 67 or a portion adjacent to the detection member rotation shaft 655 may be attached to prevent the full ice detection member from normally rotating due to various situation such as a situation in which moisture within the ice making unit 24 may be frozen to be attached, or water within the ice tray 63 may splash while the water is supplied. Here, this state may be called an attached state.

In the state in which the full ice detection member 67 is frozen and thus is not driven, only the ice tray 63 may rotate by the operation of the driving part 65. In the state in which the full ice detection member 67 is maintained in the standby state, when the ice tray 63 rotates to reach the set angle, the edge part of the ice tray 63 may come into contact with the contact part 677*d* as illustrated in FIG. 22.

In the state in which the edge part 631 comes into contact with the contact part 677*d*, when the ice tray 63 further rotates, the edge part 631 may push the contact part 677*d* to pull the freezing release member 677. As described above, when force is applied to the freezing release member 677, force may be applied to the full ice detection member 67 in the rotation direction, and thus, the frozen state of the detection member rotation shaft 655 of the full ice detection member 67 may be released.

In the state in which the restriction of the full ice detection member 67 due to the frozen state, the full ice detection member 67 may rotate by being interlocked with the rotation of the ice tray 63. Also, in the state in which the full ice detection member 67 rotates together with the ice tray 63, the ice tray 63 and the freezing release member 677 may be spaced apart from each other, and thus, the force may not be applied to the edge part 631 anymore.

In the section in which the ice tray 63 and the freezing release member 677 come into contact with each other, when the full ice detection member 67 is normally driven without being frozen, the contact may be performed within a region corresponding to a section in which the rotation of the full ice detection member 67 starts. Thus, at the moment in which the frozen state of the full ice detection member 67 is released by the freezing release member 677, the full ice detection member 67 may rotate immediately. Then, after the full ice state is detected, the full ice detection member 67 may return to the standby state.

Figure 23:
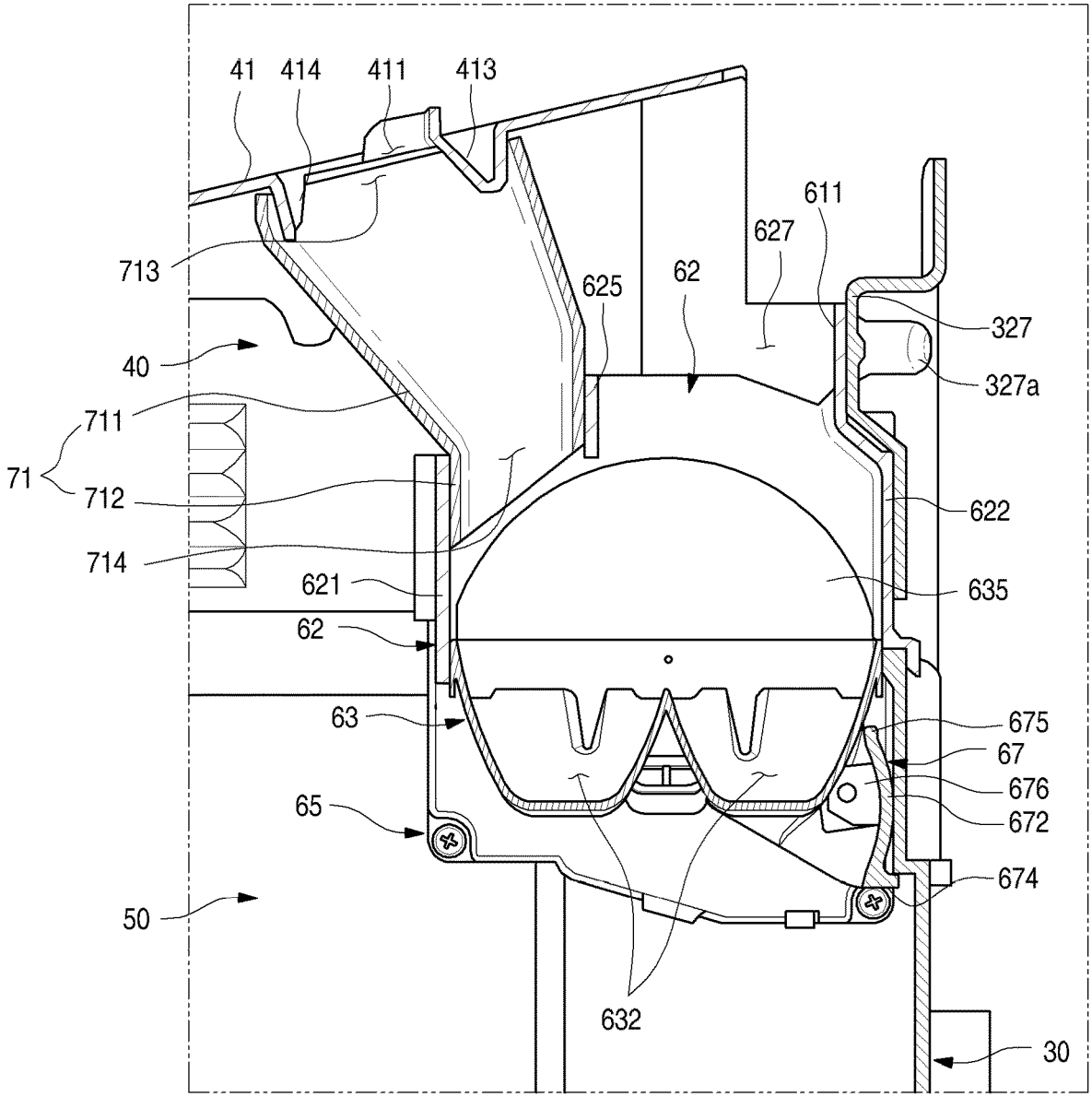
FIGS. 23 to 25 are views illustrating operation states of the ice tray and the full ice detection member in stages.
Figure 24:
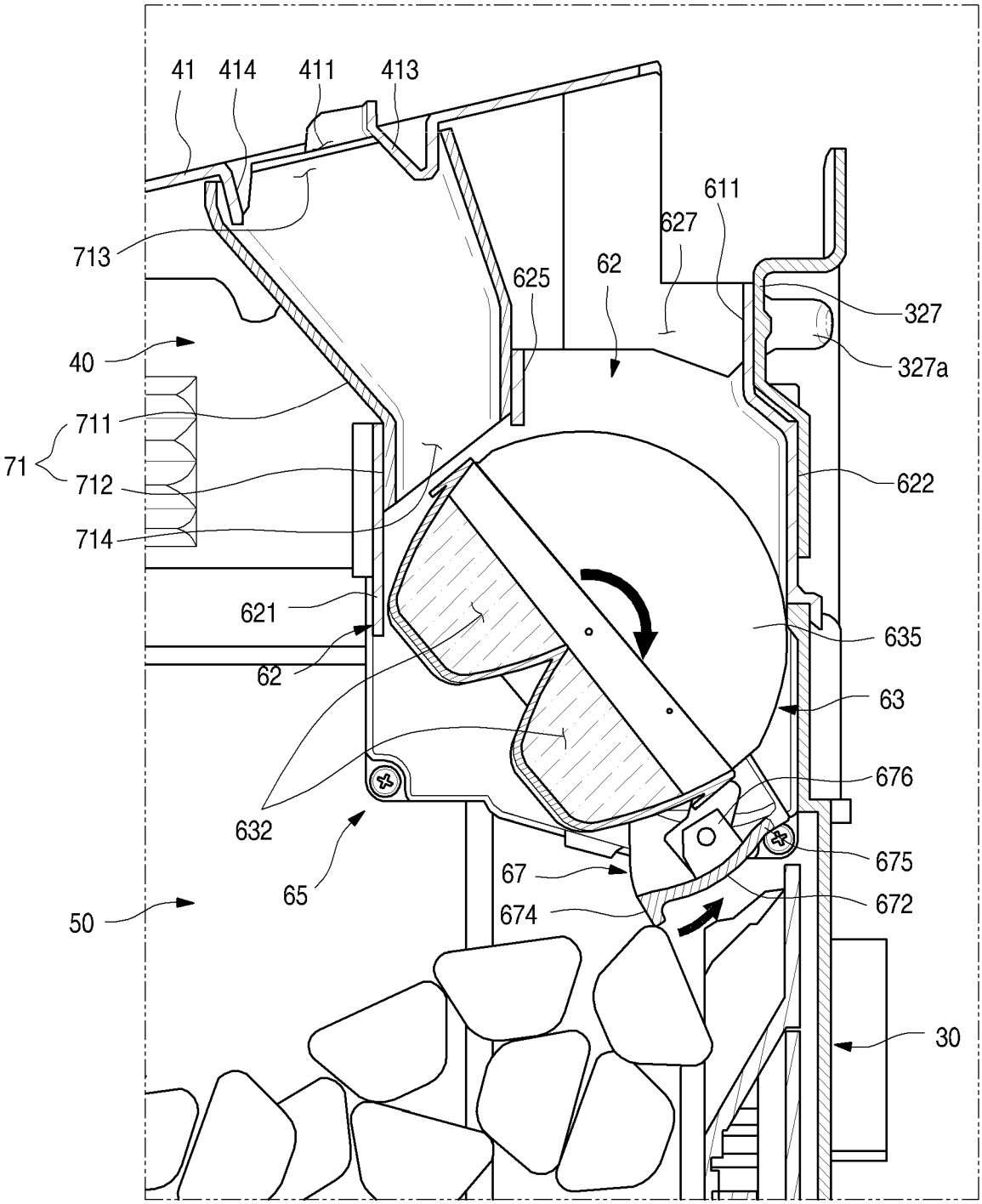
Figure 25:
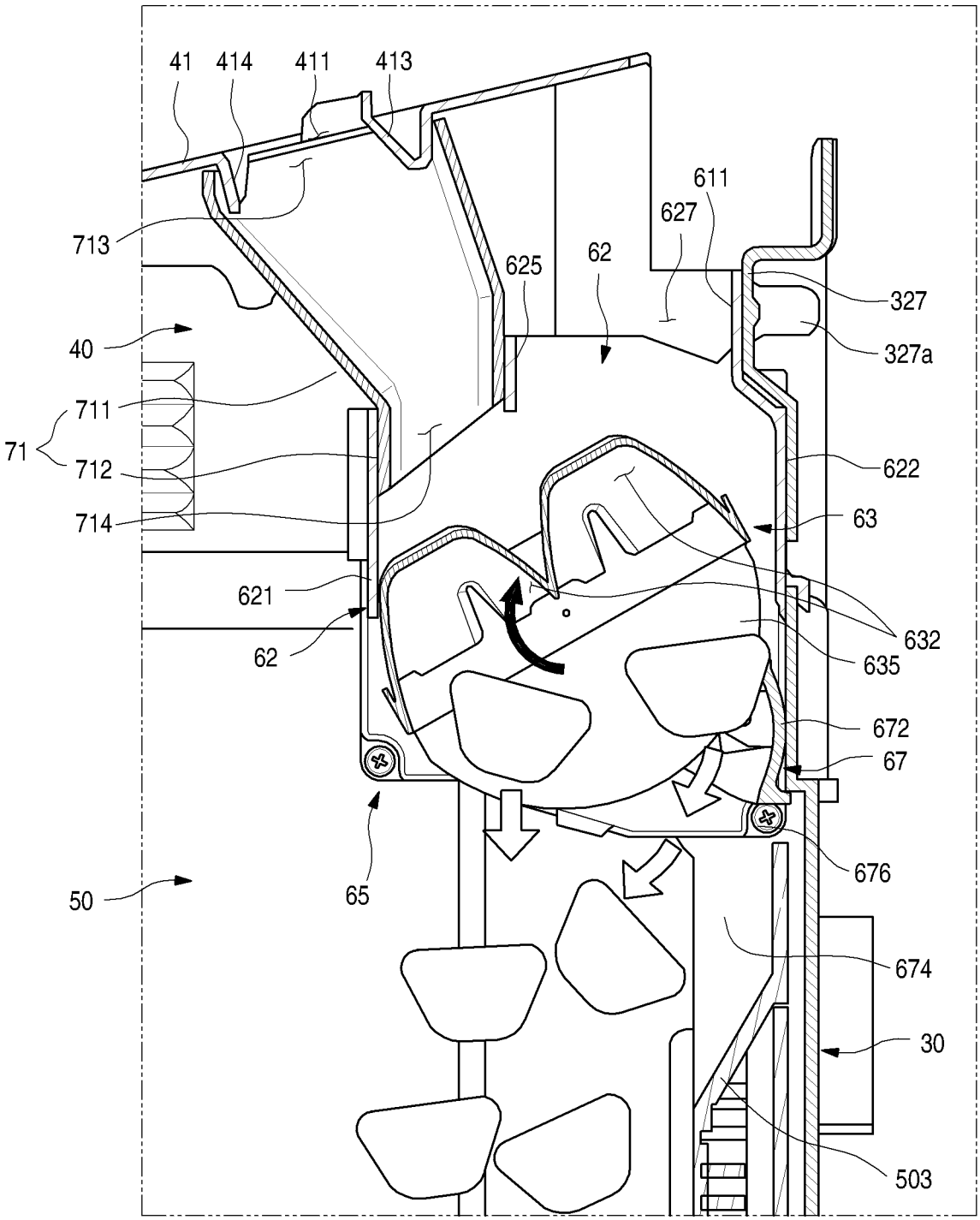

FIGS. 23 to 25 are views illustrating operation states of the ice tray and the full ice detection member in stages.

As illustrated in the drawing, the driving part 65 may include the motor generating driving force and the plurality of gears transmitting the power of the motor. Also, constituents for driving the ice tray 63 and the full ice detection member 67 may be disposed in the driving part case 651.

To make ice, water may be supplied to the ice tray 63 through the water supply cup 68. Also, cold air supplied into the ice making unit 24 may be supplied to the ice tray 63 through the ice cover 40 and the supply duct 71.

Here, the ice tray 63 may be horizontally maintained as illustrated in FIG. 21. Also, the edge part 631 of the ice tray 63 may come into contact with the accommodation part front surface 622 and the accommodation part rear surface 621 of the tray accommodation part 62.

Also, the full ice detection member 67 may be in the standby state, and the detection part 672 may be away from the rotation path of the ice tray 63 and thus may not interfere until the rotation of the ice tray 63 starts.

Also, in the state in which the full ice detection member 67 is in the standby state, the detection part 672 of the full ice detection member 67 may be disposed in a space between the inclined portion of the ice tray 63, on which the cell 632 is disposed, and the seating member 30. Thus, when the full ice detection member 67 is in the standby state, a separate space for locating the full ice detection member 67 is not necessary. Thus, the standby state may be maintained below the ice tray 63.

In the state in which the full ice detection member 67 is in the standby state, the full ice detection member 67 may be disposed in a lower region of the ice tray 63 and a front region close to the seating member 30. Thus, since the full ice detection member 67 does not cover the cold air discharge hole 241 and the rear region of the ice tray 63, which is adjacent to the cold air discharge hole 241, when the cold air introduced into the ice tray 63 is discharged through the cold air discharge hole 241, any interference may not occur, and thus, the cold air may be effectively discharged toward the cold air discharge hole.

When it is determined that the ice making in the ice tray 63 is completed by a temperature sensor 637 provided in the ice maker 60, the ice tray 63 may rotate for transferring the ice.

While the ice tray 63 rotates for transferring the ice, the full ice detection member 67 may rotate together. When the ice tray 63 rotates at a set angle as illustrated in FIG. 24, the full ice detection member 67 may also rotate by being interlocked with the ice tray 63.

Alternatively, the full ice detection member 67 rotates first before the ice tray 63 rotates to detect the full ice state, and then, the ice tray 63 may rotate.

It may be confirmed that ices stored in the ice bin 50 is full by the rotation of the full ice detection member 67. When the ices stored in the ice bin 50 are full, the full ice detection member 67 may be completely rotated in the clockwise direction to reach the full ice detection position and then rotate again in the counterclockwise direction to return to its original position. Here, when the full ice state is detected by the full ice detection member 67, the rotation of the ice tray 63 for transferring the ice may be stopped and then reversely rotate to return to its original position.

The ice tray 63 and the full ice detection member 67 may rotate in the same direction. Thus, when the ice drops from the ice tray 63 and is accumulated on the ice bin 50, the full ice detection member 67 may pass through the region in which the ices are substantially accumulated while rotating to prevent the full ice detection member 67 from erroneously detecting the full ice state.

Particularly, when the ice bin 50 has a large size, the full ice detection member 67 may pass through the front portion of the ice bin 50 in which the ices are mainly accumulated while rotating to detect the full ice state. Thus, the detection of the full ice state may be improved in reliability. When compared with the structure in which the full ice detection device detects the full ice state while rotating in the vertical direction, the full ice detection member may detect the full ice state while rotating in the front and rear directions to effectively detect the height of the ices non-uniformly distributed in the ice bin 50.

Also, since the full ice detection member 67 has a plate shape, when the ices within the ice bin 50 are disposed at the full ice height, the accurate detection may be performed. Also, the full ice detection member 67 may stably detect the full ice state without being broken and damaged even though the full ice detection member 67 repeatedly comes into contact with the ice.

When the ices within the ice bin 50 are not full, while the full ice detection member 67 rotates, the ice tray 63 may continuously rotate. When the ice tray 63 rotates at the set angle or more, the ices within the ice tray 63 may be transferred to the ice bin 50.

To transfer the ices made in the ice tray 63, the ice tray 63 may rotate at the set angle. In the state in which the ice tray 63 rotates at the set angle or more, the ice tray 63 may be twisted to allow the ices to drop from the ice tray 63.

While the ices drop downward, a portion of the ices may collide with the full ice detection member 67 and then guided along the curved surface of the inner surface of the detection part 672 and accumulated on one side of the ice bin 50.

That is, as illustrated in FIG. 23, the ices may be separated from the ice tray 63 before the ice tray 63 rotates to turn inside out. Here, the full ice detection member 67 may be in a state in which the full ice detection member is rotating to return to the standby state.

In this state, although the dropping ices collide with the full ice detection member 67, the ices may not be hung on the full ice detection member 67 to move along the inner surface of the detection part 672. Particularly, the full ice detection member 67 may uniformly guide the ices dropping while rotating to uniformly distribute the ices within the ice bin 50.

Particularly, although the full ice detection member 67 completely moves to the standby state, the inner surface of the detection part 672 may face the inside of the ice bin 50, and when the ices dropping from the ice tray 63 face the detection part 672, the ices may be guided to the inside of the ice bin 50.

As described above, the full ice detection member 67 may rotate while passing through the inside of the ice bin 50 to detect the full ice state in a main region in which the ices are accumulated in the ice bin, and also, the ices transferred from the ice tray 63 may be uniformly distributed in the ice bin 50.

When the ice tray 63 completely turns inside out, the ices of the ice tray 63 may drop to be stored in the ice bin 50, and the full ice detection member 67 may return to the initial position and then be in the standby mode state.

In this state, the stop state of the ice tray 63 may be maintained until the transfer of the ices are completely completed. When a set time elapses so that the transfer of the ices is completed, the ice tray 63 may further rotate in the counterclockwise direction to become the water supply state as illustrated in FIG. 21 so as to make ices.

The ices dropping downward while transferring the ice may be guided backward by a front surface inclination part 503 disposed on a wall of the front surface of the ice bin 50. Thus, the ices made in the uniform region may be disposed in the ice bin 50. The front surface inclination part 503 may be a portion of the portion on which the auger 53 is mounted. Thus, the dropping ices may face the auger 53, and when the auger 53 operates, the ices may be more uniformly distributed.

Figure 27:
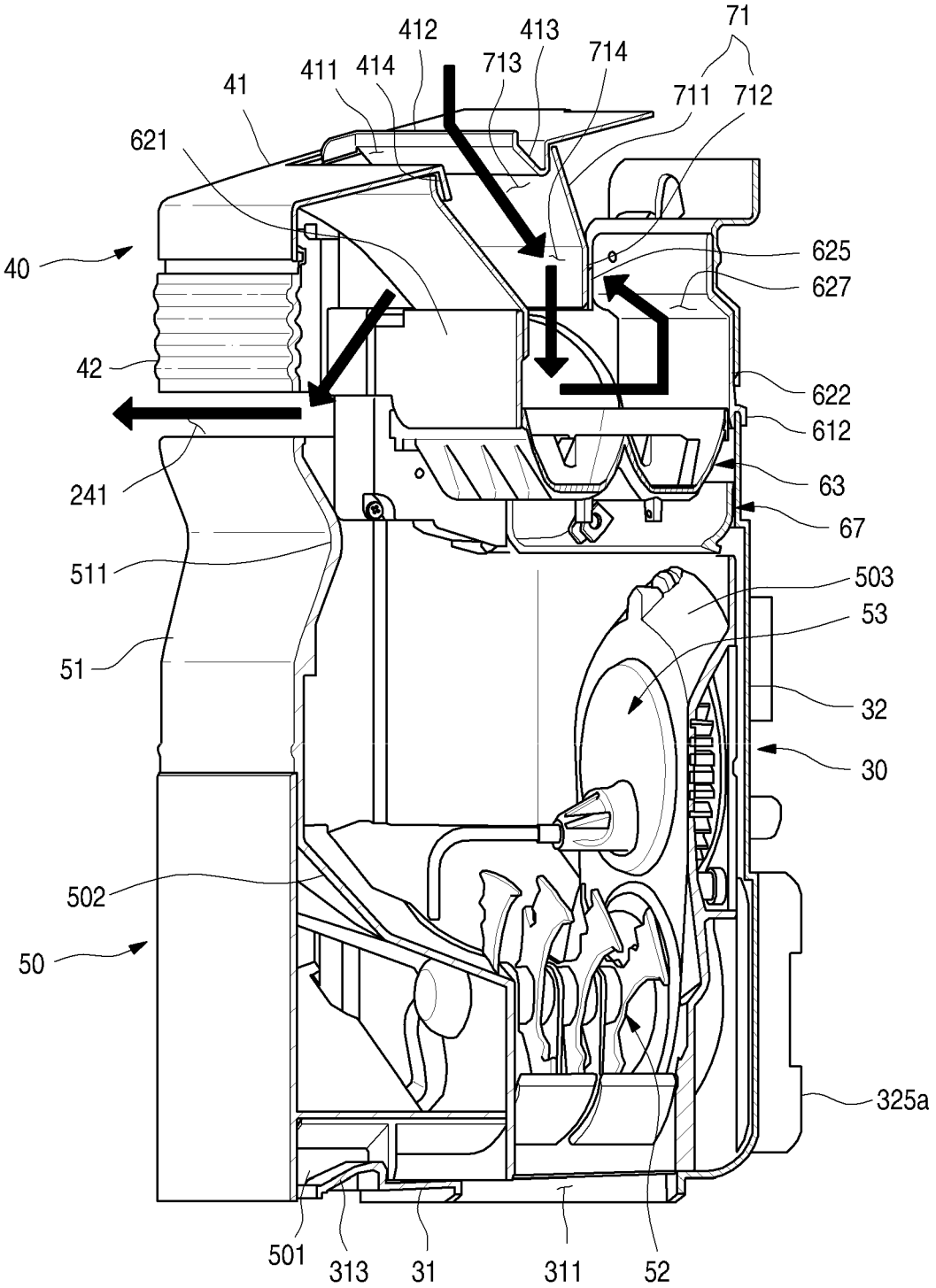
FIG. 27 is a cutaway front perspective view illustrating a flow of cold air within the ice making unit.

Alternatively, as illustrated in FIG. 27, a bottom inclination surface 502 may be disposed on a bottom surface of the ice bin 50 or a portion of the rear surface coming into contact with the bottom surface. The bottom inclination surface 502 may allow the ices disposed at the rear side of the ice bin to face the ice transfer member 52 and selectively discharge an ice cube or an ice patch through the rotation of the ice transfer member 52.

Also, the ice maker 60 may be substantially disposed vertically above the ice transfer member 52 to allow the ices dropping downward from the ice maker 60 to be collected to the ice transfer member 52 or a position adjacent to the ice transfer member 52.

Hereinafter, a flow of cold air for making ice in the refrigerator according to an implementation will be described in detail.

Figure 26:
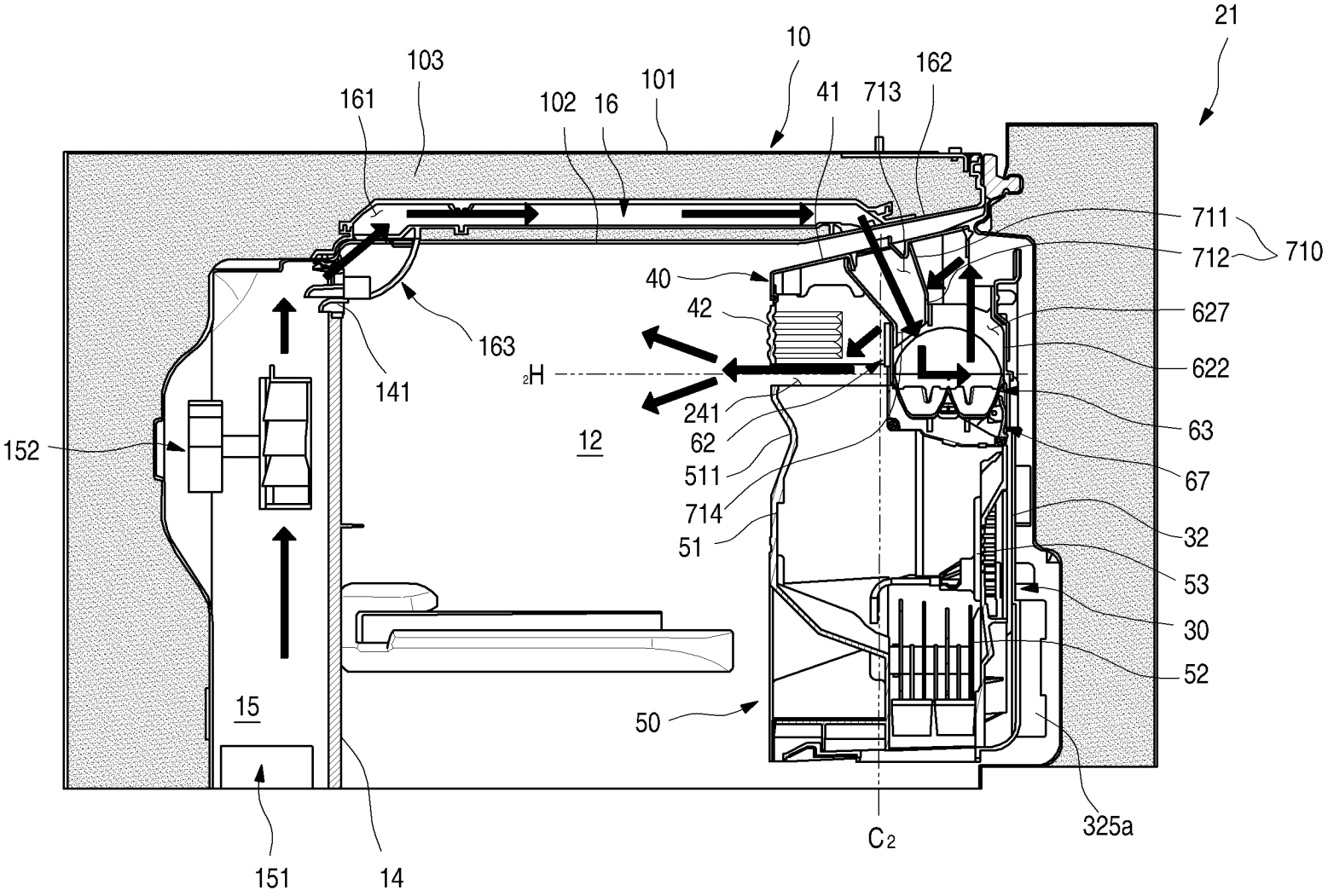
FIG. 26 is a cross-sectional view illustrating a flow state of cold air within the refrigerator.
Figure 28:
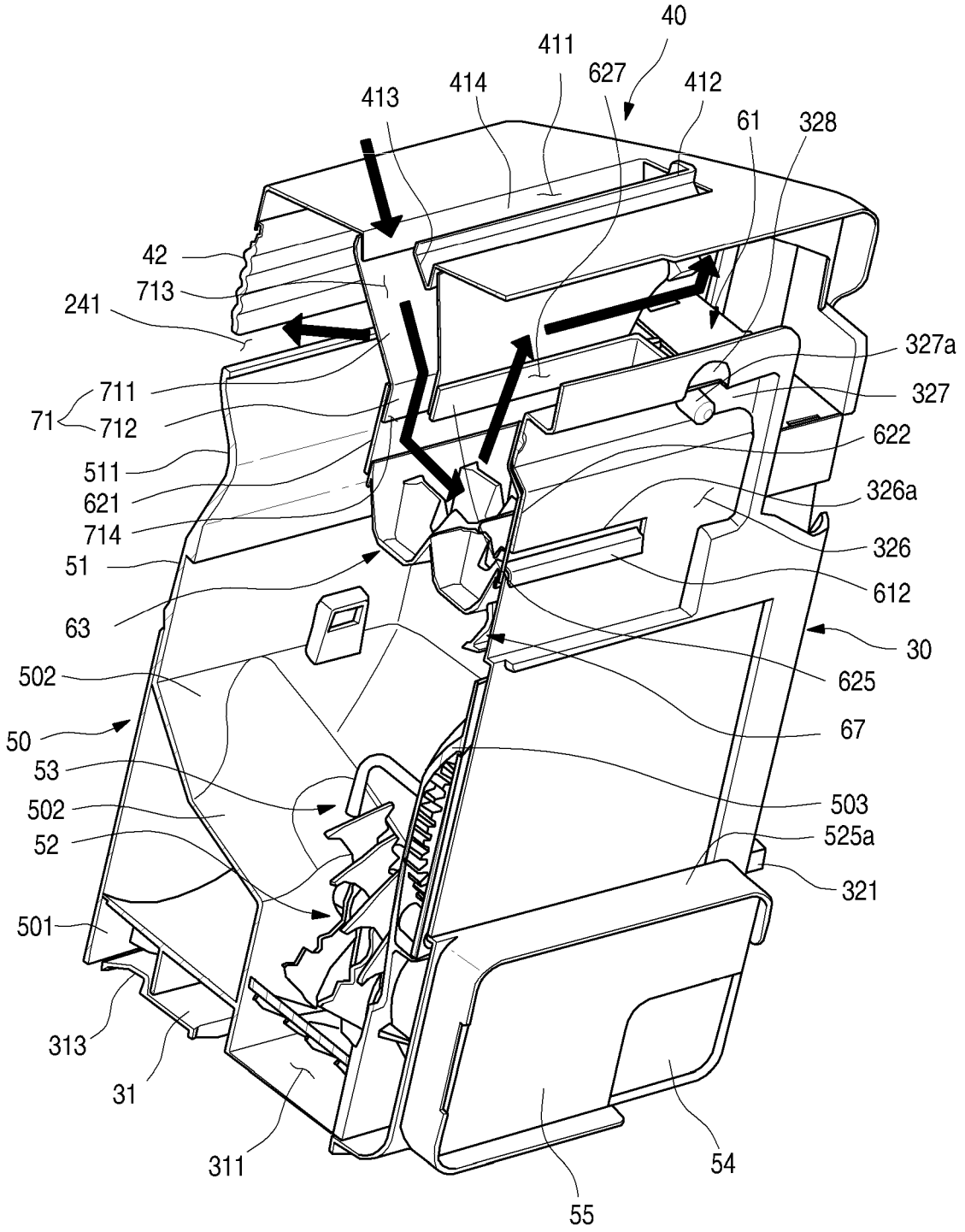
FIG. 28 is a cutaway rear perspective view illustrating a flow of cold air within the ice making unit.

FIG. 26 is a cross-sectional view illustrating a flow state of cold air within the refrigerator. Also, FIG. 27 is a cutaway front perspective view illustrating a flow of cold air within the ice making unit. Also, FIG. 28 is a cutaway rear perspective view illustrating a flow of cold air within the ice making unit.

As illustrated in the drawings, cold air generated in the evaporator 151 by the operation of the cooling fan 152 may be introduced into the freezing compartment 12 to cool the freezing compartment 12.

Also, the cold air within the heat exchange chamber 15 may be supplied to the ice making unit 24 through the cabinet duct 16 by the operation of the cooling fan 152. In the state in which the freezing compartment door 22 is closed, the duct outlet 162 of the cabinet duct 16 may be disposed adjacent to the cover inflow hole 411, and all the cold air may be introduced into the cover inflow hole 411 by being guided by the inflow hole guide 412.

The cold air introduced into the cover inflow hole 411 may be supplied to the upper side of the ice tray 63, more particularly, into the tray accommodation part 62 through the supply duct 71. Here, the lower opening 714 of the supply duct 71 may be disposed at a position that is closest to the top surface of the ice tray 63 within a range in which the supply duct 71 does not interfere with the ice tray 63 when the ice tray 63 rotates to discharge the cold air.

A flow rate of the cold air supplied to the ice tray 63 may be determined by a surface area of the lower opening 714, and the surface area of the lower opening 714 may be determined in consideration of the smooth circulation of the cold air. Also, the lower opening 714 may have a horizontal width corresponding to a horizontal length of the ice tray so that the cold air is supplied and circulated on the entire area in the horizontal direction on the top surface of the ice tray 63.

A flow direction of the cold air supplied downward to the top surface of the ice tray 63 may be perpendicular to the top surface of the ice tray 63, and after the cold air flows along the top surface of the ice tray 63, the cold air may again flow upward in a direction perpendicular to the top surface of the ice tray 63. Thus, the cold air may be continuously circulated without being stagnant by the cold air flowing in the vertical direction to cool the entire surface of the ice maker 60 at a uniform temperature.

Also, water accommodated in the cell 632 may be finely shaken by the cold air flowing in the vertical direction. Thus, an ice core for inducting the freezing for making ice may be generated. When the ice core is generated, the freezing speed may increase.

Also, the lower opening 714 may have a surface area greater than that of each of the upper opening 713, the cover inflow hole 411, and the duct outlet 162 to cause a loss of a portion of the cold air due to passage resistance while the cold air flows.

Also, the lower opening 714 of the supply duct 71 may be disposed at a position that is eccentric to the rear side with respect to the center of the ice tray 63 to discharge the cold air. Thus, the discharged cold air may flow along a top surface of the water accommodated in the ice tray 63 from the rear end of the ice tray 63 and then be heat-exchanged and discharged to a rear side with respect to the center of the ice tray 63.

Here, a front space 627 may be a surface area greater than that of a rear space 626 of the tray accommodation part 62 into which the cold air is introduced. Thus, air within the ice tray 63 may flow to the outside of the ice maker 60 through the opened top surface of the opened front space 627.

The ice maker 60 may be mounted so that the front surface is completely closely attached to a wall of the seating member 30. Thus, the cold air flowing to the outside of the ice maker 60 may flow to the front side of the ice maker 60 or may not flow downward to flow to the rear side of the ice maker 60, which provides a relatively wide space.

Since the full ice detection member 67 is disposed in a space between the lower side of the ice tray 63 and the rear side of the seating member 30, the full ice detection member 67 may not interrupt the flow of the cold air flowing to the rear side of the ice maker 60, and also, the rear space of the ice maker 60 may be secured. Thus, while the cold air from the front side of the ice maker 60 to the rear side of the ice maker 60 flows, any constituent interrupting the flow of the cold air at the rear side of the ice maker 63 may not exist to accelerate the circulation of the cold air.

The cold air flowing to the rear side of the ice maker 60 may be discharged to the outside of the ice making unit 24 through the cold air discharge hole 241. The cold air discharge hole 241 may be defined by the space between the upper end of the ice bin 50 and the lower end of the ice cover 40 and have a surface area greater than that of the front space 627 of the tray accommodation part 62 so that a more amount of cold air is effectively discharged to the freezing compartment 12.

Also, the cold air discharge hole 241 may have a height $H_2$ corresponding to that of the top surface of the ice tray 63 and be disposed in a region between the upper end of the tray accommodation part 62 and the lower end of the ice tray 63. Thus, air flowing backward by passing through the ice maker 60 may drop to the lower side of the ice bin 50 and then be discharged through the discharge hole 241 without flowing to the stored ices.

That is, while the cold air is supplied and circulated by the supply duct 71 and then discharged to the cold air discharge hole 241, the supplied cold air may be discharged to the outside of the ice making unit 24 without passing through the ices stored in the ice bin 50.

Thus, the ice stored in the ice bin 50 may be prevented from being bonded to each other by being vaporized on surfaces of the ices by the cold air and frozen by coming into contact with each other to adhere to each other. The ices stored in the ice bin 50 may be sufficiently maintained in the frozen state by indirectly cooling the ices by using the cold air within the freezing compartment 12.

In a view of the supply of the cold air, when the ice maker 60 is disposed at the front side inside the ice making unit 24, the cold air may be more uniformly supplied. That is, the ice maker 60 may be disposed at the front side (the left side in FIG. 22) with respect to a reference line $C_2$ of the center of the ice bin 50. Also, the lower opening of the supply duct may also be disposed at the front side with respect to the reference line $C_2$ of the center of the ice bin 50.

Thus, the supply duct may be sufficiently spaced apart from the duct outlet 162 of the cabinet duct 16 and the cover inflow hole 411 in the front and rear directions. Thus, the extension part of the supply duct 71 may be gently inclined. Also, the cold air introduced into the supply duct 71 may flow along the gentle inclination to allow the cold air to smoothly flow and also be smoothly circulated inside the ice maker 60.

Also, in a view of an amount of made ice once, when the ice maker 60 is disposed at the front side inside the ice making unit 24, a more amount of ices may be made. That is, both left and right surfaces of the ice making unit 24, i.e., both side surfaces of the ice bin 50 and the ice cover 40 may be inclined to avoid an interference with the inner wall of the freezing compartment 12 on the characteristics of the rotating freezing compartment door 22.

That is, the internal space of the ice making unit 24 may have the largest width at the front end, and the wide may gradually decrease backward from a position spaced a predetermined distance from the front side thereof. Thus, the ice tray 63 may be disposed at the front side so that the horizontal length of the ice tray 63 is maximally secured to increase in size of the cell 632 in which ice is made or maximize the number of cells 632. For this, the ice maker 60 may be disposed at the front side (the right side in FIG. 26) with respect to a reference line $C_2$ of the center of the ice bin 50.

Also, the ice maker 60 may be disposed at a vertical upper side with respect to the auger provided below the ice bin 50 and the ice transfer member 52 and disposed at the further front side than the rear end of the auger 53 or the ice transfer member 52.

Also, the mounting bracket 61 on which the ice tray 63 is mounted may also have a structure that is completely closely attached to the seating member 30. Particularly, the mounting bracket 61 may not be disposed in the space between the front surface of the mounting bracket 61 and the ice tray 63, and the ice tray 63 may be disposed at the maximally front side.

The cold air may be more effectively supplied to the ice maker 60 by the structure of the ice maker 60 and the arranged structure of the ice maker 60, and the ice making space may be sufficiently secured.

Figure 29:
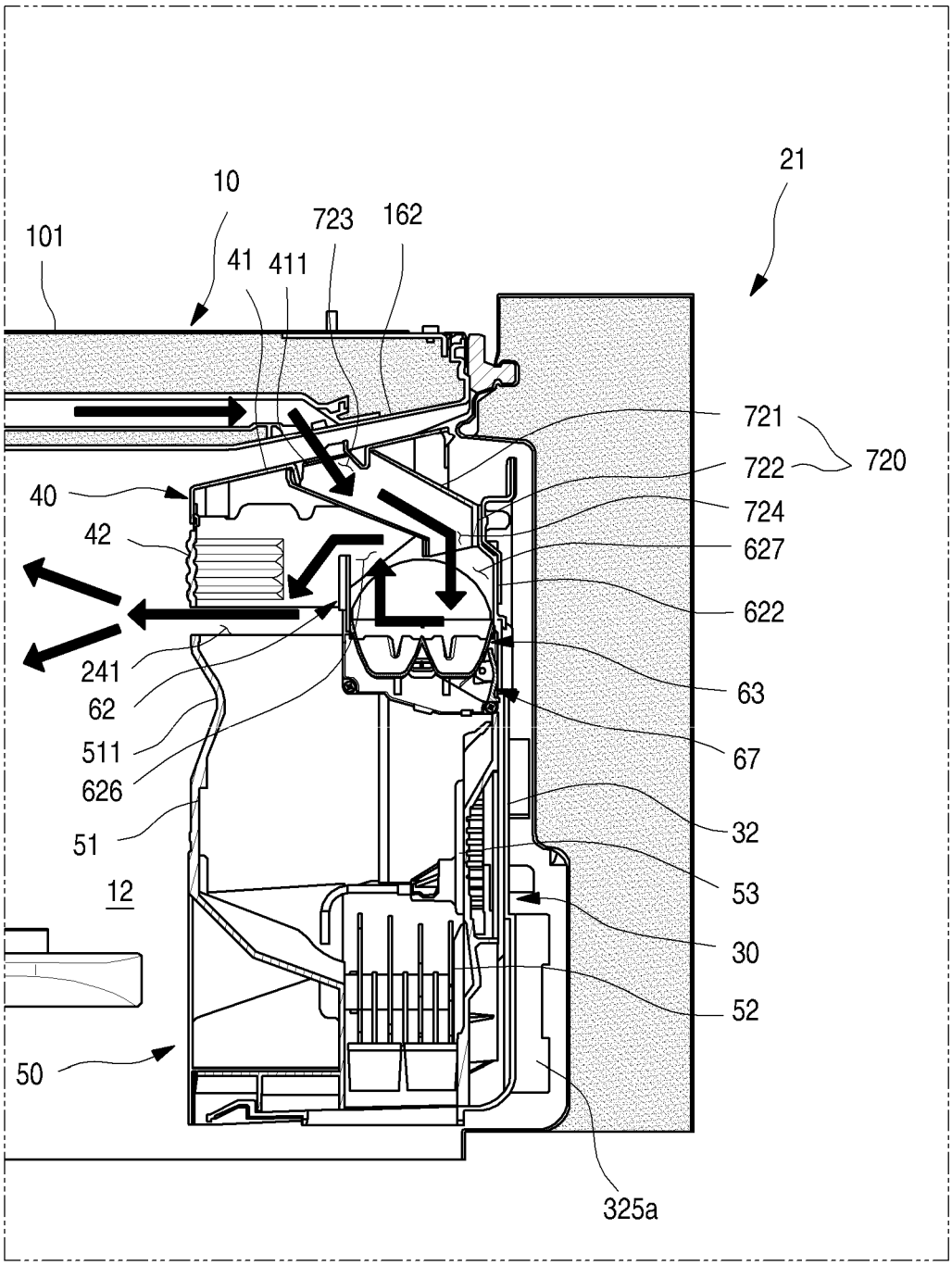
FIG. 29 is a view illustrating another example of the cold air flow state in the ice making unit.

FIG. 29 is a view illustrating another example of the cold air flow state in the ice making unit.

The ice making unit 24 may include a supply duct 72 having a different structure, and thus, a flow of the cold air may be different. Other structures except for a structure of a supply duct 72 may be the same as the inner structure of the ice making unit 24, and thus, the same constituent may be expressed by using the same reference numeral, and its detailed description will be omitted.

As illustrated in the drawing, the supply duct 72 connecting the cover inflow hole 411 of the ice cover 40 to the tray accommodation part 62 of the ice maker 60 may be disposed on an upper portion of the ice making unit 24.

The supply duct 72 may include an insertion part 722 inserted into the tray accommodation part 62 and an extension part 721 fixed to a top surface of the inside of the ice cover 40.

The insertion part 722 may vertically extend in a vertical direction and be inserted into a front space that is partitioned by the partition part 625 of the tray accommodation part 62. Thus, a lower end of the insertion part 722, i.e., the lower opening 724 may communicate with the front space.

Also, an upper end of the extension part 721, i.e., the upper opening 723 may communicate with the cover inflow hole 411, and a lower end of the extension part 721 may be connected to the upper end of the insertion part 722. Thus, the extension part 721 may be inclined or rounded and be disposed to be gently inclined when compared with the above-described supply duct 71.

Referring to the cold air flow path of the ice making unit 24 having the above-described structure, the cold air discharged through the duct outlet 162 of the cabinet duct 16 may be introduced into the extension part 721 of the supply duct 72 toward the cover inflow hole 411.

The cold air flowing along the extension part 721 may be introduced into the tray accommodation part 62 through the insertion part 722. Here, the introduced cold air may be introduced through the front space 627 to flow toward the front portion of the ice tray 63 adjacent to the freezing compartment door 21.

The cold air discharged toward the front portion of the ice tray 63 may flow backward along the top surface of the ice tray 63 and then be heat-exchanged with water accommodated in the ice tray 63 to make ice. Also, the cold air flowing along the top surface of the ice tray 63 may flow to the outside of the ice maker 60 through the rear space 626 and then be discharged to the outside of the ice making unit 24 through the cold air discharge hole 241 adjacent thereto.

Here, a volume of the rear side of the ice maker 60 and a surface area of the cold air discharge hole 241 may be greater than a volume of the rear space 626. Thus, the cold air discharged from the ice maker may not flow up to the lower side of the ice maker but be smoothly discharged through the cold air discharge hole 241.

Also, the supply duct 72 may have the extension part 721 having an inclination that is further gentle than the above-described supply duct 71, and the cold air may be introduced into the rear portion of the ice tray to flow the front side and then be discharged to the cold air discharge hole 241 disposed at the front side. Thus, the flow path may be shorted and simplified so that the cold air more effectively flows.

Figure 30:
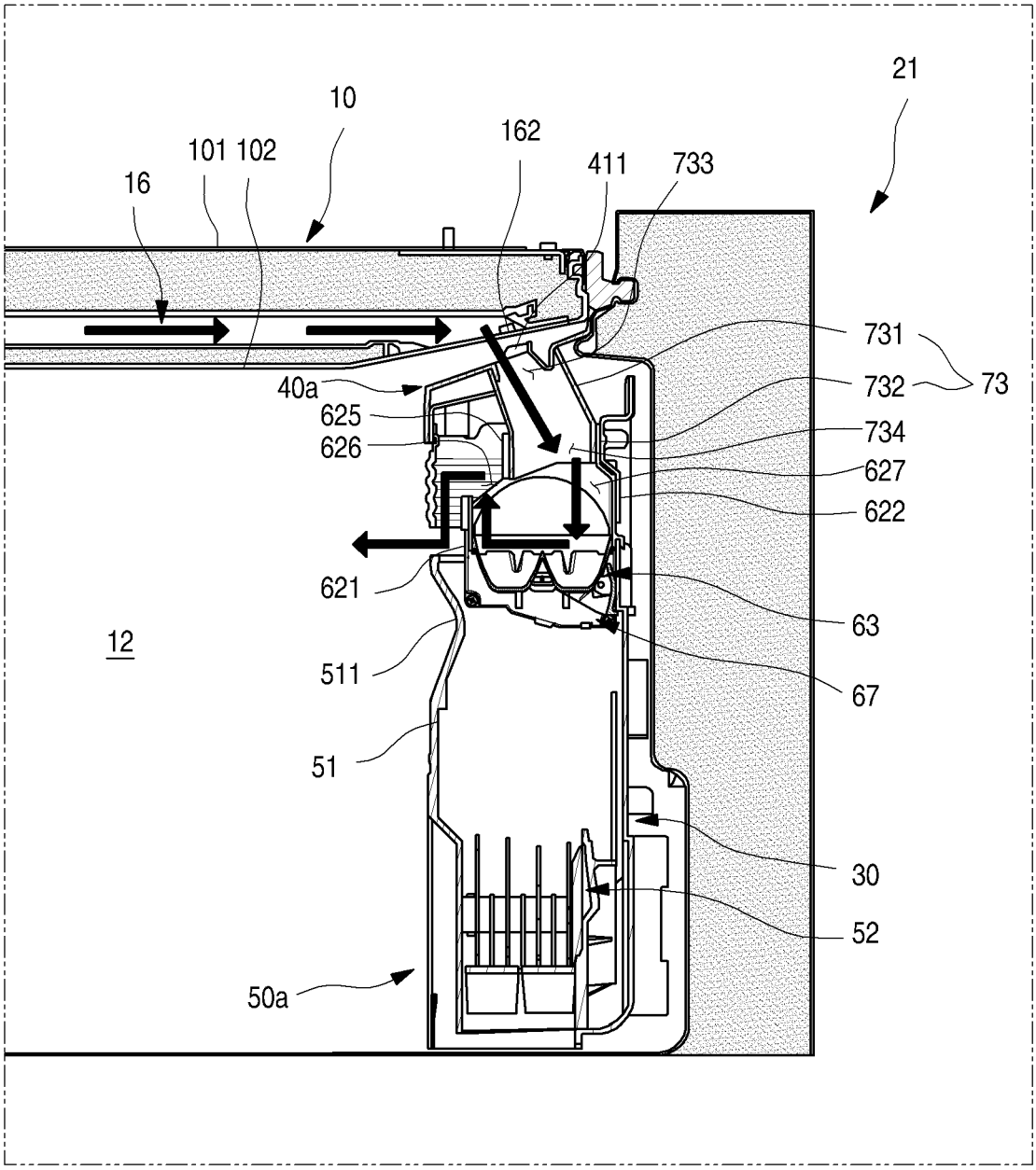
FIG. 30 is a view illustrating further another example of the cold air flow state in the ice making unit.

FIG. 30 is a view illustrating further another example of the cold air flow state in the ice making unit.

The ice making unit 24 may have a slimmer structure. Other structures except for the structures of an ice bin 50*a*, an ice cover 40*a*, and a supply duct 73 may be the same as the inner structure of the ice making unit 24, and thus, the same constituent may be expressed by using the same reference numeral, and its detailed description will be omitted.

As illustrated in the drawing, a refrigerator 1 according to further another implementation may include a cabinet 10 defining a freezing compartment 12 and a freezing compartment door 21 opening and closing the cabinet 10. An ice making unit 24 may be mounted on a rear surface of the freezing compartment door 21.

Here, a cabinet duct 16 may be disposed on a top surface of the cabinet 10, and a duct outlet 162 may be disposed on a front end of a top surface of the freezing compartment 12 to supply cold air generated in an evaporator 151 to the ice making unit 24.

A seating member 30 may be fixed and mounted on the door liner 121, and the ice making unit 24 may be disposed on the seating member 30. The ice making unit 24 may include the ice maker 60 and the ice bin 50*a*.

Here, the ice maker 60 may have the same structure as the ice maker according to the foregoing implementation, and the ice bin 50*a* and the ice cover 40*a* may have the same basic structure except for a width in front and rear directions.

That is, the ice bin 50*a* may include a see-through part 51, and the ice transfer member 52 may be provided in the ice bin 50*a*. As necessary, the above-described auger 53 may be provided in the ice bin 50*a*.

To realize the ice bin 50*a* having a slim structure, a rear surface of the ice bin 50*a* may be disposed at a position coming into contact with the ice transfer member 52, and the ice bin 50*a* may be spaced apart from a lower end of the ice cover 40*a* to extend up to a height at which the cold air discharge hole 241 is defined.

The ice maker 60 is disposed above the ice bin 50*a*. Also, a full ice detection lever 67 disposed on a lower portion of the ice maker 60 may be disposed at a lower side and a front side of the ice tray 63 to rotate and thereby to detect a full ice state of the ice bin 50*a*.

The ice tray 63 may be accommodated in the mounting bracket 61, and particularly, the tray accommodation part 62. The top surface of the ice tray 63 may be disposed in a space defined by an accommodation part front surface 622 and an accommodation part rear surface 621. Also, a partition part 625 of the tray accommodation part 62 may partition the upper side of the ice tray, i.e., the inside of the tray accommodation part 62 may be partitioned into a front space 627 and a rear space 626.

The supply duct 73 may be configured to allow the ice cover 40*a* to communicate with the front space 626 of the tray accommodation part 62. That is, the upper opening 733 of the supply duct 73 may communicate with the cover inflow hole 411 of the tray cover 40*a*, and the lower opening 734 may communicate with the front space of the tray accommodation part 62.

When the ice making unit has a slim structure, the cover inflow hole 411 corresponding to the duct outlet 162 has to be disposed at a position moving forward when compared with the cover inflow hole according to the foregoing implementation. Thus, to prevent the supply duct 73 from being sharply inclined, the lower end of the supply duct 73 may be inserted into the front space 627.

Air introduced through the cover inflow hole 411 via the duct outlet 162 may move along the supply duct 73 to supply cold air from the front space 627 of the ice tray 63 to the ice tray 63 through the lower opening 734.

The cold air introduced into the front space 627 of the ice tray 63 may move along the top surface of the ice tray 63 to flow to the outside of the ice maker 60 through the rear space 626 of the ice tray 63. Here, the cold air may pass through the cold air discharge hole 241 disposed adjacent to the front space 627 and then be introduced into the freezing compartment 12.

In this process, the accommodation part rear surface 621 of the tray accommodation part 62 may have a height that is slightly low unlike the foregoing implementations. Thus, the cold air may be easily discharged to the cold air discharge hole 241 between the ice cover 40*a* and the ice bin 50*a*, which are disposed adjacent to each other. Alternatively, the accommodation part rear surface 621 may be inclined toward the cold air discharge hole 241. Here, the height and the inclination may be set so that water accommodated in at least the ice tray 63 may not overflow.

Since the full ice detection member 67 is disposed at the lower side and the front side of the ice tray 63, the full ice detection member 67 may not be disposed in a flow path of the cold air supplied to the ice tray 63 to flow. Particularly, the full ice detection member 67 may have a slim structure and thus may not interfere with the flow between the ice tray 63 and the cold air discharge hole 241, which are adjacent to each other, so that the air heat-exchanged in the ice tray 63 is discharged to the freezing compartment 12 through the cold air discharge hole 241.

In addition to the foregoing implementation, various implementations may be exemplified.

According to another implementation, the cabinet duct may be disposed on an inner surface of the freezing compartment. A cover inflow hole for introducing the cold air to the entire area of a top surface of the ice cover may be defined to guide the cold air introduced through the entire surface of the ice cover to the top surface of the ice tray by the supply duct.

Since the cabinet duct according to another implementation except for a structure of the cabinet duct and structures of the ice cover and the supply duct are the same as those of the previous implementation, and like reference numeral denote like elements, and thus a detailed description thereof will be omitted.

Figure 31:
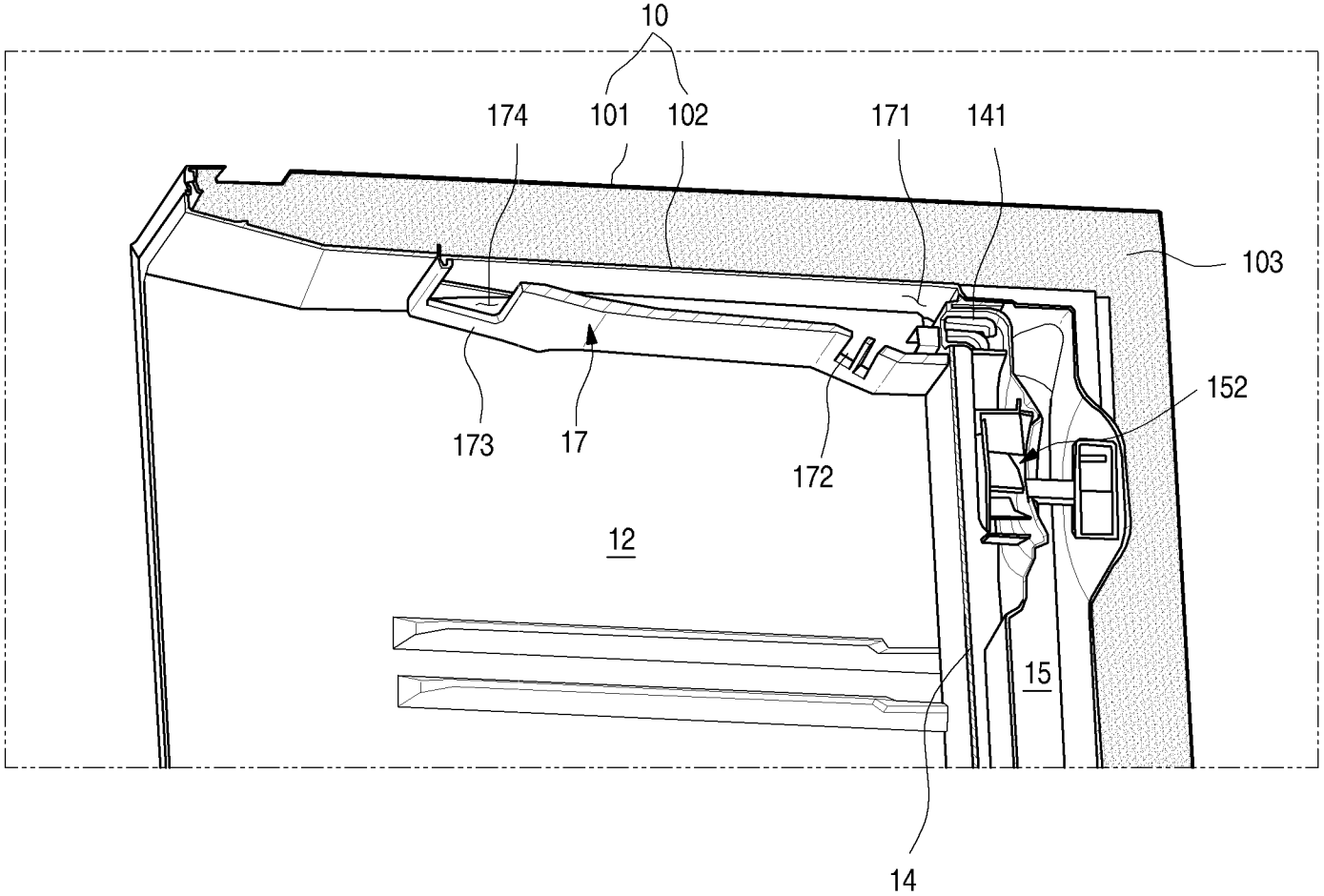
FIG. 31 is a cutaway perspective view illustrating a cabinet-side cold air flow structure of a refrigerator according to another implementation.

FIG. 31 is a cutaway perspective view illustrating a cabinet-side cold air flow structure of a refrigerator according to another implementation.

As illustrated in the drawing, the cabinet 10 according to another implementation may be defined by the outer case 101, the inner case 102, and the insulation material 103 filled between the outer case 101 and the inner case 102.

Also, a grill fan 14 may be disposed on the rear surface of the freezing compartment, which is defined by the inner case 102. The freezing compartment 12 may be provided at the front side of the grill fan 14, and a heat exchange chamber 15 may be provided at the rear side of the grill fan 14.

An evaporator 151 and a cooling fan 152 may be provided in the heat exchange chamber 15. The cooling fan 152 may operate to allow cold air within the heat exchange chamber 15 to be discharged into the freezing compartment 12 through a discharge hole 141 defined in the grill fan 14.

A cabinet duct 17 may be provided in an upper portion of the freezing compartment 12. The cabinet duct 17 may come into contact with top and rear surfaces of the freezing compartment 12, and a space through which the cold air flows may be defined in the cabinet duct 17.

The cabinet duct 17 may have an opened rear surface to define a duct inlet 171, and the duct inlet 171 may communicate with the discharge hole 141 defined in the grill fan 14. Also, a duct discharge hole 172 through which the cold air is discharged toward the inside of the freezing compartment 12 may be further defined in one side of the cabinet duct 17. Also, an inclined surface 173 may be disposed on a front end of the cabinet duct 17. The inclined surface 173 may have an inclination corresponding to a top surface of the ice making unit 24, i.e., an inclined top surface 41 of the ice cover 40. Also, a duct outlet 174 may be disposed on the inclined surface of the cabinet duct 17.

The cold air discharged to the duct outlet 174 may flow to the top surface of the ice cover 40 and then be introduced into the ice making unit 24 through the top surface of the ice cover 40.

Figure 32:
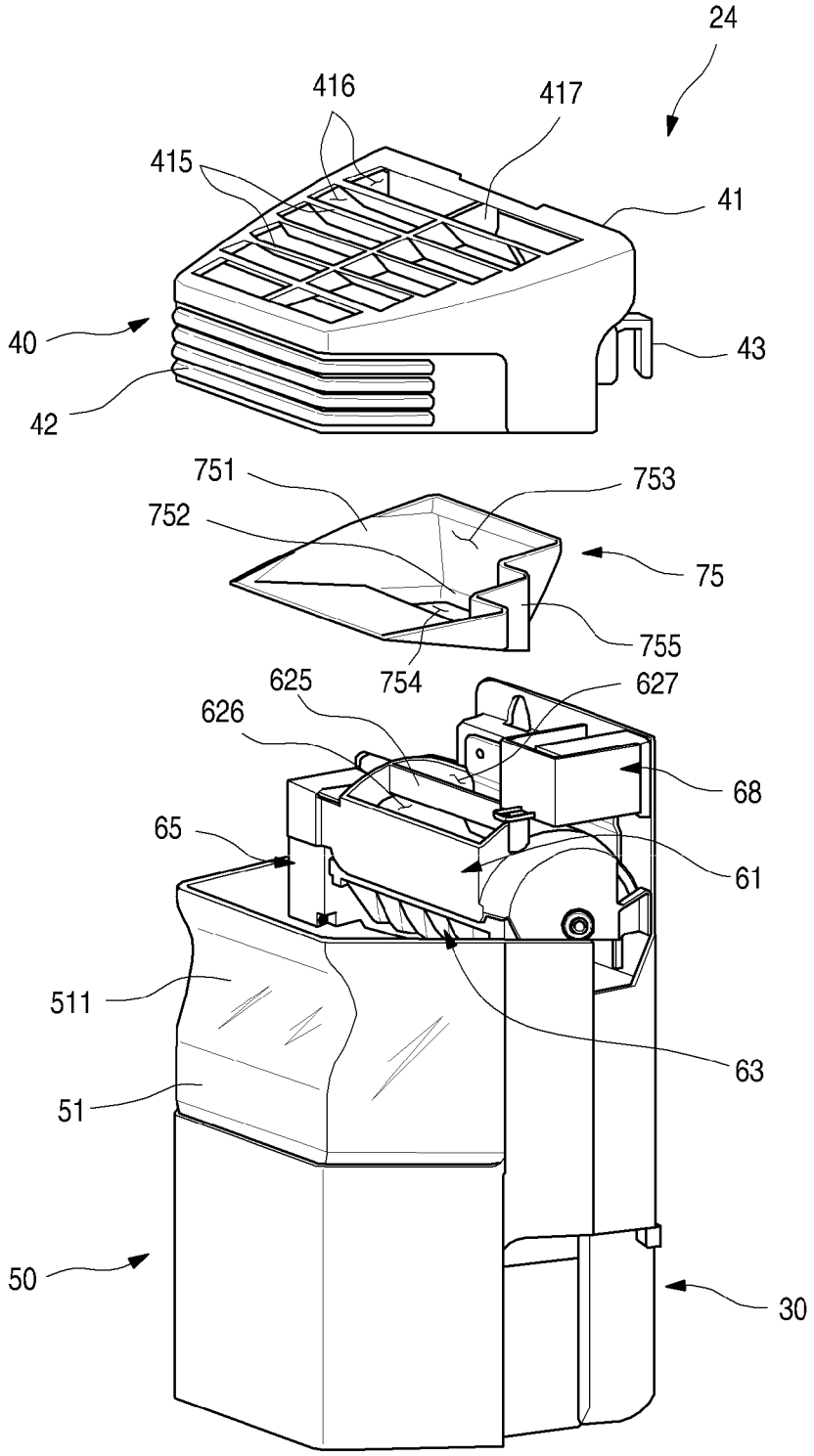
FIG. 32 is an exploded perspective view of an ice making unit according to another implementation.
Figure 33:
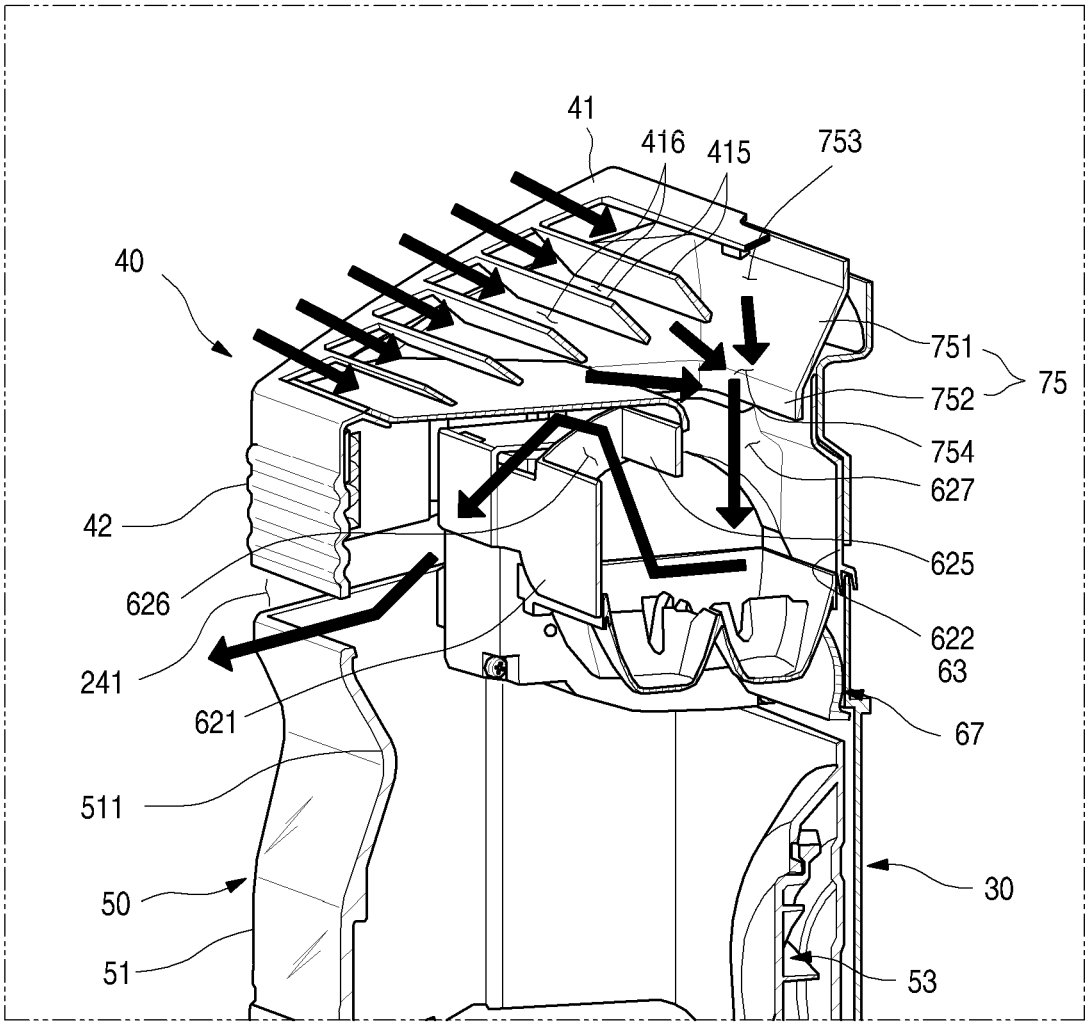
FIG. 33 is a cutaway perspective view of the ice making unit.

FIG. 32 is an exploded perspective view of an ice making unit according to another implementation. Also, FIG. 33 is a cutaway perspective view of the ice making unit.

As illustrated in the drawings, the ice making unit 24 may include a seating member 30, an ice bin 50 seated on the seating member 30, an ice maker 60 mounted above the ice bin 50, an ice cover 40 covering the ice maker 60, and a supply duct 75 guiding cold air introduced into the ice cover 40 to the ice maker 60. Here, each of the seating member 30, the ice bin 50, and the ice maker 60 may have the same structure as that according to the foregoing implementation.

Since the ice cover 40 except for an inclined top surface 41 is the same as that according to the foregoing implementation, a top surface 41 of the ice cover 40 will be mainly described.

The top surface 41 of the ice cover 40 may be disposed at a position facing an inclined surface 173 of the cabinet duct 17 in a state in which the freezing compartment door 22 is closed. Also, the top surface 41 may have an inclination corresponding to the inclined surface 173 or have an inclination slightly larger than that of the inclined surface 173. Thus, the cold air discharged from the duct outlet 174 that is spaced apart from the ice cover 40 may be effectively introduced into the cover inflow hole 416 of the top surface 41 of the ice cover 40.

A plurality of cover grills 415 may be disposed on most of an area remaining except for a circumference of the top surface 41 of the ice cover 40, and a plurality of cover inflow holes 416 may be defined between the plurality of cover grills 415.

Here, the plurality of cover grills 415 may be disposed to be inclined with respect to the cover top surface 41, i.e., disposed to be inclined toward the inside of the supply duct 75 so that all the introduced cold air is introduced into the supply duct 75.

All the cover grills 415 may be inclined toward a lower opening 754 of the supply duct 75. Thus, the cover grills 415 may have inclinations different from each other. For example, as illustrated in FIG. 33, the inclinations of the plurality of cover grills 415 may gradually decrease from a front side to a rear side. Also, the plurality of cover grills 415 may have lengths that gradually decrease from the front side to the rear side so that the cold air is smoothly introduced into the supply duct 75.

Also, a grill support 417 extending in a vertical direction may be disposed at a center of the plurality of cover grills 415 that extend in a horizontal direction. Thus, a central portion of the plurality of cover grills 415 may be supported by the grill support 417.

Also, a supply duct 75 may be disposed below the ice cover 40. The supply duct 75 may connect a top surface of the ice cover 40 to the ice maker 60 to supply the cold air introduced through the cover inflow hole 416 to the top surface of the ice tray 63.

In detail, the supply duct 72 may include an upper extension part 751 and a lower insertion part 752. The extension part 751 may come into contact with the top surface of the ice cover 40, and an upper opening 753 may be defined in an upper end of the extension part 751. The upper opening 753 may have a size that is enough to accommodate all the plurality of cover inflow holes 416. Also, the upper opening 753 may be defined along an outer circumference of the plurality of cover grills 415. Thus, most of the cold air introduced through the cover inflow hole 416 may be introduced through the upper opening 753 of the supply duct 75.

Also, a cup refuge part 715 may be disposed at one side of the extension part 751 corresponding to the water supply cup 68. The cup refuge part 715 may be recessed in a shape corresponding to the water supply cup 68 to prevent the cup refuge part 715 from interfering with the water supply cup 68. Thus, the extension part 751 may utilize the entire region of the bottom surface of the ice cover 40 except for the portion, on which the water supply cup 68 is disposed, as a flow space of the cold air.

Also, the insertion part 752 may be mounted on one side of the mounting bracket 61, i.e., mounted on a position that is eccentric with respect to a center of the ice maker 60. That is, the insertion part 752 may be inserted into the front space 627 of the tray accommodation part 62, which is partitioned by the partition part 625.

A lower opening 754 may be defined in a lower end of the insertion part 752. The lower opening 754 may have a size corresponding to that of the front space 627. Also, the insertion part 752 may extend in a vertical direction and be inserted into the front space 627. Air introduced through the supply duct 75 may be supplied to the front portion of the top surface of the ice tray 63.

The extension part 751 disposed on the upper end of the insertion part 752 may extend toward the upper opening 753. The upper opening 753 may have a surface area significantly greater than that of the lower opening 754. Thus, each surface of the extension part 751 may be inclined, and thus, all the air introduced through the upper opening 753 may be guided to the lower opening 754.

When the supply duct 75 is mounted on the mounting bracket 61, the ice cover 40 and the tray accommodation part 62 may communicate with each other by the supply duct 75. Also, all the air introduced into the cover inflow hole 416 may be guided by the supply duct 75 and then be supplied to the ice tray 63 without being lost.

Hereinafter, a flow of cold air for making ice in the refrigerator according to an implementation will be described in detail.

Figure 34:
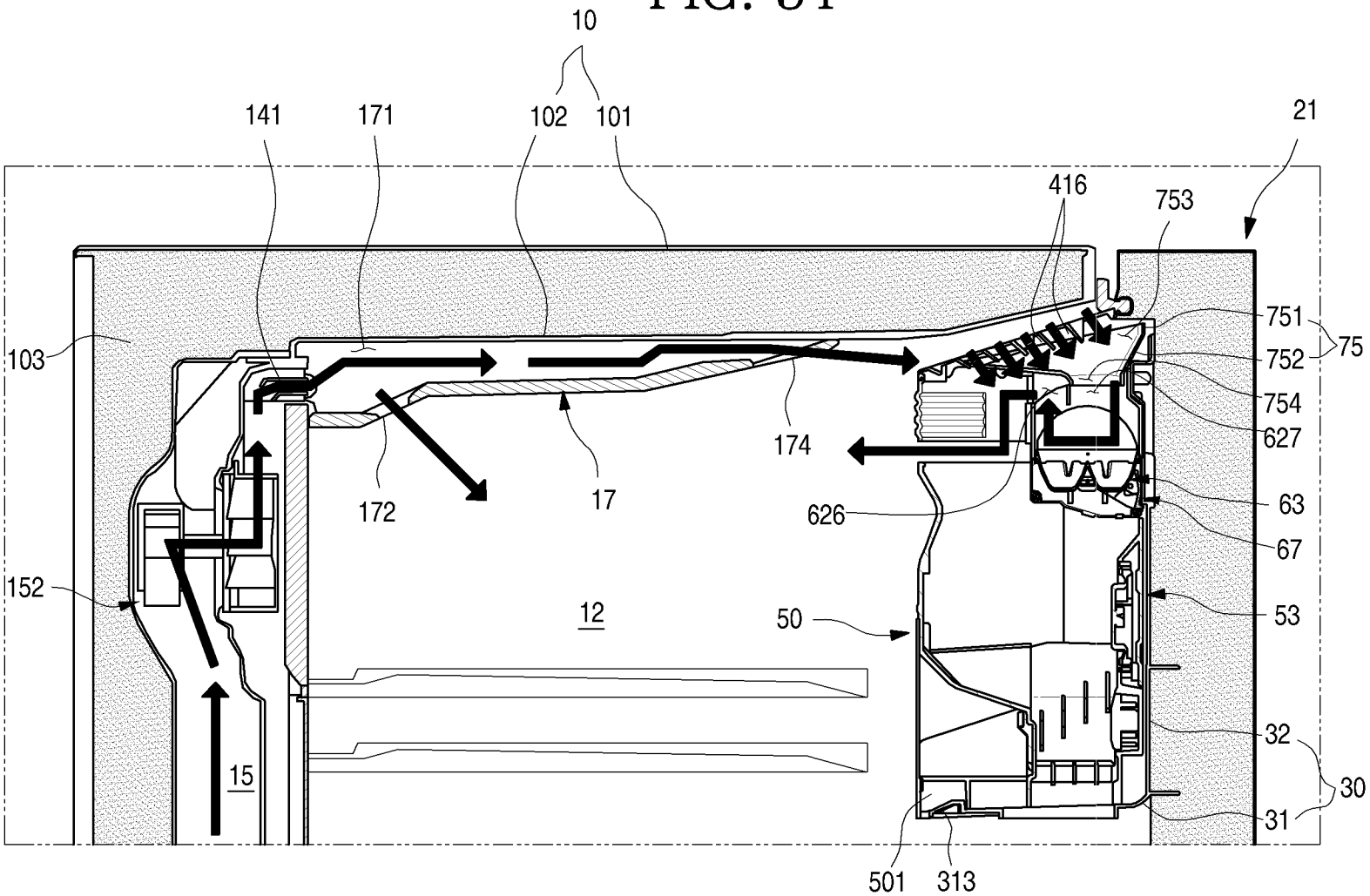
FIG. 34 is a cross-sectional view illustrating a cold air flow state in the refrigerator.

FIG. 34 is a cross-sectional view illustrating a cold air flow state in the refrigerator.

As illustrated in the drawing, a portion of the cold air generated in the evaporator 151 of the heat exchange chamber 15 may be supplied to the ice making unit 24 through the cabinet duct 17 by an operation of the cooling fan 152. When the freezing compartment door 22 is closed, the duct outlet 174 of the cabinet duct 17 may face the cover inflow hole 416 although the duct outlet 174 and the cover inflow hole 416 are spaced apart from each other. Thus, the cold air discharged from the duct outlet 174 may flow to the cover inflow hole 416.

The cold air introduced into the cover inflow hole 416 may be guided into the supply duct 75 through the cover grill 415, particularly, guided to the lower opening 754 of the supply duct 72. Alternatively, a portion of the cold air may be guided to the lower opening 754 along an inner wall of the extension part 751.

The lower opening 754 of the supply duct 75 may be disposed at a position at which the supply duct 75 does not interfere with the ice tray 63 when the ice tray 63 rotates in a state in which the lower opening is accommodated in the front space 627 of the tray accommodation part 62 to discharge the cold air to the front portion of the top surface of the ice tray 63.

The cold air supplied downward to the top surface of the ice tray 63 may flow backward along the top surface of the ice tray 63 and then flow upward in a direction perpendicular to the top surface of the ice tray 63. Thus, the cold air may flow to the outside of the ice maker 60 through the rear space of the tray accommodation part 62.

The cold air introduced into the ice tray 63 may be supplied to a position that is eccentric within the space in which the ice tray 63 is disposed as described above to promote circulation of the cold air above the ice tray 63. Thus, water accommodated in the ice tray 63 may be effectively heat-exchanged to quickly make ice by the cold air continuously supplied.

The air flowing to the outside of the ice tray 63 may smoothly flow to the wide space of the rear side of the ice maker to drop down and then be discharged to the freezing compartment 12 through the cold air discharge hole 241 disposed at a height corresponding to the ice tray 63 without coming into contact with the ices stored in the ice bin 50.

Figure 35:
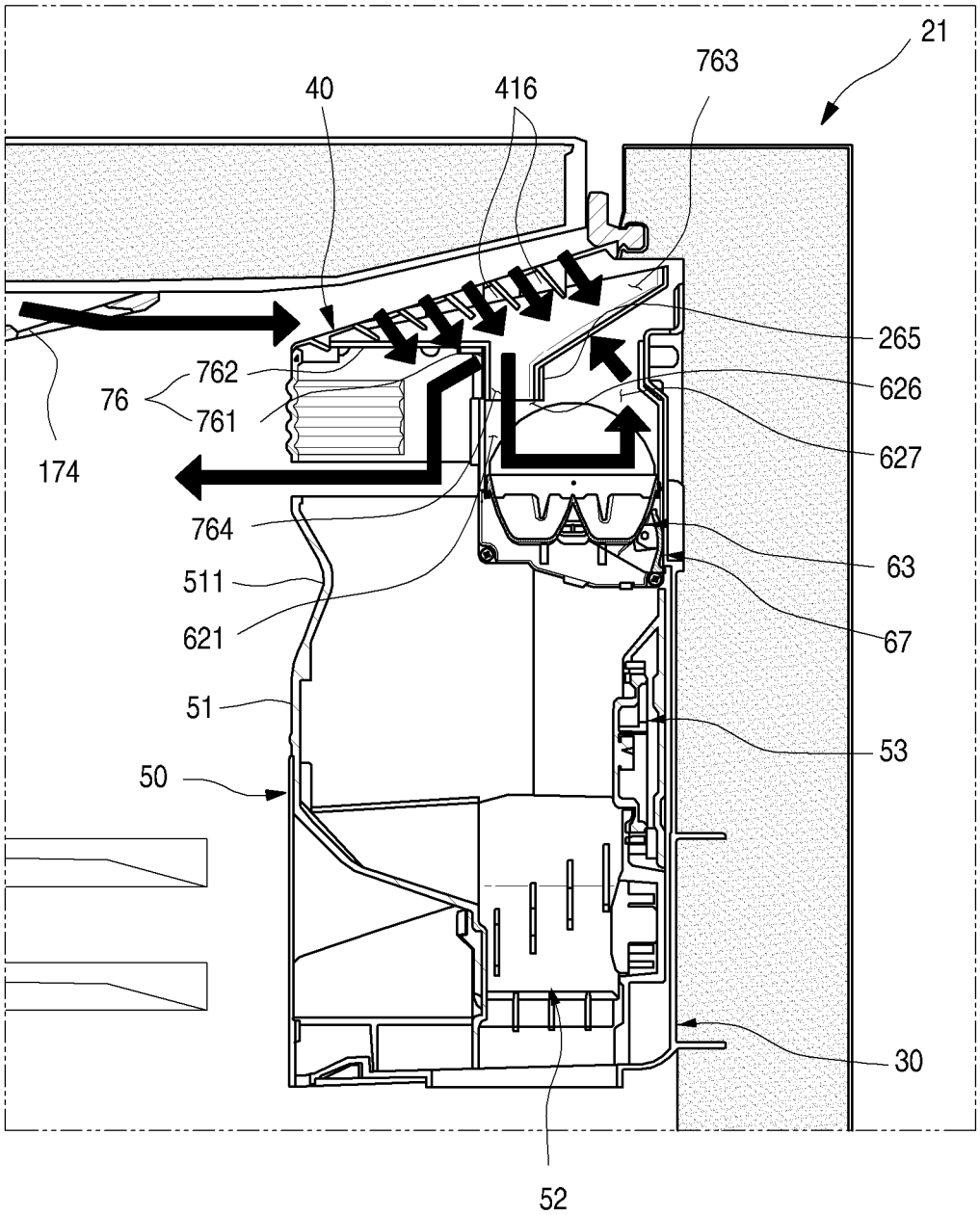
FIG. 35 is a view illustrating a cold air flow state in an ice making unit according to another implementation.

FIG. 35 is a view illustrating a cold air flow state in an ice making unit according to another implementation.

As illustrated in the drawing, an ice making unit 24 according to another implementation may include a supply duct 76 having a different structure, and thus, a flow of the cold air may be different. Other structures except for a structure of a supply duct 76 may be the same as the inner structure of the ice making unit 24, and thus, the same constituent may be expressed by using the same reference numeral, and its detailed description will be omitted.

As illustrated in the drawing, the supply duct 76 connecting the cover inflow hole 416 of the ice cover 40 to the tray accommodation part 62 of the ice maker 60 may be disposed on an upper portion of the ice making unit 24.

A plurality of cover grills 415 may be disposed on the ice cover 40. The cold air discharged through a duct outlet 174 of the cabinet duct 17 may be introduced into the ice making unit 24 by the plurality of cover grills 415.

The supply duct 76 may include an insertion part 761 inserted into the tray accommodation part 62 and an extension part 762 extending to a top surface of the inside of the ice cover 40 to communicate with all the plurality of cover inflow holes 416.

The insertion part 761 may vertically extend in a vertical direction and be inserted into a rear space 626 of a front space 627 and the rear space 626, which are partitioned by the partition part 625 of the tray accommodation part 62. Thus, a lower end of the insertion part 761, i.e., the lower opening 764 may communicate with the rear space 626.

Also, an upper end of the extension part 762, i.e., the upper opening 763 may communicate with the cover inflow hole 411, and a lower end of the extension part 721 may be connected to the upper end of the insertion part 722. The extension part 721 may be inclined or rounded. The cold air supplied into the ice making unit 24 may be concentrically supplied to the rear portion of the top surface of the ice tray 63.

Referring to the cold air flow path of the ice making unit 24 having the above-described structure, the cold air discharged through the duct outlet 162 of the cabinet duct 16 may be introduced into the extension part 762 of the supply duct 76 toward the cover inflow hole 416.

The cold air flowing along an inclined surface of the extension part 762 may be introduced into the tray accommodation part 62 through the insertion part 761. Here, the introduced cold air may be introduced through the rear space 626 to flow toward the rear portion of the ice tray 63 adjacent to the freezing compartment 12.

The cold air discharged toward the rear portion of the ice tray 63 may flow forward along the top surface of the ice tray 63 and then be heat-exchanged with water accommodated in the ice tray 63 to make ice. Also, the cold air flowing along the top surface of the ice tray 63 may flow to the outside of the ice maker 60 through the front space 627 and then be discharged to the outside of the ice making unit 24 through the cold air discharge hole 241 that is opened toward the freezing compartment 12.

Thus, the cold air introduced from the rear side to pass through the top surface of the ice tray 63 and thereby to be heat-exchanged may flow to the outside of the ice maker 60 and be discharged to the outside of the ice making unit 24 at an adequate rate. Thus, the cold air required for making ice may flow at an adequate rate to more effectively perform the ice making process.

Also, the cold air discharge hole may be defined at a height corresponding to that of the top surface of the ice tray 63. Thus, the cold air passing through the ice maker 60 may be easily discharged without flowing in the vertical direction, and also, the cold air discharged from the ice maker 60 may be smoothly discharged through the cold air discharge hole 241 without flowing up to the lower side of the ice maker 60.

Figure 36:
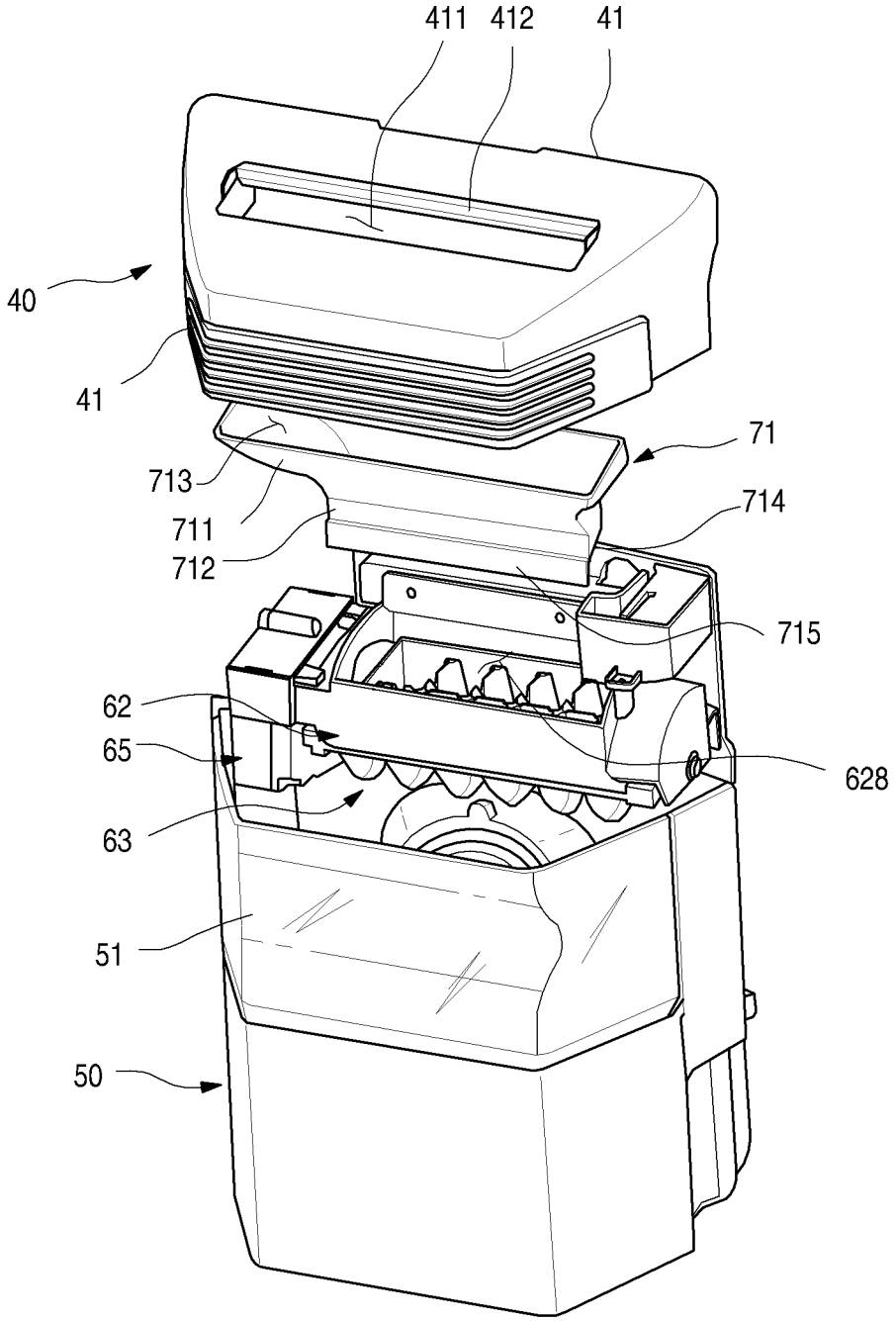
FIG. 36 is an exploded perspective view illustrating an ice making unit of a refrigerator according to another implementation.
Figure 37:
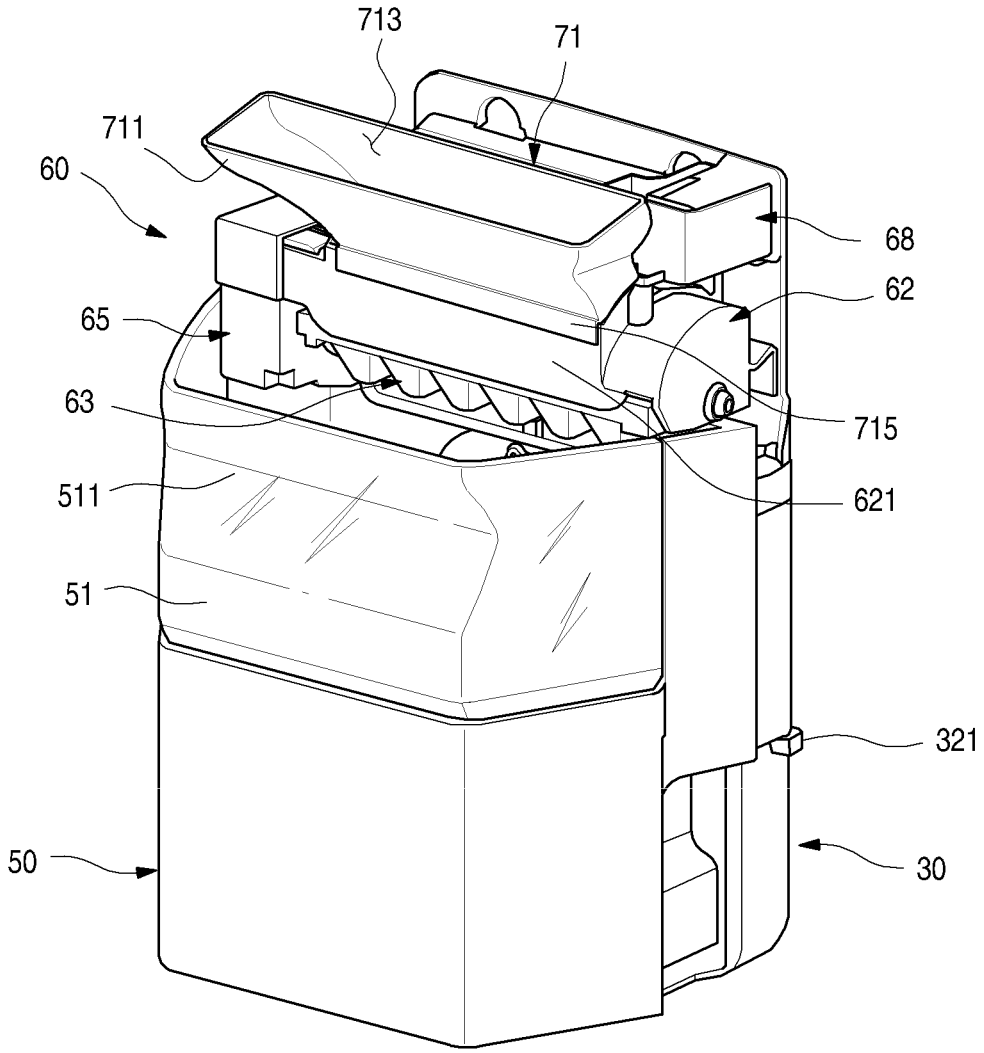
FIG. 37 is an exploded perspective view illustrating a state in which the supply duct of the ice making unit is mounted.
Figure 38:
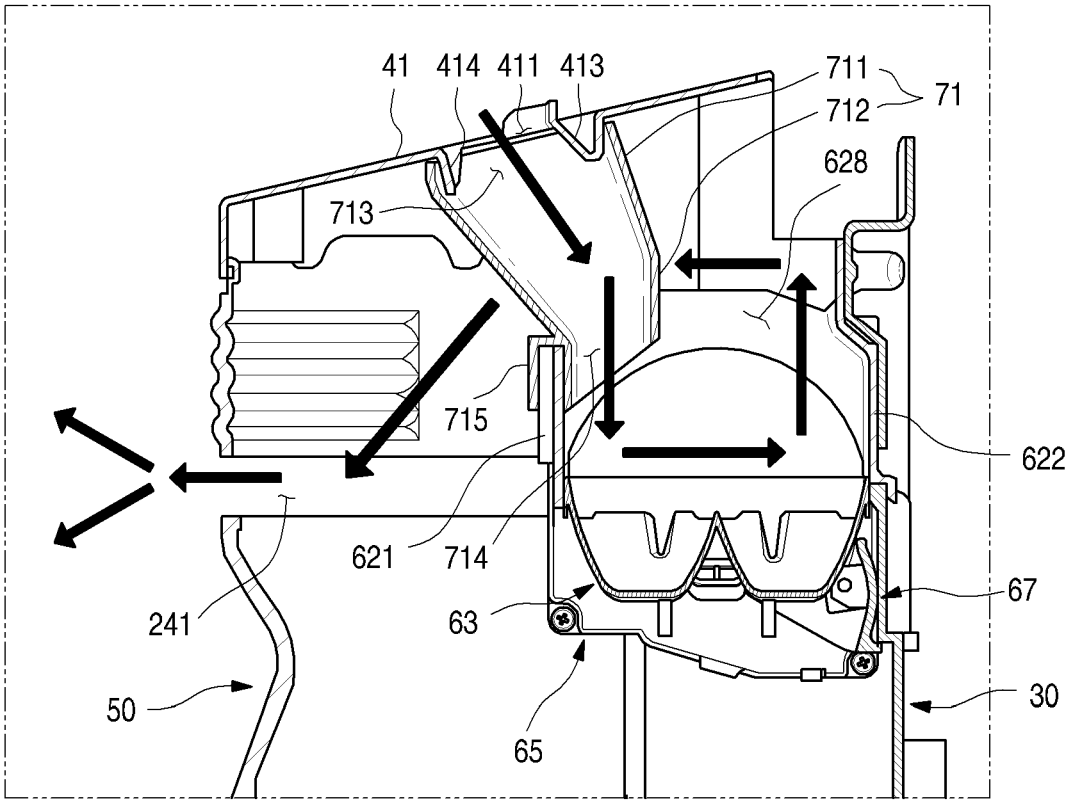
FIG. 38 is a cross-sectional view illustrating a coupling structure of the supply duct and a flow state of cold air.

FIG. 36 is an exploded perspective view illustrating an ice making unit of a refrigerator according to another implementation. Also, FIG. 37 is an exploded perspective view illustrating a state in which the supply duct of the ice making unit is mounted. Also, FIG. 38 is a cross-sectional view illustrating a coupling structure of the supply duct and a flow state of cold air.

As illustrated in the drawings, an ice making unit 24 according to another implementation may include a seating member 30 mounted on the door liner 212, an ice maker 60 mounted on the seating member 30, and an ice bin 50 and may further include an ice cover 40 covering the ice maker 60.

Here, each of the seating member 30, the ice bin 50, and the ice cover 40 may have the same structure as that according to the foregoing implementation and also are the same basic structure except for only a portion of the ice maker 60 and only a portion of the supply duct 71, and thus, a portion of a structure of the ice maker 60 and a structure of the supply duct 71 will be described below.

The ice maker 60 may be disposed above the ice bin 50 and include the mounting bracket 61, an ice tray 63 rotatably mounted on the mounting bracket 61, a driving part for rotating the ice tray 63, and a full ice detection lever 67 rotating by the driving part 65 to detect a full ice state.

The mounting bracket 61 may include a tray accommodation part 62 accommodating the ice tray 63. An accommodation front surface 622 and an accommodation rear surface 621, which respectively define a front surface and a rear surface of the tray accommodation part 62, may extend upward from a front end and a rear end of a top surface of the ice tray 63.

Thus, the tray accommodation part 62 may form a close space above the ice tray 63 to prevent water from overflowing and also provide a space in which heat exchange occurs when the cold air is introduced.

As illustrated in FIG. 36, the partition part 625 described in the foregoing implementations may not be provided in the tray accommodation part 62, and the tray accommodation part 62 may be provided as one space that is not partitioned before the supply duct 71 is mounted.

The supply duct 71 may be configured to connect the cover inflow hole 411 to the inside of the tray accommodation part 62 and have the same structure as that according to the foregoing implementation.

That is, the supply duct 71 may include an insertion part 712 inserted into the tray accommodation part 62 and an extension part 711 extending to the top surface of the ice cover 40 to communicate with the cover inflow hole 411. A lower opening 714 may be defined in an opened bottom surface of the insertion part 712, and an upper opening 713 may be defined in an opened top surface of the extension part 711.

Also, a duct mounting part 715 may be disposed on a rear surface of the insertion part 712. The duct mounting part 715 may lengthily extend in a horizontal direction to protrude from the insertion part 712 and thereby to accommodate an upper end of a tray rear surface of the tray accommodation part 62.

Thus, when the supply duct 71 is inserted into and mounted on the tray accommodation part 62, the duct mounting part 715 may be seated on the accommodation part rear surface 621. Thus, the supply duct 71 may be fixed and mounted on the mounting bracket 61 due to the above-described structure.

Also, a horizontal length of the insertion part 712 may correspond to that of the tray accommodation part 62, and the cold air may be supplied to an entire surface of the ice tray in the horizontal direction. Also, as the insertion part 712 is inserted into the tray accommodation part 62, an upper space of the tray accommodation part 62 may be partitioned into an inner space of the insertion part, i.e., the lower opening 714 and an outer space 628 of the insertion part. Here, the inner space of the insertion part 712 may correspond to the rear space 626 according to the foregoing implementation, and the outer space of the insertion part 712 may correspond to the front space 627 according to the foregoing implementation.

Thus, the cold air introduced into the cover inflow hole 411 via the duct outlet 162 of the cabinet duct 16 may flow along the supply duct 71 and then be supplied to the eccentric rear portion of the ice tray 63 through the lower opening 714. Also, the cold air supplied to the rear portion of the ice tray may flow to the outside of the ice maker 60 through the partitioned space 628, which is partitioned by the mounting of the insertion part 712, via the top surface of the ice tray 63.

Also, the cold air flowing to the outside of the ice maker 60 may be discharged to the outside of the ice making unit 24 through the cold air discharge hole 241 provided at a height corresponding to that of the ice tray 63.

A circulation structure in which new cold air is always introduced into and discharged from the ice maker 60 by the independent passage and inlet/outlet holes provided in the ice maker 60 may be provided to more efficiently make ices.

In addition to the foregoing implementation, various implementations may be exemplified.

According to another implementation, the supply duct and the ice cover may be integrated with each other. Another implementation are the same as the foregoing implementation except for a coupling structure of the supply duct and the ice cover. Thus, the same part will be designated by the same reference numeral and detailed descriptions thereof will be omitted.

Figure 39:
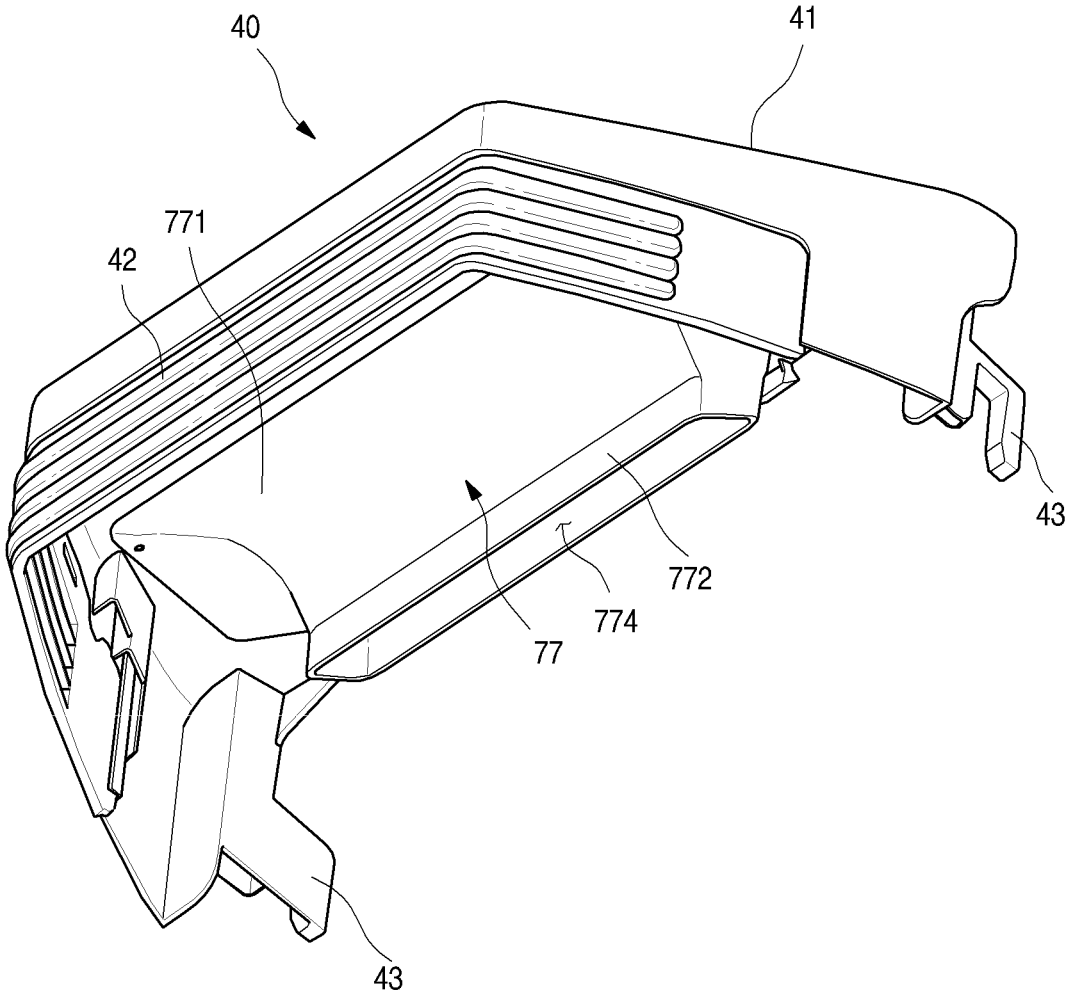
FIG. 39 is a bottom perspective view of an ice cover according to another implementation.

FIG. 39 is a bottom perspective view of an ice cover according to another implementation.

As illustrated in the drawing, the ice cover 40 according to another implementation may have an inclined top surface like the foregoing implementation, and a cover inflow hole 411 and an inflow hole guide 412 may be defined in the inclined top surface 41. Also, a cover deco 42 may be disposed on portions of front and side surfaces of the ice cover 40.

A cover coupling part 43 may be disposed on a rear end of each of both left and right surfaces of the ice cover 40 and detachably mounted on the door liner 121. A cover protrusion 415 may be further disposed on a rear end of the ice cover 40 and coupled to the seating member 30.

A supply duct 77 for guiding the cold air introduced into the cover inflow hole 411 to a top surface of the ice maker 60 may be further disposed on an inner surface of the ice cover 40. The supply duct 77 may have the same structure as that according to the foregoing implementation and include an extension part 771 and an insertion part 772. The extension part 771 may be integrated with the ice cover 40.

That is, a circumferential surface of the cover inflow hole 411 may extend downward to form the extension part 771, and thus, the cover inflow hole 411 may become a substantial upper opening of the supply duct 73. Thus, the cold air introduced through the cover inflow hole 411 may be substantially introduced through the top surface of the supply duct 77.

The insertion part 772 may vertically extend downward from a lower end of the extension part 771 and be inserted into an upper portion of the ice maker 60, particularly, the front space 627 defined in the tray accommodation part 62 of the mounting bracket 61.

Thus, the cold air introduced to the top surface of the ice tray 63 through a lower end of the insertion part 772, i.e., the lower opening 774 may be introduced into the eccentric front portion of the ice tray 63 and then be discharged through the rear space 626 of the rear portion of the ice tray 63 via the top surface of the ice tray 63.

The supply duct 77 may be integrated with the ice cover 40 when being molded. Thus, the supply duct 77 may be selectively coupled to the ice maker 60 according to detachment of the ice cover 40. That is, when the ice cover 40 is mounted, the insertion part 772 of the supply duct 77 may form a passage inserted into the front space 627 to supply the cold air.

In addition to the foregoing implementation, various implementations may be exemplified.

According to another implementation, the supply duct and the mounting bracket may be integrated with each other. According to another implementation, other constituents except for structures of the supply duct and the mounting bracket may be the same as those according to the foregoing implementation. Thus, the same part will be designated by the same reference numeral and detailed descriptions thereof will be omitted.

Figure 40:
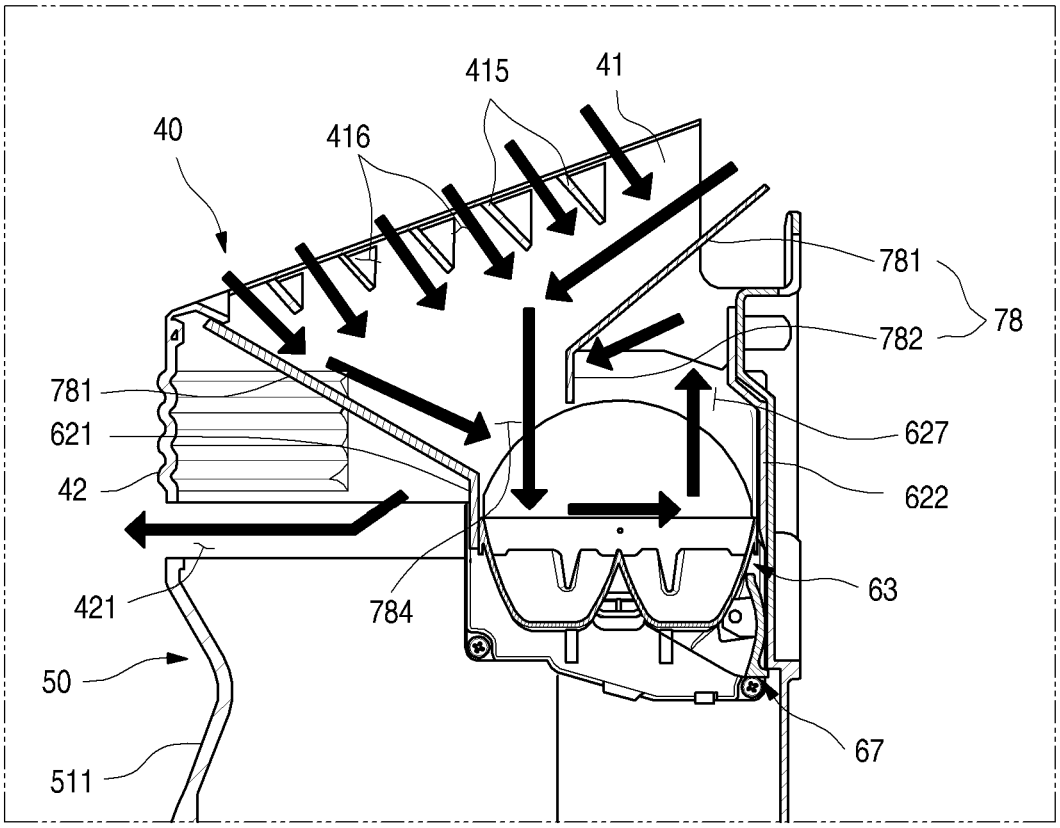
FIG. 40 is a cross-sectional view illustrating an ice making unit of a refrigerator according another implementation.

FIG. 40 is a cross-sectional view illustrating an ice making unit of a refrigerator according another implementation.

As illustrated in the drawings, an ice making unit 24 according to another implementation may include a seating member 30 mounted on the freezing compartment door 21, an ice maker 60 and an ice bin 50, which are fixed to the seating member 30, and an ice cover 40 covering the ice maker 60 and the supply duct 78 for supplying cold air to the ice maker 60.

The seating member 30, the ice bin 50, and the ice cover 40 may have the same structure as those according to the foregoing implementation. Also, the ice maker 60 may include a mounting bracket 61, an ice tray 63, a driving part 65, and a full ice detection member 67. Other constituents except for the mounting bracket 61 are the same as those according to the foregoing implementation.

The mounting bracket 61 may include a tray accommodation part 62 accommodating the ice tray 63. Also, the supply duct 78 may be integrated with an upper end of the tray accommodation part 62. That is, in this implementation, a portion that is called the supply duct 78 may be a portion of the mounting bracket 61.

The mounting bracket 61 may include a tray accommodation part 62 accommodating the ice tray 63. The tray accommodation part 62 may include an accommodation part front surface 622 and an accommodation part rear surface 621, which extend upward from the top surface of the ice tray 63. The accommodation part front surface 622 may come into contact with a front end of the ice tray 63 to extend upward. Also, the accommodation part rear surface 621 may come into contact with a rear end of the ice tray 63 to extend upward.

Also, a supply duct 78 may be disposed on the mounting bracket 61. The supply duct 78 may be configured to supply the cold air introduced into the cover inflow hole 411 of the ice cover 40 to the top surface of the ice tray 63 and be integrated with the mounting bracket 61.

The supply duct 78 may include an insertion part 782 and an extension part 781. The insertion part 782 may be disposed in the tray accommodation part 62 to partition the tray accommodation part 62 in front and rear directions. Thus, a space defined by the insertion part 782 and the accommodation part rear surface 621 may be defined as a rear space, i.e., a lower opening 784 of the supply duct 78.

Also, the extension part 781 may extend from an upper end of the insertion part 782, i.e., may extend to be inclined from an upper end of the accommodation part rear surface 621. Both ends of the extension part 781 may extend up to a bottom surface of the ice cover 40 to define an upper opening 783 accommodating the entire cover inflow hole 416 of the ice cover 40.

Thus, the cold air introduced through the upper opening 783 via the cover inflow hole 411 may flow to the insertion part 782 along the extension part 781 and then be discharged into the rear space of the ice tray 63 through the lower opening 784 defined in the lower end of the insertion part 782.

The cold air supplied through the lower opening of the rear side of the ice tray 63 may move forward along the top surface of the ice tray 63 to flow to the outside of the ice maker 60 through the front side of the lower opening. Then, the cold air may be discharged into the freezing compartment 12 through the cold air discharge hole 241 of the ice making unit 24.

Since the upper space of the ice tray 63 is substantially partitioned by the insertion part 782, the partition part 625 described in the foregoing implementation may not be provided, and the insertion part 782 may become at least a portion of the partition part 625.

That is, the supply duct 78 and the mounting bracket 61 may be integrated with each other. The insertion part 782 may partition the tray accommodation part 62 in front and rear directions to form a passage for eccentric supply and circulation of the cold air. Also, the extension part 781 may be configured to allow the cold air introduced through the cover inflow hole 416 to flow to the insertion part 782 in its entirety and thereby to flow to the ice tray 63.

The supply duct 78 may be integrated with the mounting bracket 61. Thus, when the ice cover 40 is separated, the supply duct 78 may be exposed in a state in which the supply duct 78 is integrated with the ice maker 60.

In addition to the foregoing implementation, various implementations may be exemplified.

According to another implementation, a cold air inflow hole and a supply duct may be disposed bias to one side of left and right and both sides on the top surface of the ice cover. Another implementation is the same as the foregoing implementation except for structures of the ice cover and the supply duct. Thus, the same part will be designated by the same reference numeral and detailed descriptions thereof will be omitted.

Figure 41:
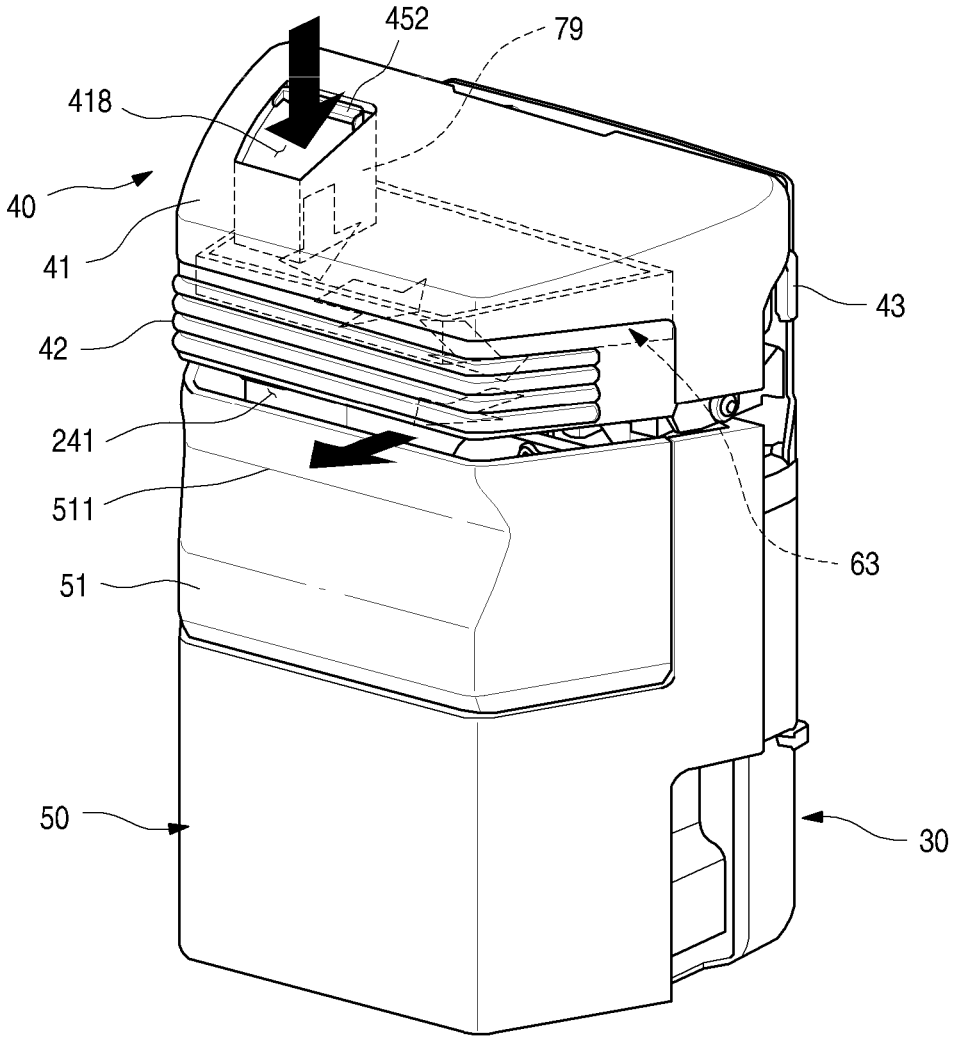
FIG. 41 is a perspective view of an ice making unit according to another implementation.

FIG. 41 is a perspective view of an ice making unit according to another implementation.

As illustrated in the drawing, a cover deco 42 may be disposed on a circumference of front and side surfaces of the ice cover 40 according to another implementation. Also, a cover coupling part 43 may be disposed on a rear end of each of left and right surfaces of the ice cover 40 and detachably mounted on the door liner 212.

Also, the ice cover 40 may have an inclined top surface 41 like the foregoing implementation, and a cover inflow hole 418 may be defined in the inclined top surface 41. The cover inflow hole 418 may be defined at a position that is biased to the left side of the top surface of the ice cover 40. Alternatively, the cover inflow hole 418 may be defined in one side of both left and right surfaces.

The cover inflow hole 418 may be defined in a left end (when viewed in FIG. 41) and communicate with the supply duct 79 provided in the ice cover 40. To more smoothly introduce the cold air introduced into the cover inflow hole 418, the inflow hole guide 411 may be disposed on portions of a front end and both left and right ends of the cover inflow hole 418. Thus, air introduced into the cover inflow hole 418 may be guided to be introduced into the cover inflow hole 418 by the inflow hole guide 411 without being lost to the outside.

The supply duct 79 may have an opened top surface communicating with the cover inflow hole and an opened bottom surface extending to left and right top surfaces of the left and right sides of the ice tray 63. Thus, the cold air introduced through the duct outlet 162 may be supplied to a position that is eccentric to one side of the ice tray 63.

The air discharged from the duct outlet 162 may be introduced into the ice making unit 24 through the cover inflow hole 418. Here, the cold air introduced into the ice making unit 24 may be supplied to the left end of both the left and right sides of the top surface of the ice tray 63 by the position of the cover inflow hole 418 and the position of the opened bottom surface of the supply duct 79.

The cold air supplied to the left end of the ice tray 63 may flow along the ice maker 60 to move up to the right end of the ice maker 60. While the cold air flows with directionality along the top surface of the ice maker 60, the cold air may be heat-exchanged to promote the ice making.

Also, the cold air introduced into the left end of the ice tray 63 may be discharged through the right end of the ice tray 63 via the top surface of the ice tray 63. That is, the cold air may be continuously supplied and discharged while flowing from the left side to the right side with respect to the ice tray 63, and thus, the cold air may be circulated.

Although not shown in detail, the upper space of the ice tray 63 may be partitioned into left and right sides, or an inflow hole and an outflow hole may be defined in both left and right sides to effectively circulate the cold air.

The cold air flowing to the outside of the ice maker 60 through the right side of the ice tray 63 may be discharged into the freezing compartment 12 through the cold air discharge hole 241 provided at a height corresponding to that of the top surface of the ice tray 63.

The cold air discharge hole 241 may be defined between the ice cover 40 and the ice bin 50. Also, the cold air within the ice making unit 24 may be discharged at a position that is substantially biased to the right side of the cold air discharge hole 241 on the whole to more effectively circulate and discharge the cold air.

Also, the cold air passing through the ice maker 60 may not flow to the lower side of the ice bin 50 but flow into the freezing compartment 12 through the cold air discharge hole 241. Thus, surfaces of ices within the ice bin 50 may be prevented from being vaporized to be frozen with respect to each other.

In addition to the foregoing implementation, various implementations may be exemplified.

According to another implementation, a cover inflow hole and a cover outflow hole may be defined in a top surface of the ice cover. Another implementation is the same as the foregoing implementation except for a structure of the ice cover. Thus, the same part will be designated by the same reference numeral, and detailed descriptions thereof will be omitted.

Figure 42:
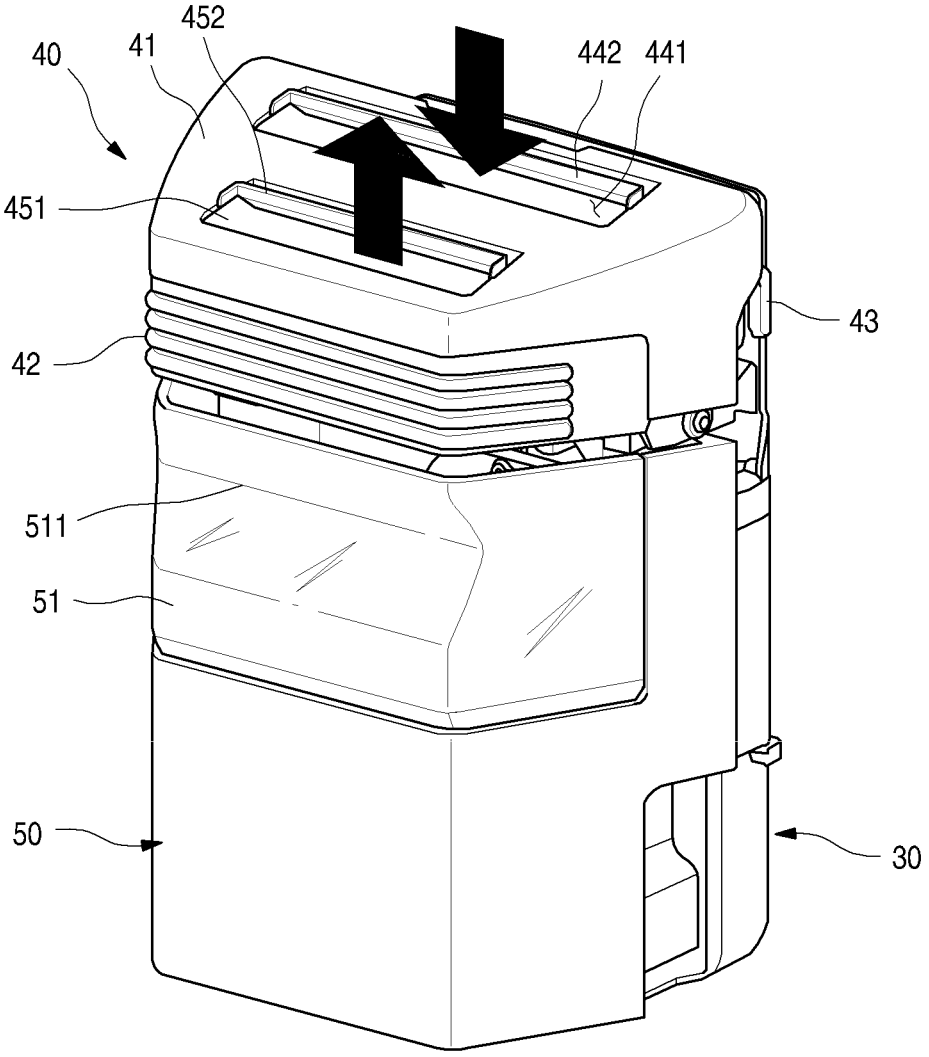
FIG. 42 is a perspective view of an optical member according to another implementation.
Figure 43:
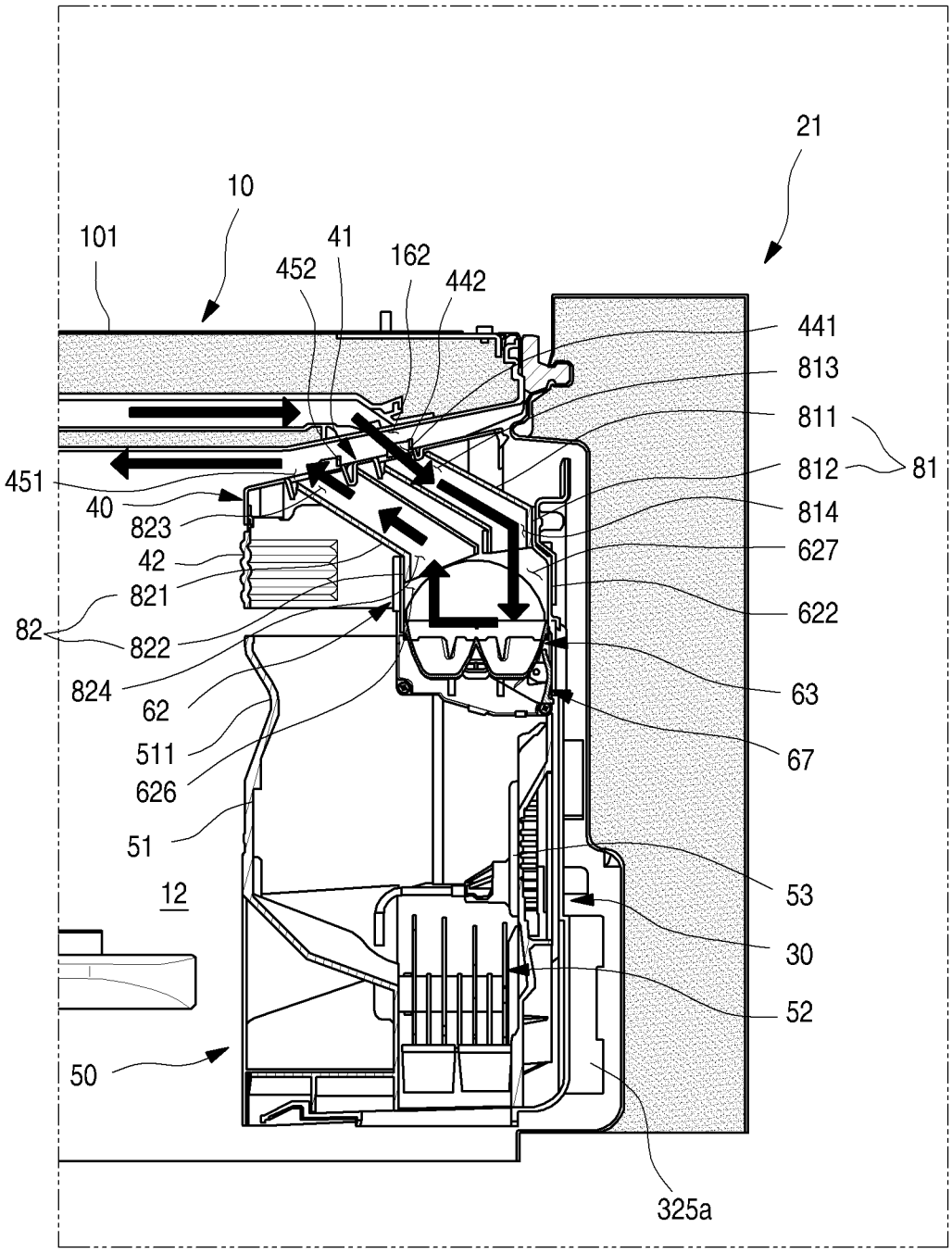
FIG. 43 is a cross-sectional view illustrating a cold air flow state in the ice making unit.

FIG. 42 is a perspective view of an ice making unit according to another implementation. FIG. 43 is a cross-sectional view illustrating a cold air flow state in the ice making unit.

As illustrated in the drawing, a cover deco 42 may be disposed on a circumference of front and side surfaces of the ice cover 40 according to another implementation. Also, a cover coupling part 43 may be disposed on a rear end of each of left and right surfaces of the ice cover 40 and detachably mounted on the door liner 121.

Also, the ice cover 40 may have an inclined top surface 41 like the foregoing implementation, and a cover inflow hole 441 and a cover outflow hole 451 may be defined in the inclined top surface 441. The cover inflow hole 441 may be defined in a further front side than the cover outflow hole 451 to communicate with the supply duct 81 provided in the ice cover 40.

Since the cover inflow hole 441 is defined in the front side, the cold air discharged from the duct outlet 612 may be introduced into the cover inflow hole 441 with a gentle inclination to allow air within the supply duct 81 to smoothly flow.

Also, to more smoothly introduce the cold air introduced into the cover inflow hole 441, the inflow hole guide 442 may be disposed on portions of a front end and both left and right ends of the cover inflow hole 441. Thus, the air discharged from the duct outlet 612 may be guided to be introduced into the cover inflow hole 441 by the inflow hole guide 442 without being lost to the outside.

A supply duct 81 may be disposed below the cover inflow hole 441. The supply duct 81 may include a supply insertion part 812 inserted into a front space 627 of the tray accommodation part 62 and a supply extension part 811 extending from the supply insertion part 812 to the cover inflow hole 441. Thus, the cold air introduced through the cover inflow hole 441 may be supplied into the eccentric front portion of the ice tray 63 by the supply duct 81.

The cover outflow hole 451 may be opened at a further rear side than the cover inflow hole 441 and defined at a position that is closer to the inside of the refrigerating compartment than the cover inflow hole to effectively discharge the cold air.

Also, to prevent the discharged air from being re-introduced into the cover inflow hole 441, the discharge hole guide 452 may extend upward from a portion of a front end and both left and right ends of the cover outflow hole 451.

The cover outflow hole 451 may communicate with the discharge duct 82 to guide the discharge of the cold air heat-exchanged in the ice tray 63.

The discharge duct 82 may include a discharge insertion part 822 inserted into the rear space 627 of the tray accommodation part 62 and a discharge extension part 821 extending from the discharge insertion part 822 to communicate with the cover outflow hole 451. Here, the opened lower end of the discharge insertion part 822 may be disposed at a position that is eccentric to a front portion of the ice tray 63.

As described above, a space of the tray accommodation part 62 above the ice tray 63 may have a structure that is covered by the supply duct 81 and the opened lower end of the discharge duct 82 to allow the cold air to be circulated.

In detail, the cold air discharged through the duct outlet 162 may be introduced into the ice making unit through the cover inflow hole 441. Also, the cold air may be supplied to the entire top surface of the ice tray 63 through the supply duct 81 and be heat-exchanged for making ice while passing through the top surface of the ice tray 63.

Also, the cold air flowing to the rear portion of the top surface of the ice tray 63 may be guided to the cover outflow hole 451 through the discharge duct 82 and then be discharged to the outside of the ice making unit 24, i.e., into the freezing compartment 12 through the cover outflow hole 451.

As described above, all the cold air supplied to the ice maker 60 may successively pass through the supply duct 81, the ice tray 63, and the discharge duct 82 to have directionality so that the cold air is effectively circulated to perform the ice making process.

Also, the cold air introduced into the ice bin 50 may be minimized by the cold air flowing through the supply duct 81 and the discharge duct 82. Thus, the surfaces of the ices stored in the ice bin 50 may be prevented from being vaporized to be melted and bonded to each other.

An ice maker and a supply duct may be further provided in a refrigerating compartment region in addition to the freezing compartment region. Hereinafter, an example in which the ice maker and the supply duct are provided in the refrigerating compartment region will be described.

Figure 44:
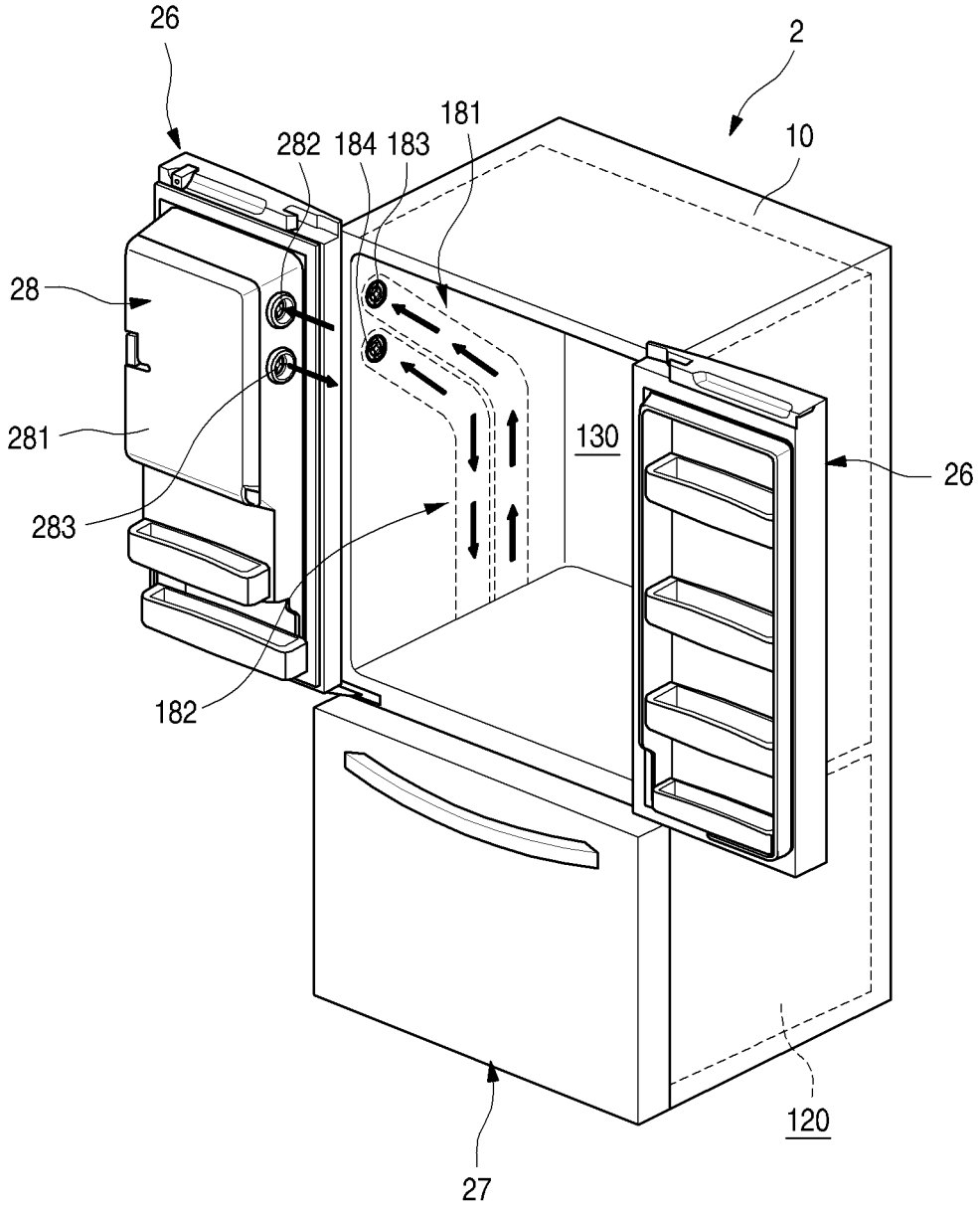
FIG. 44 is a perspective view of a refrigerator with a door opened according another implementation.

FIG. 44 is a perspective view of a refrigerator with a door opened according another implementation.

As illustrated in the drawing, a refrigerator 2 according to another implementation may include a cabinet 10 in which a refrigerating compartment 130 is provided at an upper portion, and a freezing compartment 120 is provided at a lower portion. Also, an evaporator may be provided in the freezing compartment, and a storage space within the refrigerator 2 may be cooled by cold air generated in the evaporator.

A refrigerating compartment door 26 and a freezing compartment door 27 may be disposed on a front surface of the cabinet 10. The refrigerating compartment door 26 and the freezing compartment door 27 may be independently opened and closed. Also, the refrigerating compartment door 26 may be rotatably provided in a pair of left and right sides. The refrigerating compartment door 26 may rotate to independently open and close a portion of the refrigerating compartment.

An ice making chamber 28 may be provided in a rear surface of the refrigerating compartment door 26 of one side (a left side in FIG. 44) of the pair of refrigerating compartment doors. The ice making chamber 28 may be provided in the form of an insulation space that is independent from the refrigerating compartment 130.

Also, the refrigerating compartment 130 may include ice making ducts 181 and 182 communicating with the inside of the ice making chamber 28 and a heat exchange space in which the freezing compartment and/or the evaporator are/is provided to supply cold air for cooling the ice making chamber 28.

The ice making ducts 181 and 182 may be buried in a wall of the refrigerating compartment 130. A duct outlet 183 and a duct inlet 184 may be exposed at positions corresponding to the wall of one side of the ice making chamber 28.

The ice making ducts 181 and 182 may include a first duct 181 for supplying the cold air to the ice making chamber 28 and a second duct 182 for collecting air heat-exchanged in the ice making chamber 28 into the freezing compartment 120 or the heat exchange space. The duct outlet 183 may be provided in the first duct 181, and the duct inlet 184 may be provided in the second duct 182.

When the refrigerating compartment door 26 is closed, the wall of one side of the ice making chamber 28 may come into contact with a wall of one side (a left side in FIG. 44) of the inside of the refrigerating compartment 130. Also, an ice making chamber inflow hole 282 and an ice making chamber outflow hole 283 may be vertically defined in the wall of one side of the ice making chamber 28. The ice making chamber inflow hole 282 may communicate with the duct outlet 183, and the ice making chamber outflow hole 283 may communicate with the duct inflow 184.

Thus, the cold air within the freezing compartment 120 or the heat exchange space may be supplied into the ice making chamber 28 through the first duct 181 to supply the cold air for making ice. Also, the air heat-exchanged in the ice making chamber 28 may be collected through the second duct 182. As described above, the ice making process may be performed in the ice making chamber through the circulation of the cold air.

Figure 45:
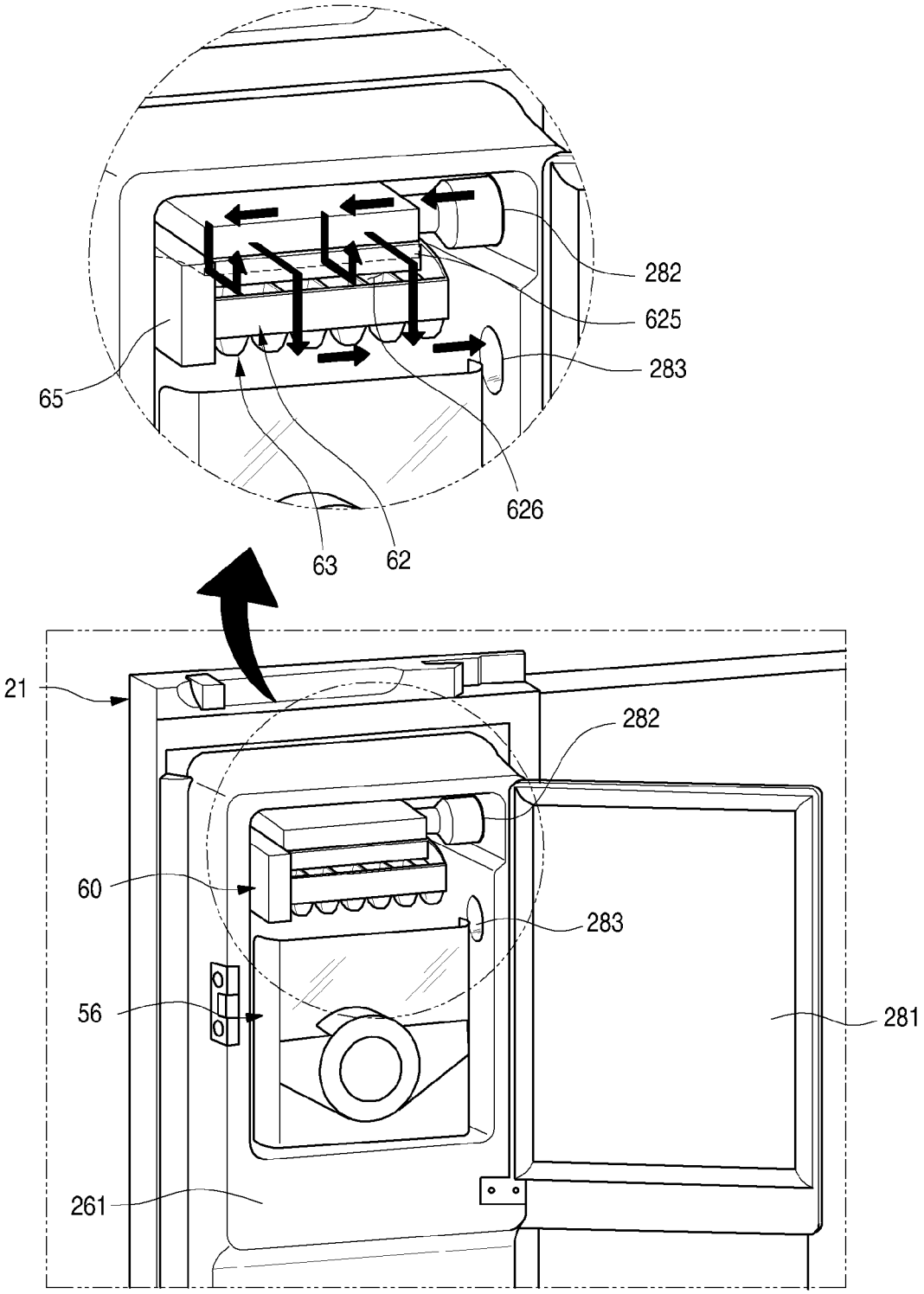
FIG. 45 is a partial perspective view illustrating an example of the inside of an ice making chamber of the refrigerator.
Figure 46:
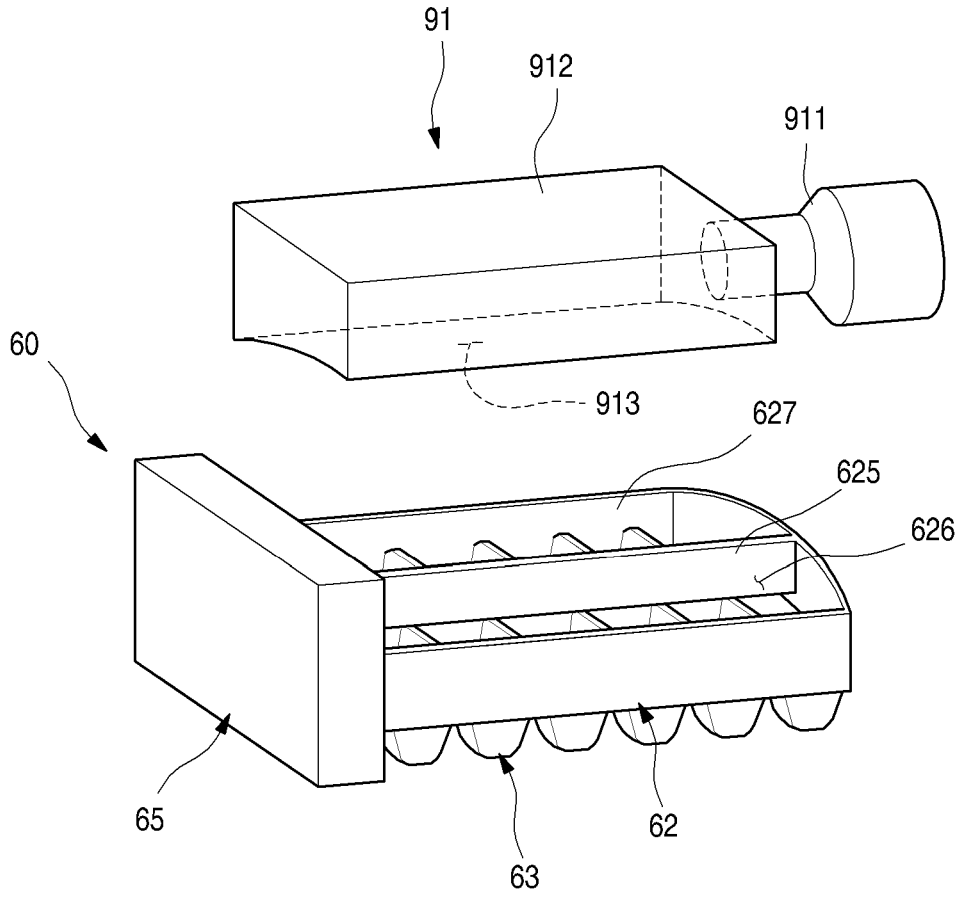
FIG. 46 is an exploded view illustrating a coupling structure of the ice maker and the supply duct in the ice making chamber.

FIG. 45 is a partial perspective view illustrating an example of the inside of an ice making chamber of the refrigerator. Also, FIG. 46 is an exploded view illustrating a coupling structure of the ice maker and the supply duct in the ice making chamber.

As illustrated in the drawing, the ice making chamber 28 may be formed by recessing a door liner 261 defining the rear surface of the refrigerating compartment door 26 and be opened and closed by an ice making chamber door 281. Also, an ice maker 60 and an ice bin 50 may be provided in the ice making chamber 28 to make and store ice. Also, the ice making chamber 28 may communicate with a dispenser provided in a front surface of the refrigerating compartment door 26, and the dispenser may be manipulated to dispense the stored ice.

The ice maker 60 for making ice may be disposed in an upper side of the ice making chamber 28, and the ice bin 50 in which the ice dropping from the ice maker 60 is stored may be provided below the ice maker 60.

The ice making chamber inflow hole 282 may be defined in the sidewall of the ice making chamber 28 corresponding to the ice maker 60, and the ice making chamber outflow hole 283 may be defined below the ice maker 60. The ice making chamber outflow hole 283 may be defined between the ice maker 60 and the ice bin 50. Thus, all air passing through the ice maker 60 may not be introduced into the ice bin 50, and most of air may be discharged through the ice making chamber outflow hole 283. That is, a large amount of cold air may not be directly introduced into the ice bin 50. Thus, the inside of the ice bin 50 may be indirectly cooled to prevent the ices from being bonded to each other by being vaporized to be frozen with respect to each other.

A detailed structure of the ice maker 60 may be the same as the foregoing implementations and include a driving part 65, an ice tray 63, and a tray accommodation part 62 on which the ice tray 63 is mounted.

A partition part 625 may be provided in the tray accommodation part 62 to partition the upper space of the ice tray into front and rear spaces. Thus, the inside of the tray accommodation part 62 may be divided into a front space 627 and a rear space 626 by the partition part 625.

A supply duct 91 may be provided above the ice maker 60. The supply duct 91 may be configured to connect the ice making chamber inflow hole 282 to the upper space of the tray accommodation part. All the cold air introduced into the ice making inflow hole 282 may be supplied to the top surface of the ice tray 63.

The supply duct 91 may include an insertion part 912 inserted into the tray accommodation part 62 and an extension part 911 extending from one side of the insertion part 912 to the ice making chamber inflow hole 282.

The insertion part 912 may have a size corresponding to that of the front space of the tray accommodation part 62 to supply the cold air to the entire front portion of the top surface of the ice tray through the lower opening 913.

A lower end of the insertion part 912 may extend to be inserted into the front space 627. The lower opening 913 of the lower end of the insertion part 912 may be inclined or rounded so that the insertion part 912 does not interfere with the ice tray 63 when the ice tray 63 rotates to transfer ices.

The extension part 911 may be disposed on a side surface of the insertion part 912. The extension part 911 may be configured to connect the insertion part 912 to the ice making chamber inflow hole 282. The extension part 911 may have both ends that are opened to communicate with the insertion part 912 and the ice making chamber inflow hole 282. Thus, all the cold air introduced through the ice making chamber inflow hole 282 may be discharged to the top surface of the ice tray 63 through the insertion part 912.

The front space 627 into which the insertion part 912 is inserted may be disposed eccentric to the front side with respect to a center of the ice tray 63. Also, the front space 627 may have a size less than that of the rear space 626 so that the air introduced into the front space 627 smoothly flows to the rear space 626 via the top surface of the ice tray 63.

The cold air passing through the rear space 626 may flow over the rear surface of the tray accommodation part 62 to flow the outside of the ice maker 60. The cold air flowing to the outside of the ice maker 60 may drop down to flow to the outside of the ice making chamber 28 through the ice making chamber inflow hole 283 defined below the ice maker 60.

As described above, the cold air supplied by the supply duct 91 may flow from the front side to the rear side on the top surface of the ice tray 63 so that the cold air is actively circulated in the ice maker 60. Thus, the ice making in the ice tray 63 may be promoted.

As necessary, the supply duct 91 may not be provided in the front space 627 but provided in the rear space 626.

The ice maker 60 and the supply duct 91 may have different structures. Hereinafter, structures of the ice maker and the supply duct according to another implementation will be described. This implementation is same as the abovementioned implementations except for the ice maker and the supply duct, and thus, the same constituent as those according to the foregoing implementations may be denoted by the same reference numeral and its detailed description will be omitted.

Figure 47:
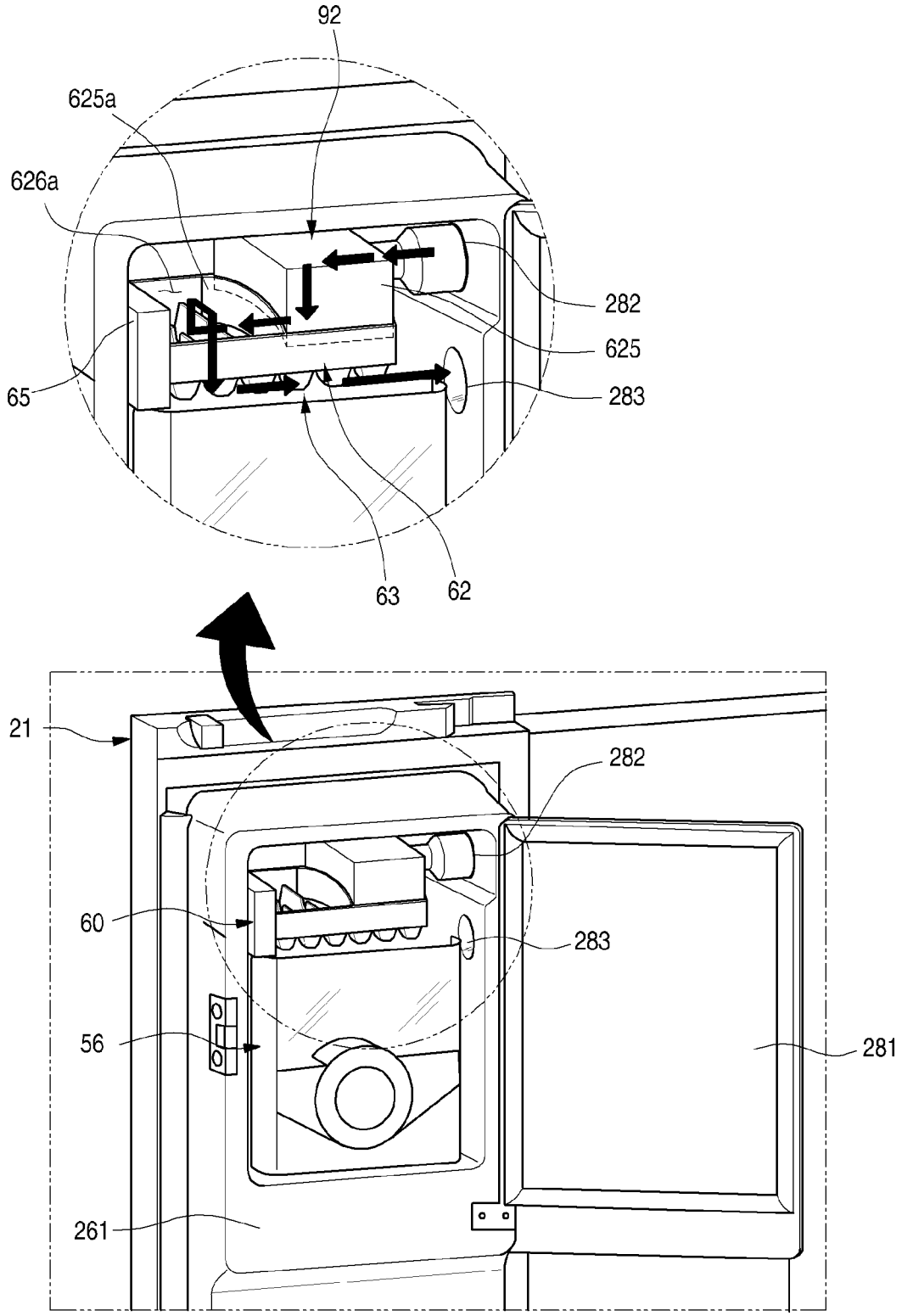
FIG. 47 is a partial perspective view illustrating another example of the inside of an ice making chamber of the refrigerator.
Figure 48:
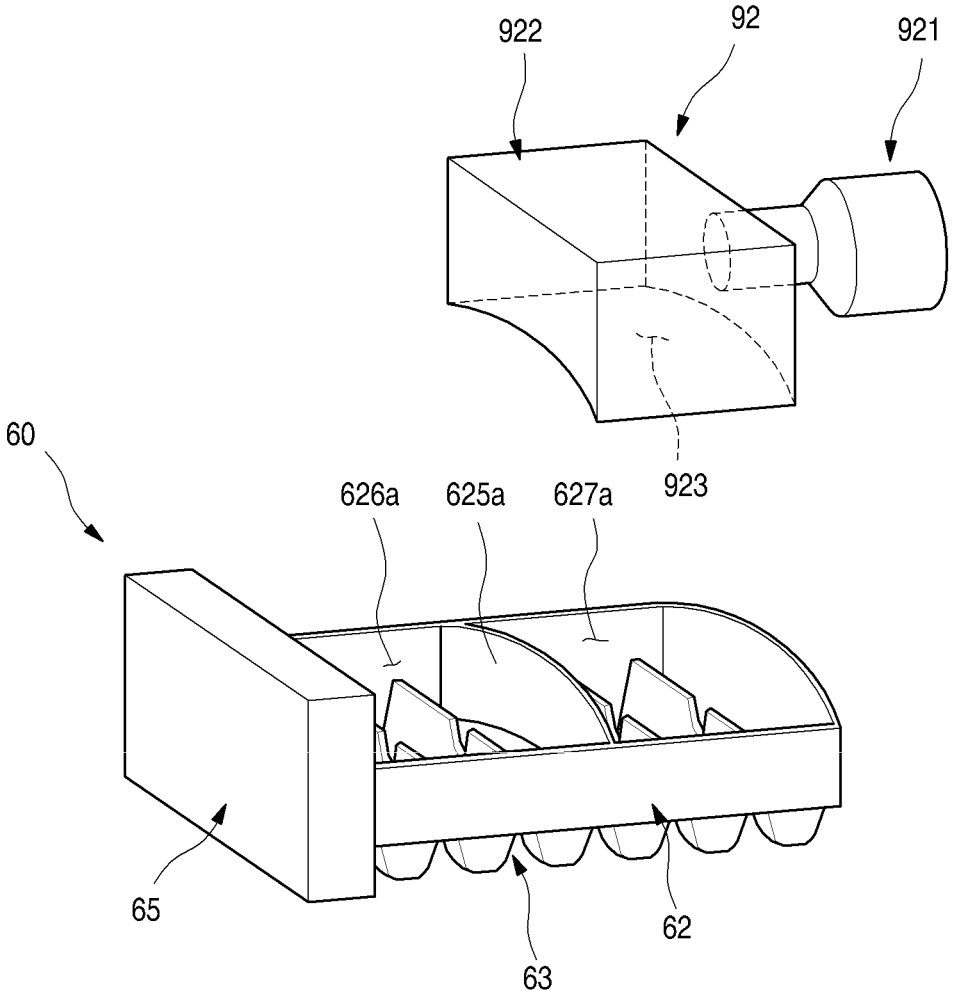
FIG. 48 is an exploded view illustrating a coupling structure of the ice maker and the supply duct in the ice making chamber.

FIG. 47 is a partial perspective view illustrating another example of the inside of an ice making chamber of the refrigerator. Also, FIG. 48 is an exploded view illustrating a coupling structure of the ice maker and the supply duct in the ice making chamber.

As illustrated in the drawing, the ice maker 60 according to another implementation may include a driving part 65, an ice tray 63, and a tray accommodation part 62 on which the ice tray 63 is mounted.

A partition part 625*a* may be provided in the tray accommodation part 62 to partition the upper space of the ice tray 63 into front and rear spaces. Thus, a first space 627*a* and a second space 626*a* may be defined in parallel to each other inside the tray accommodation part 62 by the partition part 625*a*.

A supply duct 92 may be provided above the ice maker 60. The supply duct 92 may be configured to connect the ice making chamber inflow hole 282 to the upper space of the tray accommodation part. All the air introduced into the ice making inflow hole 282 may be supplied to the top surface of the ice tray 63.

The supply duct 92 may include an insertion part 922 inserted into the tray accommodation part 62 and an extension part 921 extending from one side of the insertion part 922 to the ice making chamber inflow hole 282.

The insertion part 922 may have a size corresponding to that of the first space 627*a* of the tray accommodation part 62. The insertion part 922 may have a bottom surface that is opened to supply the cold air to the entire space of one side (a right side in FIG. 47) of the top surface of the ice tray 63.

A lower end of the insertion part 922 may extend to be inserted into the first space 627*a*. The lower opening 923 of the lower end of the insertion part 922 may be inclined or rounded so that the insertion part 912 does not interfere with the ice tray 63 when the ice tray 63 rotates to transfer ices.

The extension part 921 may be disposed on a side surface of the insertion part 922. The extension part 921 may be configured to connect the insertion part 922 to the ice making chamber inflow hole 282. The extension part 911 may have both ends that are opened to communicate with the insertion part 922 and the ice making chamber inflow hole 282. Thus, all the cold air introduced through the ice making chamber inflow hole 282 may be discharged to the top surface of the ice tray 63 through the insertion part 922.

The first space 627*a* into which the insertion part 922 is inserted may be disposed at a position that is eccentric to one side (a right side in FIG. 47) with respect to the center of the ice tray 63. Also, the first space 627 may have a size less than that of the second space 626*a*. Thus, the air introduced into the front space may smoothly flow to the second space 626*a* of the other side (a left side in FIG. 47) via one side (a right side in FIG. 47) of the top surface of the ice tray 63.

The cold air passing through the second space 626*a* may flow over the rear surface of the tray accommodation part 62 to flow the outside of the ice maker 60. The cold air flowing to the outside of the ice maker 60 may drop down to flow to the outside of the ice making chamber 28 through the ice making chamber inflow hole 283 defined below the ice maker 60.

As described above, the cold air supplied by the supply duct 92 may flow from the right side to the left side on the top surface of the ice tray 63 so that the cold air is actively circulated in the ice maker 60. Thus, the ice making in the ice tray 63 may be promoted.

As necessary, the supply duct 92 may not be provided in the first space 627*a* but provided in the second space 626*a*.

A refrigerator according to an implementation includes a cabinet having a storage space, a door opening and closing the storage space, an ice maker provided in a rear surface of the door and including an ice tray, a cabinet duct provided in the cabinet to extend to the ice maker and thereby to supply cold air for making ice, an ice cover provided in the rear surface of the door and having a cover inflow hole, through which the cold air is introduced, in a position corresponding to an outlet of the cabinet duct, and a supply duct connecting the cover inflow hole to the ice maker to supply the cold air to the ice tray. The outlet of the supply duct may be disposed in a partitioned space above the ice tray and discharge the cold air at an eccentric position of a top surface of the ice tray.

Also, a refrigerator according to an implementation includes a cabinet having a refrigerating compartment and a freezing compartment, a refrigerating compartment door opening and closing the refrigerating compartment, an ice making chamber providing an insulation space in a rear surface of the refrigerating compartment door, an ice maker provided in the ice making chamber and including an ice tray in which ice is made, an ice making duct provided in the cabinet to supply cold air into the ice making chamber in a state in which the refrigerating compartment door is closed, an ice making chamber inflow hole opened to a wall of one side of the ice making chamber to communicate with the ice making duct, and a supply duct connecting the ice making chamber inflow hole to the ice maker to supply the cold air for making ice to the ice tray. The ice maker partitions an upper side of the ice tray into an inflow space and an outflow space, and an outlet of the supply duct is disposed in the inflow space above the ice tray.

The refrigerator according to the implementation may expect the following effects.

The cover inflow hole may be defined in the top surface of the ice cover into which the cold air supplied from the cabinet duct of the refrigerator body is introduced, and the cold air may be supplied through the supply duct connecting the cover inflow hole to the tray accommodation part of the ice maker.

Thus, the cold air introduced into the ice making unit through the cabinet duct may not be lost but be entirely supplied to the ice tray through the supply duct. Thus, the ice making rate on the ice tray may be more improved, and also, the ice making performance may be improved, i.e., the amount of made ice may increase.

Also, the inflow hole guide may be disposed on the circumference of the cover inflow hole to minimize the leakage of the cold air in the state in which the cover inflow hole and the duct outlet of the cabinet duct are separated from each other, and thus, the most of cold air may be supplied into the ice making unit.

Also, the supply duct may be eccentrically disposed to one side to the ice tray, and thus, the cold air may be supplied with directionality on the ice tray.

The ice tray and the mounting bracket on which the ice tray is mounted may be closely attached on the rear surface of the door and disposed maximally close to the door. Thus, the ice tray may be disposed on the position at which the mounting bracket has the widest horizontal width to maximize the ice making capacity of the ice tray and thereby to increase in the amount of made ice.

Also, the tray accommodation part in which the ice tray is accommodated may be partitioned into the front space and the rear space, and the cold air introduced into one space may be discharged to the other space via the top surface of the ice tray. In addition, the outflow space may have an area greater than that of the inflow space to promote the circulation of the cold air. Thus, the ice making performance of the ice tray may be more improved.

Also, the full ice detection member mounted on the ice maker may be disposed at the lower side and the front side of the ice tray to sufficiently secure the rear space of the ice tray, i.e., the space adjacent to the discharge of the cold air, thereby preventing the flow of the cold air from interfering with the full ice detection member. Thus, the air flowing to the upper side of the ice tray may easily flow to the rear side of the ice tray, thereby further promoting the circulation of the cold air.

Also, the cold air discharge hole may be provided in the space between the ice bin and the ice cover, and the cold air discharge hole may be defined to correspond to the height of the ice tray. Thus, the cold flowing to the upper side of the ice tray may be easily discharged through the cold air discharge hole to allow the cold air to be more smoothly circulated.

Also, in the supply duct, the upper opening serving as the inlet may have a surface area less than that of the upper opening serving as the outlet, and the substantial supply capacity of the cold air may be set through the lower opening. Thus, although a portion of the cold air is lost, the supply amount of cold air may be satisfied to prevent the ice making performance from being deteriorated.

Also, the outlet of the supply duct may be disposed to be perpendicular to the top surface of the ice tray. Thus, the cold air may be supplied in the direction that is perpendicular to the water surface on the ice tray. Thus, when the cold air is supplied, the surface of the water stored in the ice tray may be shaken by the vibration. Thus, the formation of the ice core may be promoted, and the ice making speed may be improved.

Also, the ice tray may be accommodated in the tray accommodation part, and the front, rear, left, and right surfaces of the ice tray may be closely attached to each other by the tray accommodation part to prevent the cold air from leaking. In addition, the front surfaces of the mounting bracket and the tray accommodation part may come into contact with the seating member to minimize the introduction of the cold air from the upper side to the lower side via the ice maker, thereby more promoting the circulation of the cold air of the ice making unit.

Furthermore, as described above, the cold air flowing to the outside of the ice maker may not flow to the ice bin but be discharged to the freezing compartment through the cold air discharge hole. Thus, the direct supply of the cold air into the ice bin may be minimized to prevent the surface of the ice within the ice bin from being vaporized and frozen by the supplied air.

Also, the full ice detection member that detects the full state of the ice stored in the ice bin may rotate in the same direction as the ice tray and be disposed at the lower side and front side of the ice tray.

Thus, the full ice detection member may not interfere with the rear flow of the cold air, and also, even though the ice cube drops down from the ice tray has an irregular height, the ice may move forward and backward to allow the full ice detection member to detect the full state, and thus, the detection area may be expanded. Thus, the full ice detection performance may be improved.

Also, the full ice detection member may be disposed in the space defined between the door-side wall and the cell of the ice tray to prevent the storage loss of the ice bin from occurring.

In addition, the full ice detection member may detect the full ice state at the same height as the full ice detection device that vertically moves according to the related art and also detect the full ice state in the front and rear directions through the rotation thereof. Thus, the wider area may be detected at the same height.

Also, the protrusion may be disposed on the rear surface of the ice bin at the full ice height of the ice bin. Thus, ice that is far away from the full ice detection member may be pushed forward by the protrusion to more effectively detect the full ice state. That is, when the distance of the ice bin in the front and rear directions is long, the ice outside the full ice detection area may move into the full ice detection area, and thus, the full ice detection area may be substantially more expanded.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet including a refrigerating compartment and a freezing compartment;

a door that is configured to open and close at least a portion of the freezing compartment;

an ice maker that is located adjacent to a rear surface of the door and that is configured to (i) supply water to make ice automatically, (ii) provide ice to an ice tray, and (iii) transfer ice automatically;

a cabinet duct that is located above the freezing compartment and that is configured to supply cold air to the freezing compartment or the ice maker;

an ice cover that is located above the ice maker, that includes a cover inflow hole through which cold air is introduced, the cover inflow hole being in a position that faces an outlet of the cabinet duct;

a supply duct that connects the cover inflow hole to the ice maker and that defines a cold air supply passage to an interior area of the ice maker; and an ice bin located below the ice maker, wherein the cover inflow hole is located within an upper opening of the supply duct, wherein the ice maker comprises a tray accommodation part that extends upwardly from a top surface of the ice tray to provide a space in which the top surface of the ice tray is accommodated, wherein the tray accommodation part is provided with a partition part that partitions a space within the tray accommodation part in a longitudinal direction of the ice tray into (i) an inflow space into which the supply duct is inserted and (ii) an outflow space from which cold air that has exchanged heat in the ice tray is discharged, and wherein a lower end of the ice cover and an upper end of the ice bin are spaced apart from each other to define a cold air discharge hole through which the discharged cold air from the ice tray is discharged.

2. The refrigerator according to claim 1, wherein the supply duct comprises:

an insertion part that extends to a first side of a top surface of the door, that is eccentric to the rear surface of the door, and that is inserted into the ice maker; and an extension part that is inclined from an upper end of the insertion part and that is connected to the cover inflow hole.

3. The refrigerator according to claim 2, wherein the insertion part includes an opening at a lower end of the insertion part, wherein the extension part includes an opening at an upper end of the extension part, wherein a surface area of the opening of the insertion part is smaller than a surface area of the opening of the extension part and a surface area of the cover inflow hole.

4. The refrigerator according to claim 1, further comprising an inflow hole guide that extends upwardly and that is configured to guide cold air discharged from the outlet of the cabinet duct to the cover inflow hole, wherein the inflow hole guide is located on a circumference of the cover inflow hole.

5. The refrigerator according to claim 1, further comprising a duct fixing part that extends downwardly and that is inserted into an open top surface of the supply duct to fix the supply duct.

6. The refrigerator according to claim 1, wherein the supply duct is inserted into the ice maker and extends upward to a point at which the supply duct is out of a rotation radius of the ice tray.

7. The refrigerator according to claim 1, wherein the supply duct includes an open bottom surface at a position that is eccentric in a front direction and a rear direction with respect to a center line that defines a rotation shaft of the ice maker.

8. The refrigerator according to claim 1, wherein the supply duct partitions a space above the ice tray into (i) an inflow space into which cold air is introduced and (ii) an outflow space from which cold air is discharged.

9. The refrigerator according to claim 8, wherein a volume of the inflow space is smaller than a volume of the outflow space.

10. The refrigerator according to claim 1, wherein the cabinet duct (i) is located between an outer case that defines an outer surface of the cabinet and an inner case that is spaced apart from the outer case to define the freezing compartment and (ii) communicates with a heat exchange space in the cabinet, the heat exchange space accommodating an evaporator.

11. The refrigerator according to claim 1, wherein the cabinet duct (i) is located on a top surface of an interior area of the freezing compartment and (ii) communicates with a heat exchange space in the cabinet, the heat exchange space accommodating an evaporator.

12. The refrigerator according to claim 1, wherein the ice bin is configured to store ice made by the ice maker.

13. The refrigerator according to claim 12, wherein the ice maker is located in a rear surface-side space of the door with respect to a center line of the ice bin.

14. The refrigerator according to claim 12, wherein the cold air discharge hole is defined at a height corresponding to a top surface of the ice tray.

15. The refrigerator according to claim 1, wherein the ice maker comprises:

a driving part that is configured to rotate the ice tray in a first direction, and a mounting bracket on which the ice tray is rotatably mounted, and wherein the supply duct includes a lower portion that is inserted into the tray accommodation part.

16. The refrigerator according to claim 15, wherein the ice maker comprises:

a full ice detection member that is coupled to the driving part below the ice tray and that rotates in the first direction to detect how much ice is filled in an ice bin while ice moves in a front direction or a rear direction, a driving shaft that is configured to rotate the ice tray, a detection member rotation shaft that is configured to rotate the full ice detection member, wherein the driving shaft and the detection member rotation shaft are located on a surface of the driving part, and a lever rotation shaft that is located below an ice tray rotation shaft.

17. The refrigerator according to claim 16, wherein the full ice detection member has a plate shape having a particular width and is bent below the ice tray to extend in a longitudinal direction of the ice tray.

18. The refrigerator according to claim 16, wherein the ice tray comprises:

a plurality of cells that are partitioned to make a plurality of ice cubes, and at least one of the cells has a width that gradually increases upwardly, and wherein, in a standby state, the full ice detection member is accommodated in a space between (i) an outer surface of the at least one of the cells and (ii) the rear surface of the door.

19. The refrigerator according to claim 1, wherein a volume of the inflow space is less than a volume of the outflow space.

* * * * *